US006241210B1

(12) United States Patent
Brindisi

(10) Patent No.: US 6,241,210 B1
(45) **Date of Patent: *Jun. 5, 2001**

(54) ADJUSTABLE MOUNTING DEVICE

(75) Inventor: Thomas J. Brindisi, Los Angeles, CA (US)

(73) Assignee: HangGlider Partners, Studio City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/263,156

(22) Filed: Mar. 5, 1999

Related U.S. Application Data

(63) Continuation-in-part of application No. 08/816,784, filed on Mar. 19, 1997, now Pat. No. 6,032,915
(60) Provisional application No. 60/013,671, filed on Mar. 19, 1996.

(51) Int. Cl.[7] ..... A47G 1/24
(52) U.S. Cl. ..... 248/476; 248/496
(58) Field of Search ..... 248/476, 485, 248/486, 489, 480, 495, 493, 496

(56) References Cited

U.S. PATENT DOCUMENTS

| | | | |
|---|---|---|---|
| 28,174 | 5/1860 | Hochstrasser . | |
| 309,980 | 12/1884 | Poposkey . | |
| D. 349,447 | 8/1994 | Daniller | D8/367 |
| 371,124 | 10/1887 | Croom . | |
| 1,017,174 | 2/1912 | Sanders et al. . | |
| 1,209,582 | 12/1916 | Hoernegel | 248/490 |
| 1,432,206 | 10/1922 | Poole, Jr. . | |
| 1,887,159 | 11/1932 | Knight . | |
| 1,908,200 | 5/1933 | Webster . | |
| 2,056,078 | 9/1936 | Slater | 248/243 |
| 2,117,714 | 5/1938 | Funk | 248/274 |
| 2,448,588 | 9/1948 | Greenberg | 248/495 |
| 2,478,256 | 8/1949 | Eysmann | 248/496 |
| 2,723,096 | 11/1955 | Schwartz | 248/495 |
| 2,740,603 | 4/1956 | Wofford | 248/494 |
| 2,757,890 | 8/1956 | Sutton et al. | 248/494 |
| 2,791,388 | 5/1957 | Hirt | 248/495 |
| 2,898,064 | 8/1959 | Scott | 248/496 |
| 2,943,831 | 7/1960 | Goss | 248/495 |
| 2,975,994 | 3/1961 | Goss | 248/496 |
| 3,063,666 | 11/1962 | Morrison | 248/496 |
| 3,112,912 | 12/1963 | Alvarez | 248/223 |
| 3,268,195 | 8/1966 | Hoffman | 248/225 |
| 3,285,549 | 11/1966 | Cook | 248/495 |
| 3,330,525 | 7/1967 | Weinstein | 248/496 |
| 3,360,229 | 12/1967 | Beyer | 248/496 |
| 3,838,842 | 10/1974 | McCracken | 248/476 |
| 3,895,775 | 7/1975 | Norton | 248/476 |
| 3,945,599 | 3/1976 | Spier et al. | 248/476 |
| 4,141,117 | 2/1979 | Van Gompel | 24/136 |
| 4,220,309 | 9/1980 | Eisen et al. | 248/542 |
| 4,222,544 | 9/1980 | Crowder | 248/495 |
| 4,278,224 | 7/1981 | Arakawa | 248/246 |
| 4,364,538 | 12/1982 | Tomlinson | 248/495 |

(List continued on next page.)

*Primary Examiner*—Ramon O. Ramirez

(57) ABSTRACT

A device that provides adjustable hanging of an item, such as a picture frame, on a vertical support such as a wall. The hanger may provide for automatic, in situ, and/or substantially continuous vertical adjustment, and/or horizontal adjustment. The adjustable hanger may comprise a first portion affixed to the vertical support, and a second portion that engages with the first portion and fixedly attaches to or is incorporated in the reverse side of the item, with one or both of the aforementioned portions being formed to allow automatic, in situ, continuous vertical adjustment and selective locking with respect to the other portion through a clamp, bias, or similar means; one or both these portions may also be formed to allow horizontal adjustment and repositioning with respect to the other portion. Also disclosed is a device for horizontally extending the available range of mounting positions for items that need to be supported by a stud.

20 Claims, 38 Drawing Sheets

U.S. PATENT DOCUMENTS

| | | | |
|---|---|---|---|
| 4,530,482 | 7/1985 | Berinson | 248/475.1 |
| 4,549,713 | 10/1985 | Magadini | 248/495 |
| 4,557,455 | 12/1985 | Benjamin | 248/496 |
| 4,611,779 | 9/1986 | Leonard, Jr. | 248/476 |
| 4,641,807 | 2/1987 | Phillips | 248/480 |
| 4,656,698 | 4/1987 | Arakawa | 24/136 |
| 4,736,855 | 4/1988 | Arakawa | 211/94 |
| 4,786,022 | 11/1988 | Grieshaber | 248/287 |
| 4,863,135 | 9/1989 | Mellor et al. | 248/328 |
| 4,883,247 | 11/1989 | Crandall | 248/542 |
| 4,892,284 | 1/1990 | Kelrick | 248/476 |
| 5,056,954 | 10/1991 | Flux et al. | 403/330 |
| 5,058,847 | 10/1991 | Arakawa | 248/328 |
| 5,069,411 | 12/1991 | Murphy | 248/476 |
| 5,133,526 | 7/1992 | Olmsted | 248/495 |
| 5,303,895 | 4/1994 | Hart | 248/475.1 |
| 5,342,014 * | 8/1994 | Wilson | 248/495 X |
| 5,359,870 | 11/1994 | Reutlinger | 70/456 |
| 5,454,542 | 10/1995 | Hart | 248/494 |
| 5,480,120 | 1/1996 | Bruner | 248/477 |
| 5,584,462 | 12/1996 | Reese | 248/477 |
| 5,605,313 | 2/1997 | Erickson et al. | 248/467 |
| 5,806,826 | 9/1998 | Lemire | 248/476 |
| 5,931,439 | 8/1999 | Lemire | 248/493 |
| 5,947,438 | 9/1999 | Lemire | 248/476 |

* cited by examiner

FIG. 1
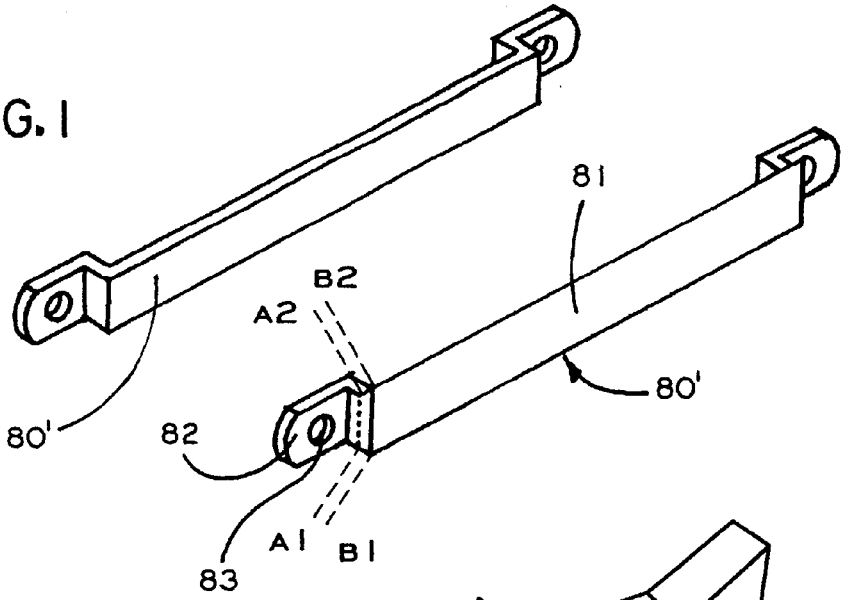
FIG. 1A
FIG. 2
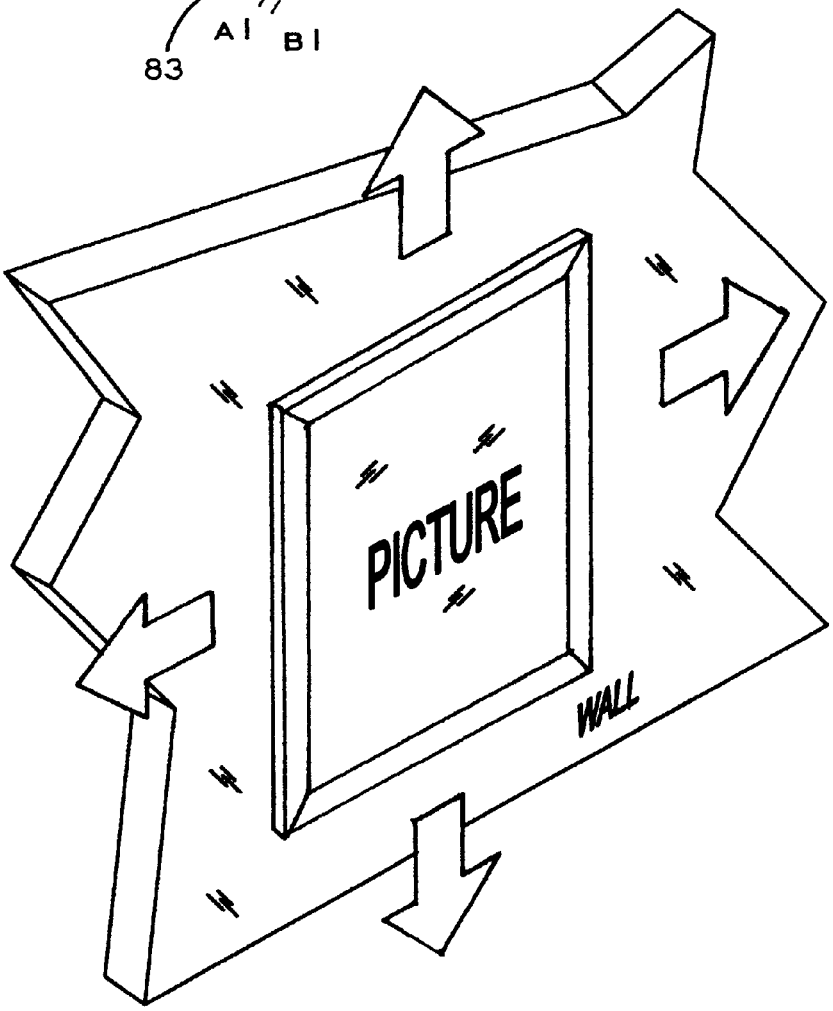

FIG. 12
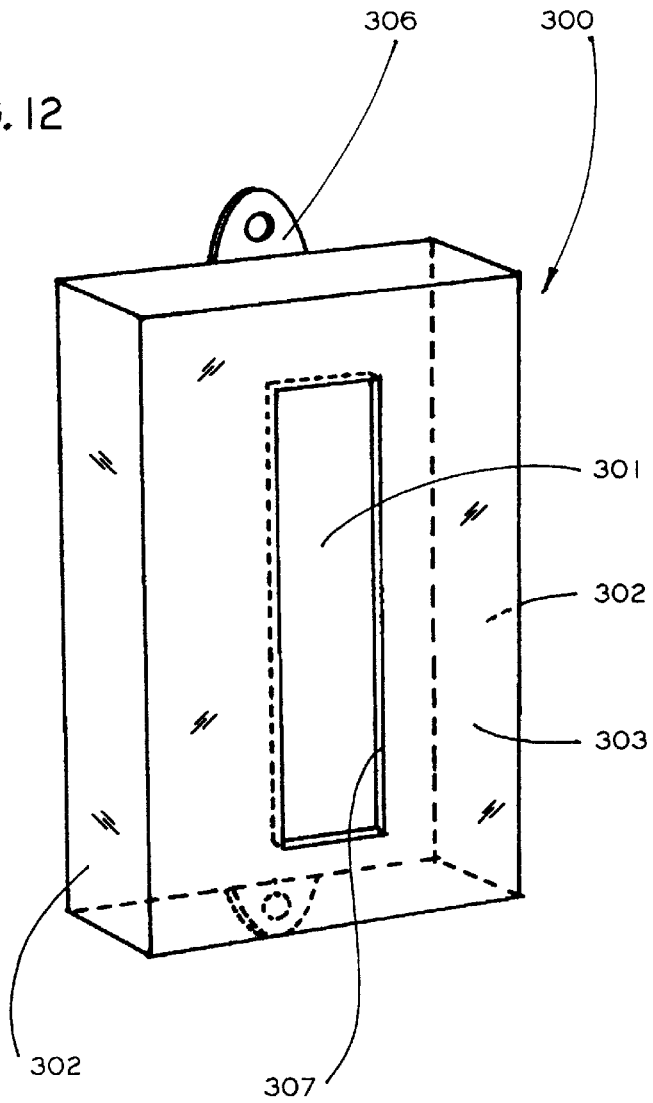
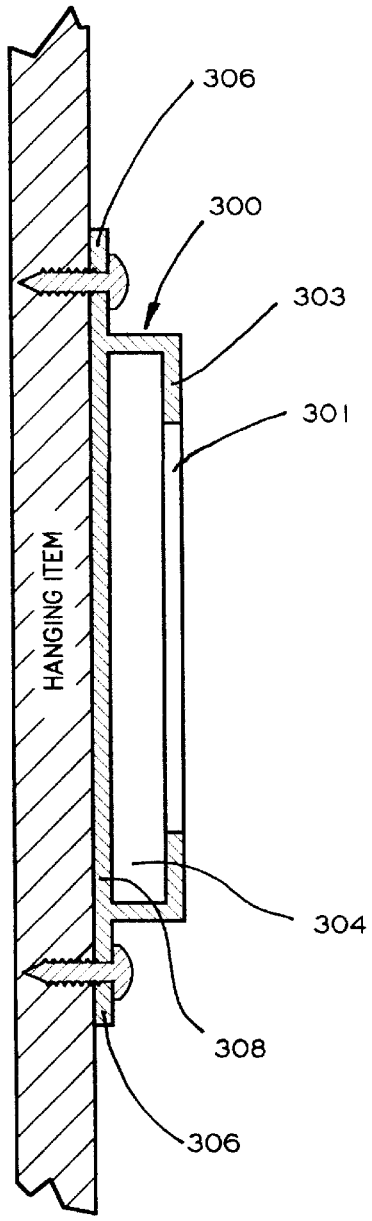
FIG. 12A

FIG. 30
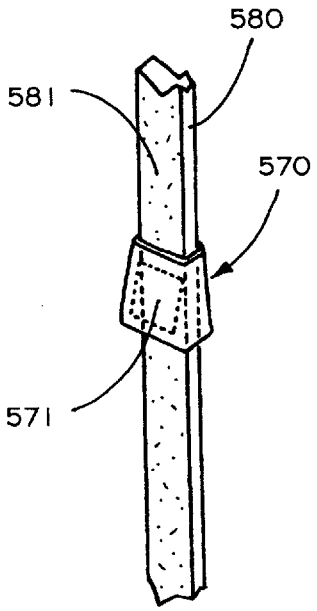
FIG. 30A
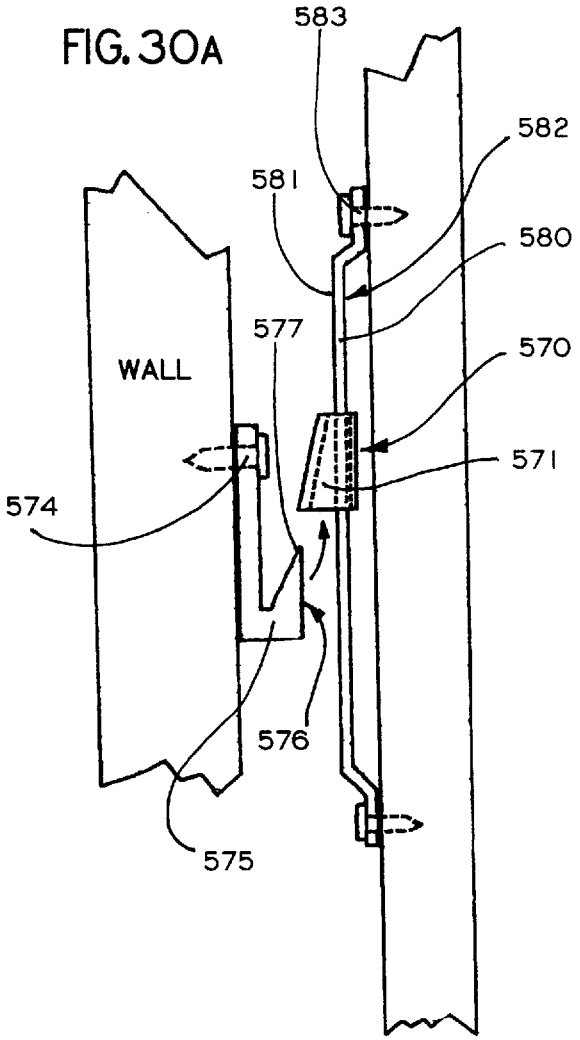
FIG. 31
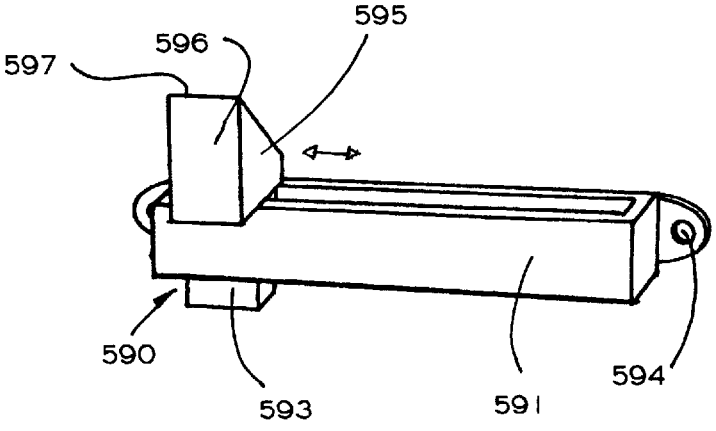
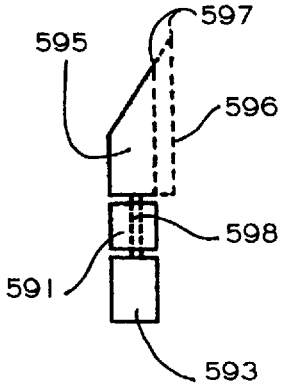
FIG. 31A

ADJUSTABLE MOUNTING DEVICE

This application is a continuation-in-part of U.S. patent application Ser. No. 08/816,784, which was filed on Mar. 19, 1997 and issued as U.S. Pat. No. 6,032,915 on Mar. 7, 2000, and which referenced and claimed. The benefit of provisional U.S. patent application Ser. No. 60/013,671, which was in turn filed on Mar. 19, 1996, and entitled "Adjustable Wall Mounting Device." The disclosures of those applications are incorporated by reference herein.

BACKGROUND OF THE INVENTION

The field of the present invention pertains to the art of picture hangers, and securing devices and mounting devices for items that have a substantial vertical aspect. More particularly, the present invention relates to a mounting or positional securing device that can be adjusted to different fixed positions (of the item vis-à-vis the support that it is secured to) without requiring that fastening means into the supporting surface be removed and reaffixed.

The prior art reflects a long-standing endeavor to create mounting devices which simplify the process of positioning and mounting an item and which expand the latitude concerning where and how a mounted, hanging, or otherwise secured item can be repositioned. For example, as has been repeatedly noted in a multitude of patents granted over the last century (including those discussed below, the disclosures of which are incorporated herein by reference), hanging an item such as a picture or painting in a precise desired position on a wall can prove frustrating and time consuming. For one thing, it is often difficult to discern exactly where an item will look best until it has already been hung in the vicinity of the desired position, and then, from the proper perspective, viewed hanging. Even when an exact desired position is known in advance, imprecision or errors in measurement usually occur (to different degrees depending on the hanging hardware used) and commonly prevent that location from actually being obtained on the first try. Finally, even when an exact position is known in advance, and it is satisfactorily obtained through luck or work, the addition or rearrangement of furniture or other hanging items is often discouraged or rendered less attractive because of the disincentive to tamper with the location of the existing item. In addition to the time that is wasted and the less than aesthetically satisfactory arrangements that are often lived with, the removal and reaffixing nails or screws is a common occurrence that causes damage to the wall surface and sometimes failure of support for the hanging item. While prior artisans in the field have long recognized these difficulties and have created myriad devices aimed at solving them, the devices have fallen short of providing satisfactorily robust yet simple ways for the end user to hang an item.

Definitions

The following definitions generally apply throughout this specification to the defined terms themselves as well as their roots, derivatives and other variants, as long as the same concept is sought to be invoked thereby. Also, the definitions of further terms peculiar to this specification will become evident from their usage herein.

First, "automatic" adjustability means that the hanging position of an item can be adjusted (in the applicable directions): (1) without disengaging the item from the support such that letting go of it then would allow it to fall to the ground (i.e., "in situ"), (2) without requiring movement of the hanging item to a position significantly removed from that position being sought, and (3) without requiring direct manipulation (by hand or by tool) of any portion of the device residing substantially recessed (i.e., inconveniently concealed from reach) between the hanging item and the support. Automatic activation of adjustment can be achieved by the user manually applying a selected force or series of forces on the item itself, and/or on a part of the assembly that is conveniently accessible (for example, an activation "trigger" or "lever" placed conveniently at or lying flush or near flush with an item's frame edge). The term "automatic" is not meant to exclude devices which incorporate the automatic nature of the invention taught herein, but simply add an additional locking means technically or nominally requiring some user interaction with a recessed part of the assembly (e.g., an added security locking means that requires a tool for initial unlocking) prior to an otherwise automatic process of adjustment.

Also, "continuous" adjustability means that adjustment occurs over a substantially continuous range rather than falling into a discrete group of selectable positions. This definition is not intended to exclude mechanisms having a minor degree of discontinuities imposed by supplemental means, such as relatively fine incremental teeth, which are added to improve an otherwise continuous mechanism's holding of a vertical position (as exemplified by the embodiment of FIGS. 35–41).

Further, when it is indicated herein that an embodiment provides for "ready engagement and disengagement of the item," or is "readily engageable and disengageable from the support," or the like, it is meant that an item may be readily hung on a support and removed therefrom as desired, through facile manipulations that do not involve any significant disassembly or any detachment of parts of the assembly affixed to the support or the subject item.

Finally, terms such as "item" and "frame" are used herein with some overlap. For example, depending on the logical context, the term "item" may refer only to an item such as a diploma or picture, or it may also be inclusive of the "frame" in which such an item is framed, and/or inclusive of an attached or incorporated mounting device. Likewise, the term "frame" may refer just to the object in which an item is framed, or it may include the framed item and/or mounting device. These terms are simply chosen as a convenience in illustrating the concepts of the present invention, and are not meant to limit the types of items that may be adjustably held in position thereby. For example, a shelf might be considered a "hanging item" for the purposes of the present invention, despite the fact that it does not have a distinct "frame."

The Prior Art

The prior art includes a series of patents directed to devices that provide two-way adjustability that is only horizontally continuous and automatic. These patents include U.S. Pat. No. 5,480,120, issued Jan. 2, 1996 to Bruner; U.S. Pat. No. 3,945,599, issued Mar. 23, 1976 to Spier et al.; U.S. Pat. No. 3,063,666, issued Nov. 13, 1962 to Morrison; U.S. Pat. No. 2,757,890, issued Aug. 7, 1956 to Sutton et al.; and U.S. Pat. No. 2,740,602, issued Apr. 3, 1956 to Wofford. The devices taught in each of these patents essentially comprise a first portion having a series of horizontal slots (or pairs of slots) and a second portion comprising an opposing hook(s) or the like which seats in any member of the series of horizontal slots. Some of the aforementioned patents disclose devices with the first portion attached to the wall and the second to the picture, while the others teach the converse arrangement. In either case, a measure of vertical adjustability is provided by disengaging the hanging item and its associated hanging means from the wall support means, and reseating the hook in a different member of the series of horizontal slots. In most of the devices, horizontal adjustability is provided by the hook(s) or the like being free to slide laterally along the horizontal length of the opposing slot(s) with which it is engaged. Most significantly, however, in each of these patents, the vertical adjustability is not substantially continuous in nature, and instead falls into a group of discrete selectable positions. Also, in each of these patents, vertical adjustment requires disengagement of the hanging item from the wall support, meaning that if the person hanging the item were to let go of the item, it would presumably drop to the floor. Moreover, reengagement during vertically adjustment can involve somewhat of a "blind" process.

The prior art also teaches devices which provide for continuous, two-way, but non-automatic adjustability, requiring that adjustments be made directly to an assembly which is not conveniently accessible behind the hanging item. For example, U.S. Pat. No. 4,892,284, issued Jan. 9, 1990 to Kelrick, and U.S. Pat. No. 2,791,388, issued May 7, 1957 to Hirt, both teach devices that allow for continuous, two-way adjustability effected by the manipulation by tool (e.g., screwdriver) of a rack and pinion or the like. These devices present a clear inconvenience in that the user is required to insert a tool between the hanging item and wall and then, with some precision, locate the adjustment means. In addition, these devices require that the user have a suitable tool handy whenever adjustment to the hanging item is desired, and they also tend to necessitate the existence of a substantial gap between the hanging item and the wall in order to accommodate the device as well as clearance for the tool to be inserted.

Another example of a two-way, continuously adjustable device is found in U.S. Pat. No. 4,549,713, issued Oct. 29, 1985 to Magadini. Magadini discloses vertically disposed rods which slide along a horizontal wall support, and upon which spring biased "L" or "I" shaped metal hanger straps are locked in place against downward vertical movement. This device, however, is not automatically adjustable in that vertical adjustment requires direct manual location, manipulation (i.e., overcoming the spring bias of a hanger strap and moving it to a different position), and resetting of the hanger straps. Further, the Magadini device may require the hanging item to be removed from the wall in order to manipulate the hanger straps. Also, because the horizontal wall support is (by necessity) at the uppermost position compared to the rest of the assembly, part of the assembly itself is visible, which is generally not aesthetically desirable.

Another example of a non-automatic adjustable device is disclosed in U.S. Pat. No. 2,898,064, issued Aug. 4, 1959 to Scott. The Scott device comprises a beaded chain that attaches to the item to be hung, and an assembly that attaches to the wall and includes a horizontally sliding member with slots into which the beaded chain can be connected at various positions along the chain. This device is of course not automatic because the beaded chain must be manually reached, pulled out of the slots, and reinserted at a different position in order to accomplish vertical adjustment. It also appears that the hanging item may have to be disengaged from the wall for the beaded chain to be reinserted.

The prior art includes various other patents disclosing two-way, non-automatic adjustable devices. Beyond the disadvantages noted above, these devices require the hanging item be repeatedly removed, set somewhere, and then replaced, and further require some guesswork as to exactly where an item will hang after the device has been adjusted a given amount. These non-in situ adjustment process creates temporal lapses that undermine visual and mental comparison of the item hanging in different positions.

U.S. Pat. No. 4,641,807, issued Feb. 10, 1987 to Phillips teaches such a device. This device comprises a mounting stud attached to a slotted body plate that is secured to the wall by a screw passing through the slot and into the wall. When the screw is loosened, the body plate can be slid along and rotated about the screw; the body plate stays in position once the screw is retightened. This device requires that the hanging item be disengaged and set somewhere while the assembly is directly manipulated and a new configuration secured. It also appears that the device affords at most one screw to secure the body plate to the wall; thus, hanging an item anywhere other than with its center of mass directly above the screw will create a rotational torque in the plane of the wall tending to cause the whole assembly to rotate out of level, undermining horizontal adjustability.

The prior art also includes patents directed to devices that provide vertical but not horizontal adjustability. One example is U.S. Pat. No. 4,557,455, issued Dec. 10, 1985 to Benjamin. Beyond not providing horizontal adjustability, however, this toothed latching device is not fully automatic because it only allows upward movement when engaged, it is "one-way." With the Benjamin device, in order to adjust a hanging item downwardly, the item must first be moved all the way to the top of its adjustment range, whereat the latch disengages, and then all the way to the bottom of its adjustment range whereat the latch reengages. Then, with the latch engaged, the item is moved upwardly until the desired lower position is reached. Consequently, whenever a hanging item is desired to be moved downwardly at all, it must be moved entirely out of its existing position, the previous position (minus the desired downward adjustment) remembered or marked, and then relocated. Each time an item is adjusted just past its desired position, the entire process must be repeated.

Another type of prior art device providing vertically-only, non-automatic continuous adjustability, is disclosed in U.S. Pat. No. 3,285,549, issued Nov. 15, 1966 to Cook, and U.S. Pat. No. 2,943,83 1, issued Jul. 5, 1960 to Goss. These devices are operationally somewhat similar to the Magadini device described above, in that they each require manual manipulation of the recessed assembly in order to effect vertical adjustments.

Finally, U.S. Pat. No. 1,432,206, issued Oct. 17, 1922 to Poole, Jr., discloses a marginally relevant device that provides automatic, continuous, vertically-only adjustability. The device is a mirror support comprising a clamping portion affixed to the mirror, and a vertically disposed rod affixed to the wall. When the mirror is disposed in the vertical plane, the clamping portion clamps the rod; when the bottom of the mirror is tilted upward, the clamping portion no longer clamps the rod, allowing it to slide up or down on the rod until the mirror is again disposed vertically by the user. Inasmuch as there appears no ready way to remove the rod from the wall or to remove the clamp from the mirror, the clamping portion is permanently secured in sliding relation to the rod, and there is no way to readily engage or disengage the mirror from the wall. It should also be noted that, because the portion of the device which provides the range of vertical adjustability (namely, the rod) is attached to the wall, visible overhang of part of the assembly itself is apparently unavoidable. It should be further noted that the Poole, Jr. device necessitates a significant gap between the hanging item and the wall, both because the clamp must be distanced from the rear of the item to provide clearance for pivoting the item on the rod without hitting the rod, and because the portion of the clamp facing the wall must have clearance from the wall in order to allow pivoting on the rod without hitting the wall.

The prior art also contains numerous teachings concerning horizontally-only adjustable devices, for example, U.S. Pat. No. 5,454,542, issued to Hart on Apr. 19, 1994.

Thus, there clearly remains a need for a mounting device that allows for readily disengageably hanging an item with automatic, substantially continuous vertical adjustability. A further need is for a mounting device that provides automatic, substantially continuous, two-way adjustability, with or without ready disengageability of the supported item. Another need is for a mounting device which can increase the usable horizontal hanging area for items that require the support of a wall stud, so that the position of studs is not as determinative of the placement of such items. The foregoing description of existing needs is not meant to limit the invention in any way, and it should be understood that an embodiment of the invention need only serve one of the aforementioned needs or one of the other needs set forth herein.

SUMMARY OF THE INVENTION

The present invention may take the form of a releasably engageable, adjustable mounting device that allows automatic, substantially continuous adjustment to at least the vertical position in which an item is mounted, or it may take the form of an releasably or fixedly engageable adjustable mounting device that allows automatic, substantially continuous, two-way adjustment to the position of a supported item. Alternately, it may take the form of a device that conveniently permits extension of the horizontal range available for securely hanging an item with the support of an underlying stud. The above and other objects, features and advantages of the invention will become apparent from the following description of preferred embodiments, taken in conjunction with the accompanying drawings.

BRIEF DESCRIPTION OF THE DRAWINGS

The accompanying drawings, along with the description, serve merely to illustrate and explain the concepts underlying the present invention, and to describe preferred embodiments thereof. From these representative embodiments, many other configurations of the invention will be readily apparent to those of skill in the art.

FIGS. 1 and 1A are top front left perspective views of two versions of a generic wallbar that may be part of the two-way adjustable embodiments such as those shown in FIGS. 8–29, 33–34, and 42–67;

FIG. 2 is a perspective view of an item hanging on a vertical flat surface wherein an automatic, substantially continuous, two-way adjustable embodiment of the present invention (not shown) is attached to the rear of the hanging item and/or to the flat vertical surface, showing the two-way automatic repositioning of the item that can be accomplished while the item remains hanging in situ;

FIGS. 9 and 9A are a partial side view and partial transparent perspective view of an embodiment similar to that of FIG. 8, showing the wedge nearly trapped in the brake trap;

FIGS. 12 and 12A are a perspective view and cross-sectional side view of a generic box that may be adapted for use in the devices of FIGS. 13–21, showing the attachment of the box to the rear of an item to be hung;

FIGS. 30 and 30A are a partial perspective view and a side transparent view of an embodiment providing vertical adjustability, showing how the hook projecting from the wall is poised to be trapped in the vertically sliding lock trap;

FIGS. 31 and 31A are a perspective view and a side transparent view of part of an embodiment similar to that shown in FIG. 30 but providing two-way adjustability;

DETAILED DESCRIPTION OF PREFERRED EMBODIMENTS

There are many applications for the present invention, and the specific embodiments described herein are not meant to limit such applications. Thus, while the following detailed description focuses on embodiments that may be of a scale and character appropriate to the hanging of pictures, paintings and the like, this is simply for the sake of furthering the clarity of the discussion. The invention taught herein, however, is envisaged as encompassing a wide range of applications extending to anything that can benefit by adjustable mounting. Examples include advertising or informational displays, art exhibits, and various other flat or even three dimensional items, including items having utilities or functions other than as a mere display, and items that are intended to have direct or remote interaction with a person or other object.

Regarding the particular embodiments of the invention that are described herein in detail, it must be kept in mind that the cross-sectional shapes, thickness, widths and lengths of the various elements, as well as the particular mechanisms and configurations, can readily be varied to afford different combinations of strength, operational dynamics, and overall thickness of the assembly. Only a few representatives of the many possible different configurations are shown. However, it is preferable (although not mandatory) that an embodiment be: (1) easy to understand and adjust; (2) easy to level; (3) capable of securing a hanging position that is not too easily disturbed by vibration or the like; (4) sufficiently durable so as to allow a reasonable life cycle of adjustments; (5) at most minimally visible when hung; and (6) not prone to scratching, scuffing, or marring the wall.

Proceeding to the figures, FIG. 2 shows generally how two-way (i.e., horizontally and vertically), automatic, substantially continuously adjustable embodiments of the invention are movable to different positions while hanging on the wall. Simultaneous, diagonal two-way adjustment is also possible with some embodiments. It should be noted, however, that two-way adjustability of any kind is not strictly a requisite to the present invention, certain embodiments of which provide vertical or horizontal (in the case of the stud extender) adjustability only.

Figure 3:
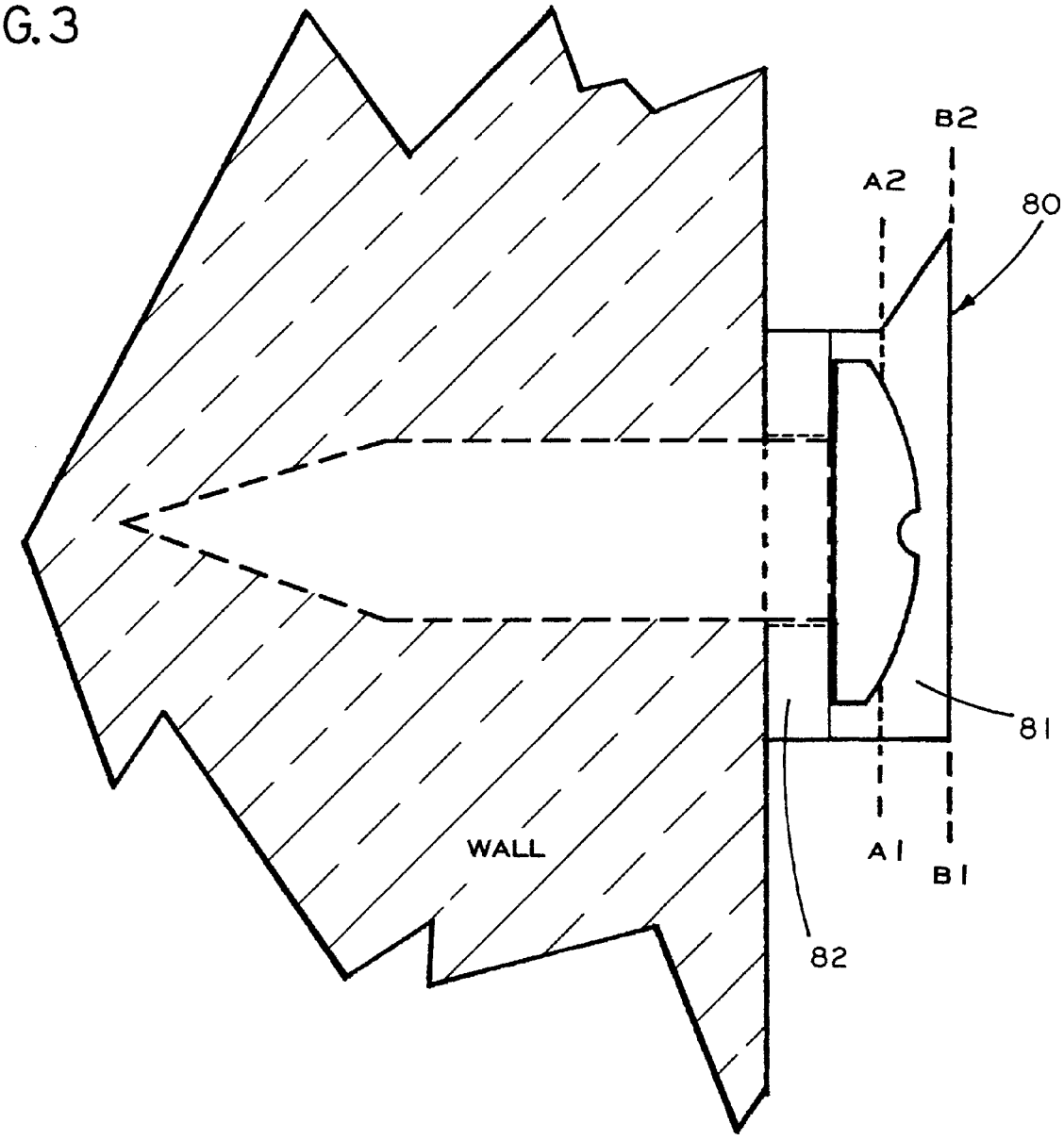
FIG. 3 is a side transparent view of a generic version of the wallbar shown in FIG. 1A viewed along the lines a1–b1 and a2–b2, with the wallbar attached to the wall by screws or nails.
Figure 4:
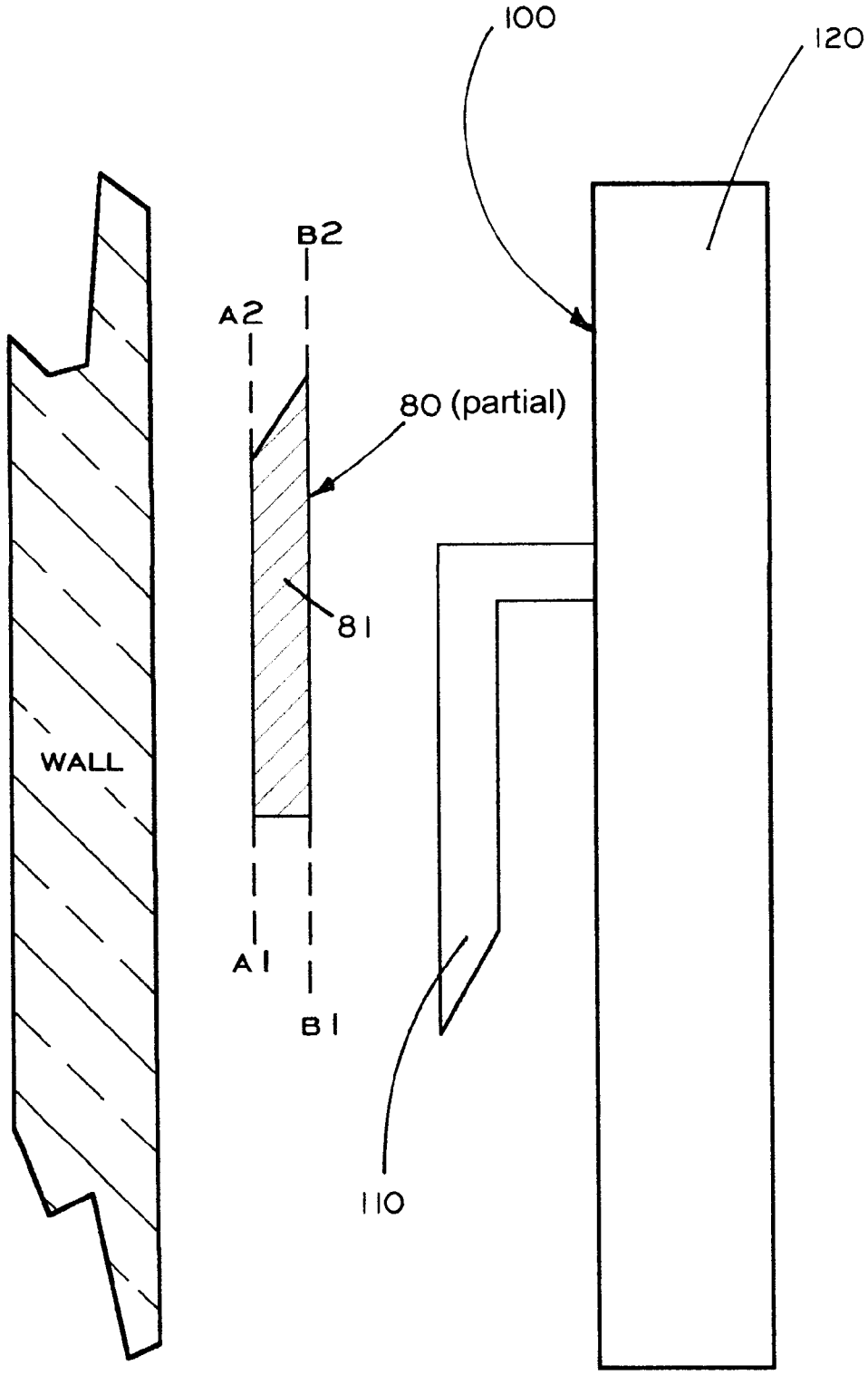
FIG. 4 is a partial side view of part of the wallbar (mounted to the wall) and the rest of a generic two-way adjustable assembly (mounted to an item to be hung, not shown) of an embodiment such as those shown in FIGS. 8–29, 33–34, and 65–66, with the rest of the adjustable assembly being raised into position (along with the item to be hung, not shown) for mounting on the wallbar.
Figure 5:
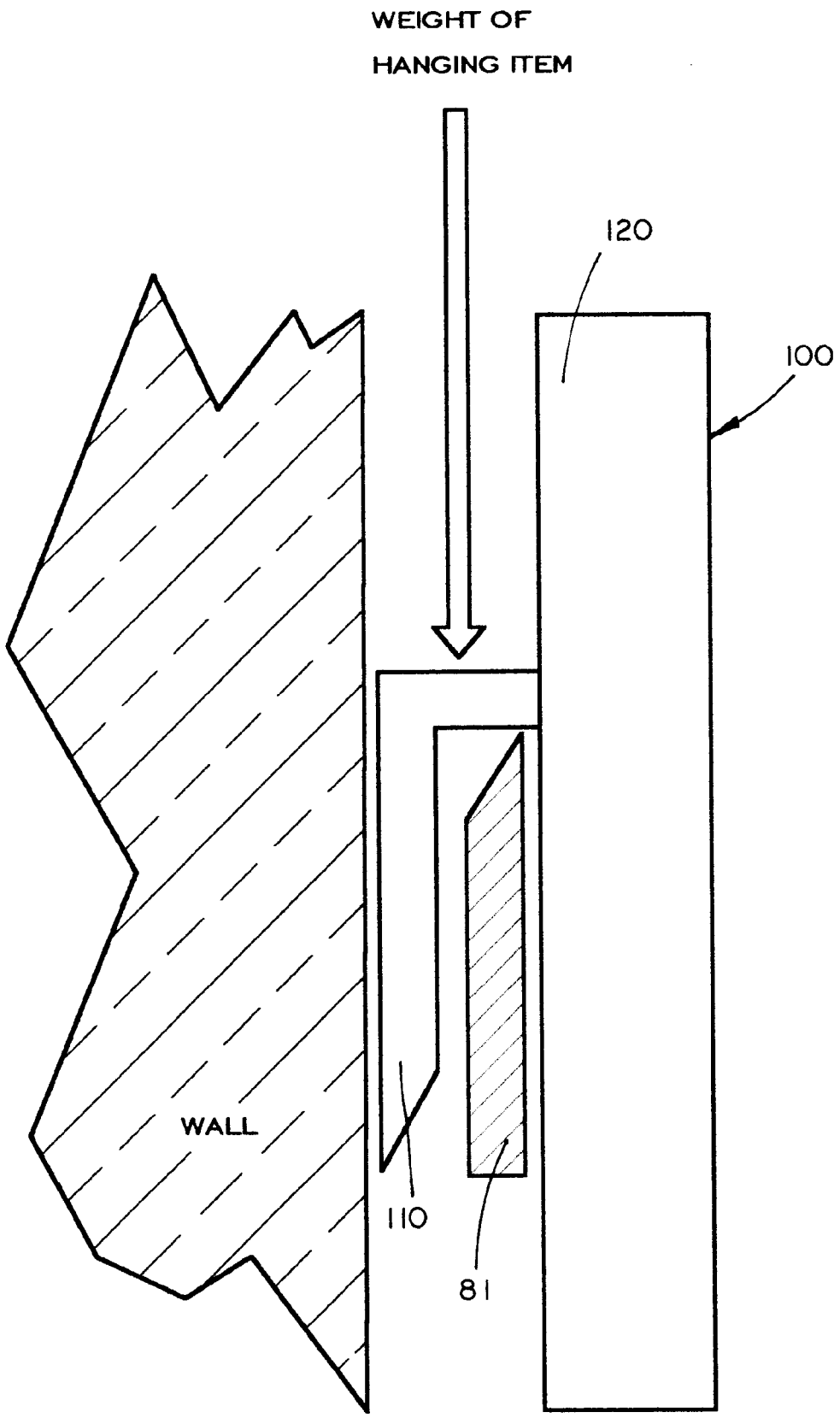
FIG. 5 is a partial side view similar to FIG. 4, except that the assembly is in a mounted position with the hook seated on the wallbar and the arrow depicting the force exerted by the weight of the hanging item (not shown) being supported by the wallbar mounted to the wall.

FIGS. 1 & 1A show a perspective view of a generic wallbar 80 or 80' that attaches to the wall (with nails or screws through holes 83 of ears 82) for use with most of the two-way adjustable embodiments described herein. FIG. 3 shows a side transparent view of generic wallbar 80 viewed along the lines a1–b1 and a2–b2, with wallbar 80 being attached to the wall. It should be noted that in many of the embodiments of hangers described herein, a horizontal slot or a series of such slots can be preformed into the surface on which an item is to be hung, permitting boundless horizontal adjustability in a way that can be aesthetically acceptable. This would be particularly suitable for art galleries and the like.

Figure 6:
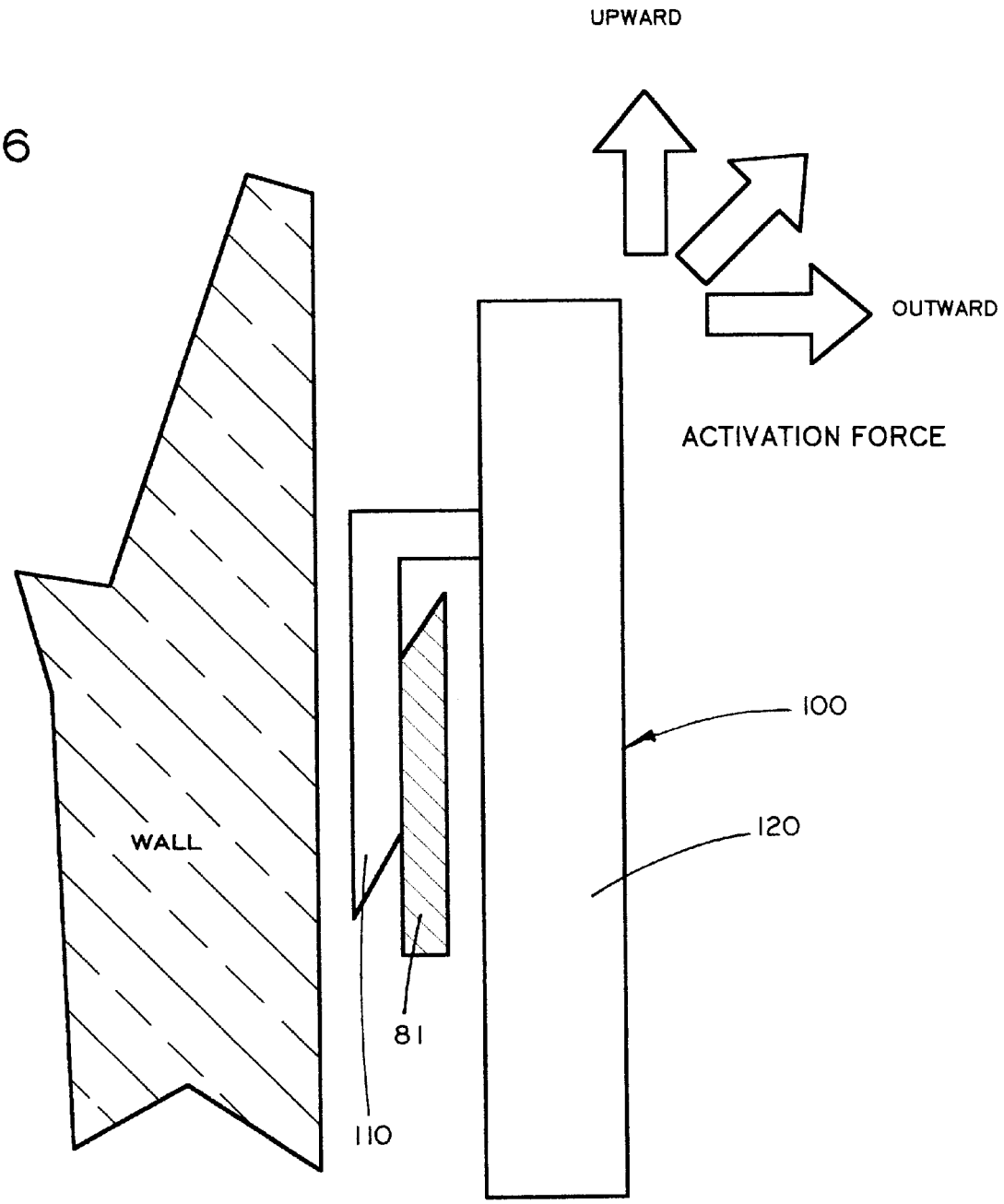
FIG. 6 is a partial side view similar to FIG. 5, except that the assembly is in an activated position caused by pulling upward and outwardly (as in the embodiments of FIGS. 10–21) on the hanging item (not shown)
Figure 7:
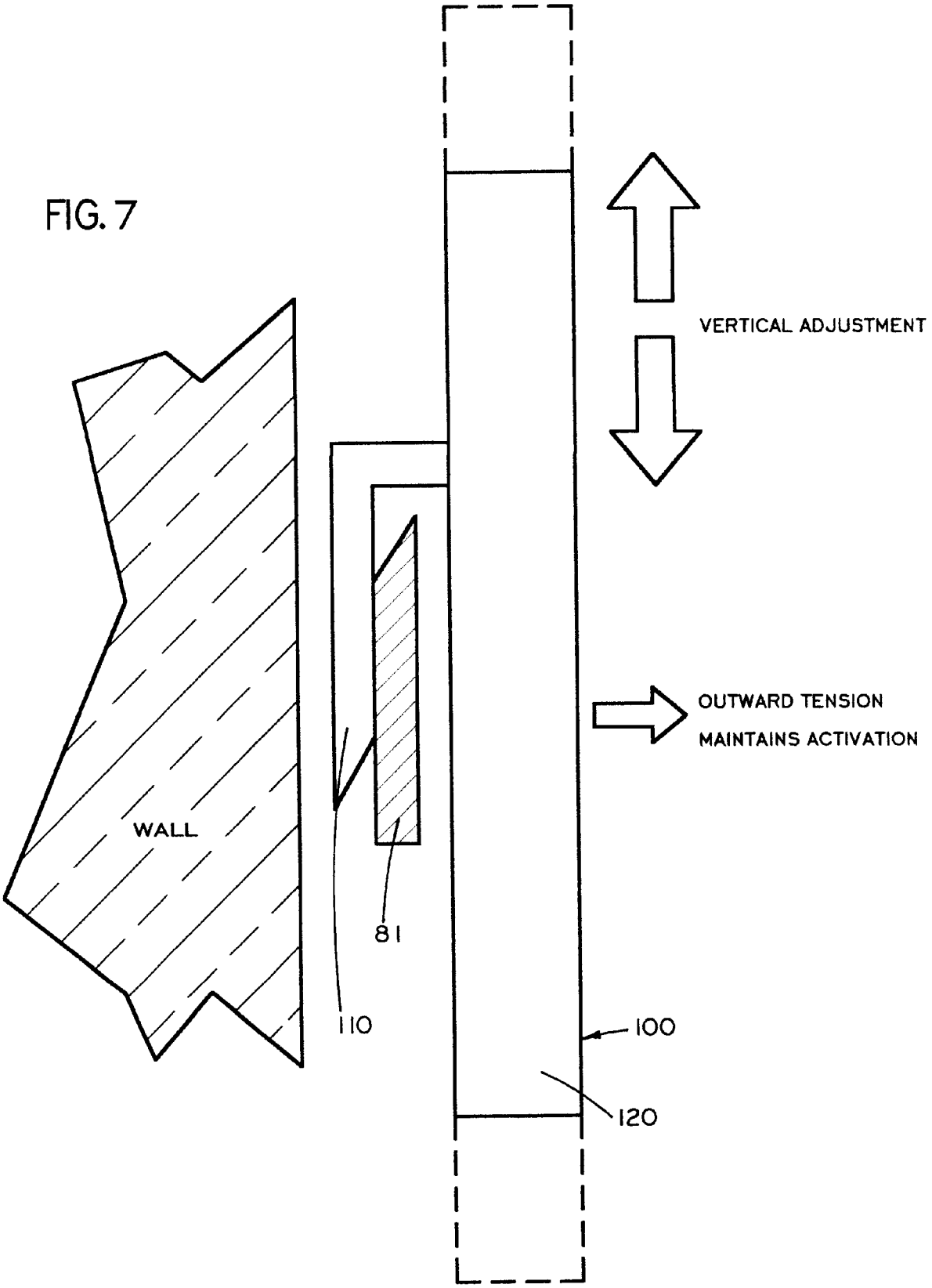
FIG. 7 is a partial side view similar to FIG. 6, with the assembly remaining in its activated position (as maintained in the embodiments of FIGS. 10–21), but also showing vertical adjustment of the assembly (indicated in broken lines)

FIGS. 4–7 show a sequence wherein a generic vertically adjustable mounting device having a downwardly pointing hook mounted on the rear of the item to be hung is seated on the horizontal bar 81 of generic wallbar 80 (see FIG. 1) and then activated for vertical adjustment. Typically in the embodiments of FIGS. 10–21, this activation is achieved by pulling upward and outward on the hanging item, as shown in FIG. 6, and adjustment is typically accompanied by maintaining some degree of outward (away from the wall) tension on the hanging item, as shown in FIG. 7. The operation of the embodiments of FIGS. 8–9, 22–29, and 33–34 is similar, except that they are activated by inward or inward and upward pressure, as discussed below. The embodiments of FIGS. 42–67 are vertically activated by pressing on an activation button or toggling a lever(s) conveniently placed at an edge of the frame.

FIGS. 8–29, 33–34, and 42–67 illustrate embodiments of two-way, automatic, substantially continuously adjustable mounting devices wherein a vertically adjustable, downward pointing hook assembly is mounted on the rear of the item to be hung, and the hook assembly, in turn, mates with and horizontally adjusts on a wallbar 80, shown in FIG. 1, that is mounted to the wall (as shown in FIG. 3). In reviewing the Figures, it should be kept in mind that, although the wallbar 80 shown in FIG. 1 presents a further aspect of the present invention, it is not a requisite. In other words, there are readily apparent embodiments of the present invention that are quite similar to many of the embodiments of FIGS. 8–29, but which only provide vertical adjustability, with the wallbar being entirely omitted, and a suitable interface (instead of a downwardly pointing hook) provided for catching a nail or the like protruding from the wall.

Figure 8A:
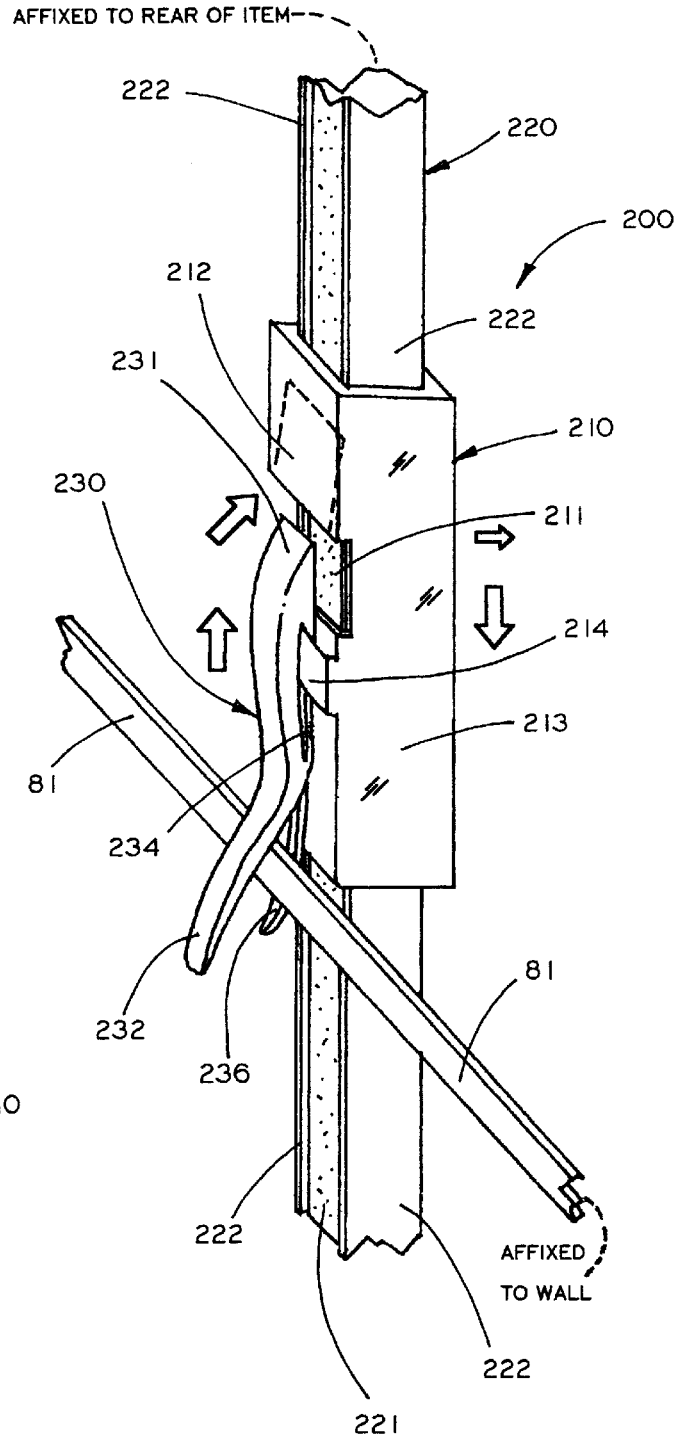
FIGS. 8 and 8A are perspective views of a two-way adjustable embodiment having a locking hook and wedge that wedges into a brake lock trap, showing force applied on the item (indicated with arrows on the right) to seat the hook on the wallbar and pivot the wedge toward and up into the brake lock trap (indicated with arrows on the left)
Figure 8:
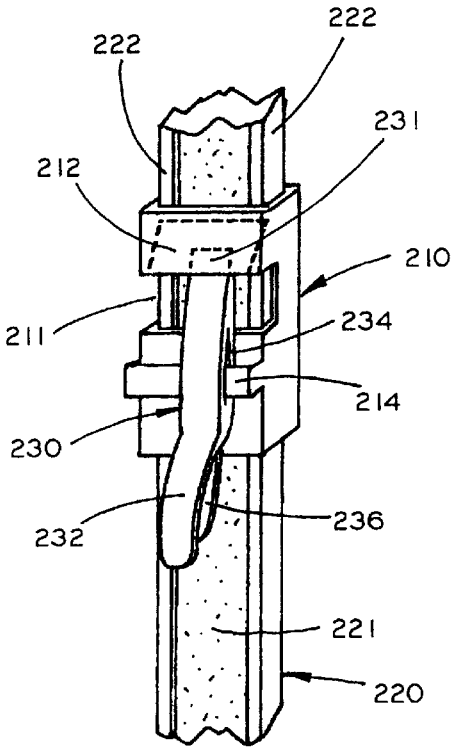

FIGS. 8 and 8A show an adjustable mounting device utilizing a wedge in sliding trap design. Vertical bar 220 is fixedly attached to the rear of the item to be hung, and includes guide rails 222 and brake strip 221. Vertically sliding along guide rails 222 and over brake strip 221 is sliding lock trap 210. Sliding trap includes body 213, brake trap window 211, trap pocket 212, and hook holder bar 214. Mounted on holder bar 214 is locking hook and wedge 230. Locking hook and wedge 230 vertically slides and partially pivots on bar 214 along slot 234. At the upper end of hook and wedge 230 is wedge 231, and at the lower end is hook 232 and wallbar catch 236. On the side of wedge 231 facing brake strip 221 is a high-friction surface, such as rubber or metal grating, chosen to provide the maximum grip with the surface of the material chosen for brake strip 221. The other side of wedge 231 facing the interior of pocket 212 may have a slick surface so that wedge 231 slides as far into pocket 212 as possible to increase wedging (described below). Pocket 212 is shaped with a triangular cross-section, coming close to meeting with bar 220 at the top section of pocket 212, and being its furthest away from bar 220 at its bottom section. Slot 234 extends down far enough in locking wedge and hook 230 so that holder bar 214 can almost, but not quite, contact the lowest point of slot 234 without wedge 231 being fully jammed in pocket 212. Slot 234 extends up far enough so that when holder bar 214 is proximate to the uppermost extent of slot 234, wedge 231 is fully within window 211 when viewed frontally.

In operation, the item to be hung is lowered with hook 232 above bar 81 (see FIG. 1 regarding the connection of bar 81 to the wall), such that hook 232 catches on bar 81. At this point, the item is pulled just slightly outward to ensure that wedge 231 pivots slightly and is fully within window 211. Then the item is lowered slightly further, causing hook and wedge 230 to slide upwardly on holder bar 214 until wedge 231 inserts into and then jams in pocket 212 between the interior face of pocket 212 and brake strip 221. Wedge 231 jams between pocket 212 and strip 221 because of the complementary shapes (generally wedge-shaped or triangular) of the brake strip facing side of wedge 231 and the interior face of pocket 212. At this point, due to the aforementioned jamming or wedging of wedge 231 between the sliding trap 210 and the vertical bar 220, sliding lock trap 210 is no longer able to move vertically along bar 220, and is locked in place; consequently, so is the item, the weight of which is transferred through the crotch between hook 232 and catch 236 and onto bar 81. The item can be freely moved horizontally, however, with the crotch between hook 232 and catch 236 sliding along the top of bar 81. Level hanging can be improved by widening hook 232 and ensuring bar 81 is attached closely along the weight centerline of the item. The bar can be hung sufficiently level by sight.

To adjust the item's vertical position once it is hung as described above, the user pushes gently inwardly (towards the wall) on the item and then lifts the item up slightly while gently maintaining inward pressure. This causes catch 236 to be forced into bar 81, exerting torque on locking hook and wedge 230 and forcing wedge 231 towards the wall, and it also moves the main point of wedging from the high-friction side of wedge 231 and brake strip 221 to the low-friction side of wedge 231 and the low friction interior of pocket 212. The upward pull on the item pulls vertical bar 220 upwards and at first this brings sliding lock trap 210 with it, because the two are jammed together. Because the high-friction wedging has been replaced with low-friction wedging, however, locking hook and wedge 230 is allowed to fall out of pocket 212 by its own weight. (The end of catch 236 can be extended and slightly curved so as to allow the user to apply a degree of upward pull through catch 236 and on the bottom of bar 81 to provide further assurance that hook and wedge 230 can become unwedged.) Thereupon, the continuance of inward pressure and upward pulling on the item causes wedge 231 to be lowered fully into window 211 and then to pivot slightly about holder bar 214 and outside of window 211 such that the tip of wedge 231 is physically outside of sliding trap 210. At this point, the vertical position of the item can be freely adjusted. Then, to relock the item once the desired vertical position has been reached, the user applies some outward tension on the hanging item (which causes hook 232 to be in tension with the wall-facing side of bar 81, applying torque on hook and wedge 230 forcing wedge 231 in against the outer surface of the top of trap 210) and pulls up slightly on the item until wedge 231 slips down and back into window 211. Finally, vertical locking is again achieved in the same way that it is right after hook 232 has been lowered onto bar 81, as described above.

Regarding the embodiment of FIG. 8, it might be desirable to place a small awning (not shown) right at the edge of pocket 212 that fronts window 211, for holding the tip of wedge 231 during vertical adjustment. The awning would be shaped with a slight curve such that the tip of wedge 231 would slide directly back to window 211 as soon as there is an outward pull on the hanging item. Note that the thickness of rail 222 is exaggerated for the purposes of illustration, and its thickness should in reality be minimized, lessening the overall thickness of the assembly and gap between the hanging item and wall. Also, the points of contact between sliding lock trap 210 and bar 220 should be made as slick as possible to allow convenient vertical adjustment.

Figure 9:
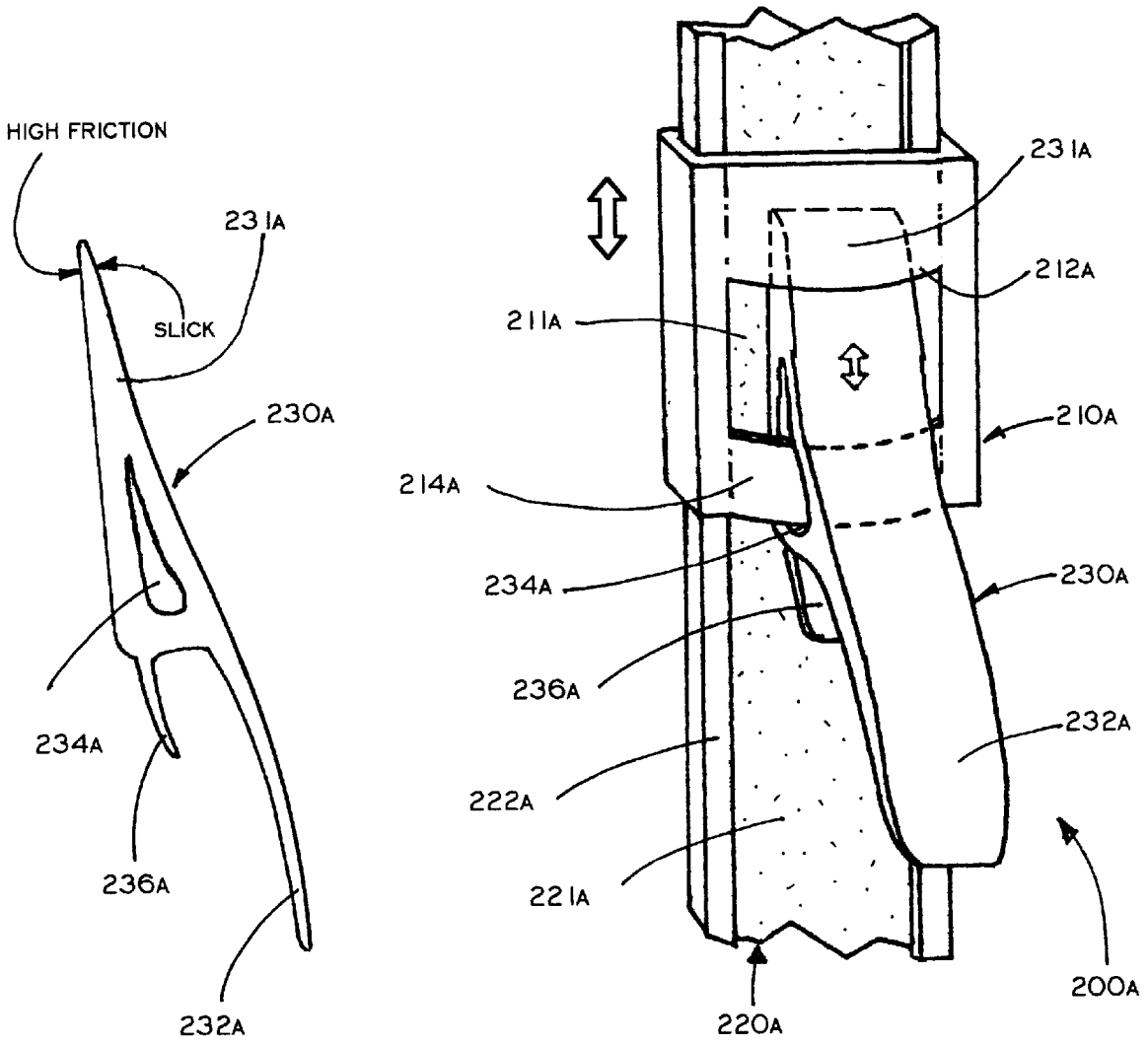

FIGS. 9 and 9A show an embodiment that is similar to that of FIG. 8, except that the hook and wedge 230*a* is shaped somewhat differently than 230 of FIG. 8, particularly at slot 234*a;* the corresponding holder bar 214*a* is also shaped differently. Reference numbering in FIGS. 9 and 9A is the same as in FIG. 8, except that "a" is appended to the corresponding parts in FIGS. 9 and 9A. Note that guide rail 222*a* is much thinner than rail 222 is shown in FIG. 8, which, as noted, is exaggerated for illustration. FIGS. 9 and 9A also show a side view of hook and wedge 230*a,* and how its side facing brake strip 221*a* may have a high-friction surface while the opposing side (which faces the interior of pocket 212*a*) may have a low-friction surface.

Figure 10:
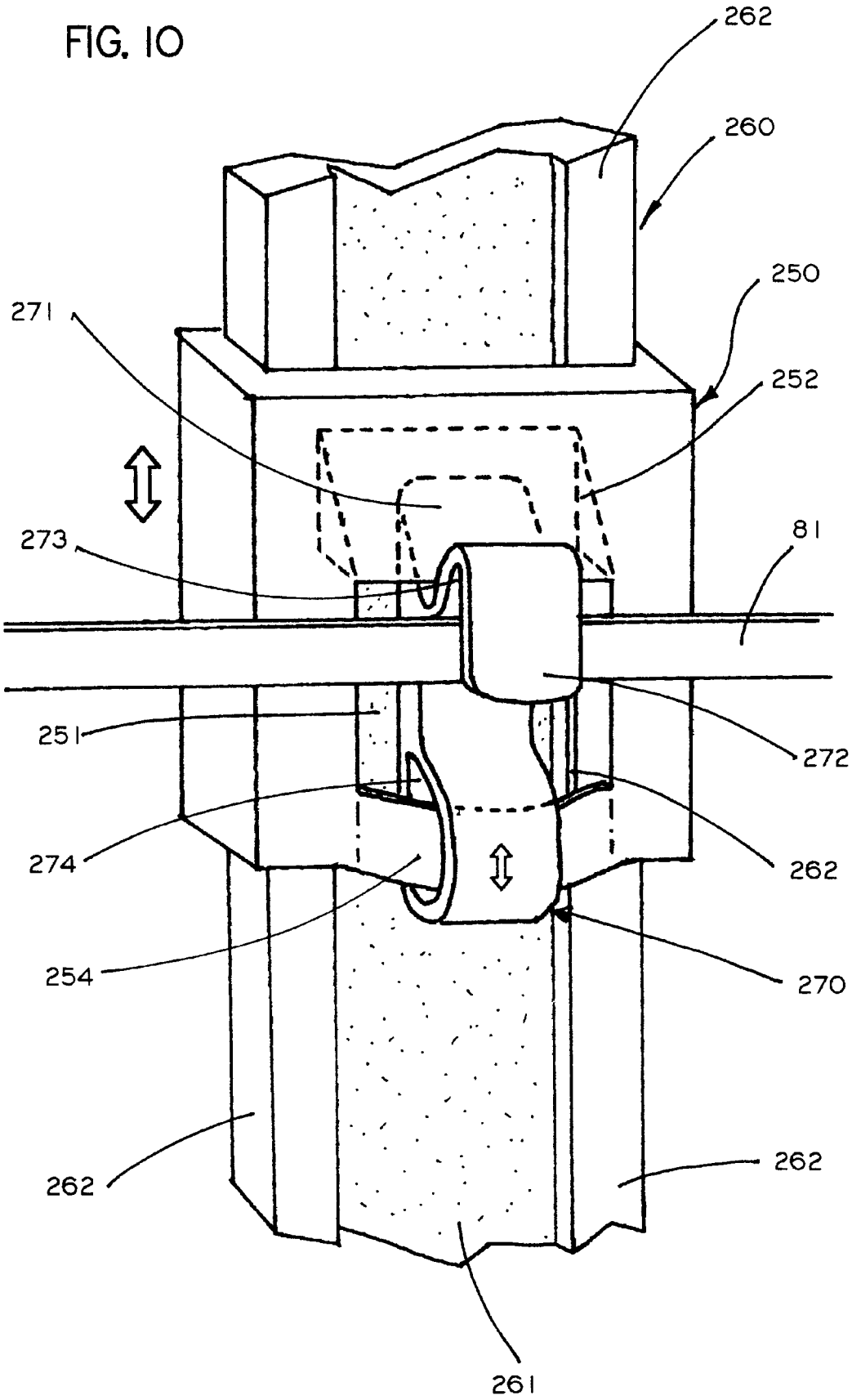
FIG. 10 is a transparent perspective view of an embodiment similar to that shown in FIGS. 8 and 9 but having a book that is closer to the wedge, showing the wedge nearly trapped.

FIG. 10 shows an embodiment that is similar to that of FIGS. 8 and 9, except that it is configured so that activation is caused by pulling up and out rather than by pushing in and pulling up. Parts that correspond to those of FIGS. 8 and 8A are numbered with reference numbers 40 higher than those of FIG. 8 (e.g., guide rails 262 correspond to guide rails 222 of FIG. 8). As in FIGS. 8 and 9, sliding lock trap 250 slides vertically on guide rails 262 of vertical bar 260, and locking hook and wedge 270 in turn slides vertically and pivots a small amount via slot 274 on holder bar 254 of trap 250. The difference in activation force for this embodiment is due to the fact that the point at which hook 272 seats on bar 81 is on the same side rather than the opposite side of holder bar 254 as wedge 271. In other words, the pivoting action needed to pull the wedge out of wedging from between the brake strip and the interior surface of the pocket is opposite here because both the point to be moved and the point at which pressure are applied are on the same side of the fulcrum instead of at opposing sides of the fulcrum. Note that in FIG. 10, for purposes of illustration, crotch 273 of locking hook and wedge 270 is not shown as seated on bar 81. In situ, however, hook and wedge 270 would only be in the illustrated position if forced there by being seated on bar 81. When seated, with the weight of the hanging item transferred through crotch 273 onto bar 81 and into the wall, wedge 271 is jammed between the interior face of pocket 252 and brake strip 261. Similar to what is shown in FIGS. 9 and 9A, the side of wedge 271 facing brake strip 261 may have a high-friction surface.

To activate the assembly for vertical adjustment, the user applies outward tension on the hanging item and then lifts upwardly a bit on the item until wedge 271 unjams from between strip 261 and pocket 252. Because the embodiment of FIG. 10 is configured such that opening 274 does not extend up far enough, wedge 271 cannot entirely leave pocket 252 or escape through window 251. (Although it is not shown in FIG. 10, this embodiment could also be configured similarly to that of FIG. 8 inasmuch as wedge 271 could leave pocket 252 entirely so as to be able to escape through window 251.) Instead, wedge 271 can simply move down in pocket 252 such that the tip of wedge 271 is in a lower section of pocket 252 which is further from strip 261 (see the above description of the shape of similar pocket 212 of FIG. 8, which is similar to pocket 252). Then, while maintaining a modicum of outward pressure (which keeps wedge 271 pinned against the interior surface of pocket 252 but not jammed, and keeps the interior face of hook 272 pinned against the wall-facing side of bar 81), the user can pull the hanging item up or down, and sliding trap 250 will follow suit, sliding up and down along bar 260. (Optionally, there could be a catch on the lower part of the interior face of pocket 252 to hold onto wedge 271 during adjustment, or some other similar means to hold hook and wedge 270 together with trap 250 during the adjustment process). When adjustment is complete, the user simply releases the outward pressure, and then lowers the item until bar 81 forces wedge 271 (via pressure transmitted through crotch 273) to wedge between sliding trap 250 and brake strip 261. Note that opening 274 must extend downwardly far enough to allow holder bar 254 to move down without hitting the lower extent of opening 274 when wedge 271 is jammed between strip 261 and pocket 252 (i.e., when hook and wedge 270 reaches its highest point with respect to sliding trap 250).

In this embodiment, to ensure that wedge 271 never became irretrievably jammed (inasmuch as it cannot be unjammed in situ), a few optional devices could be employed. First, although it is noted above that the sliding trap should generally move as easily as possible along the vertical bar, there may be a modicum of friction between them so that when the item is pulled slightly upward, the whole jammed trap/hook and wedge does not simply follow downwardly on the bar, and instead separates from the bar such that a wiggle or shake on the item will cause the hook and wedge to fall out of the trap by its own weight. Another measure would be to press inwardly and then upwardly on the hanging item if wedge 271 stayed jammed, so that the bottom of bar 81 would hit the upward-facing surface of hook and wedge 270 just above opening 274 (which protrudes outwardly a bit), snapping wedge 271 downwardly and out from between pocket 252 and strip 261. Further, the end of hook 272 could be provided with a barb (not shown) which would catch the bottom of bar 81 when the hanging item is pulled upwardly even if the item were not pushed inwardly (although this may make it harder to initially seat crotch 273 over bar 81 when hanging the item).

Figure 11:
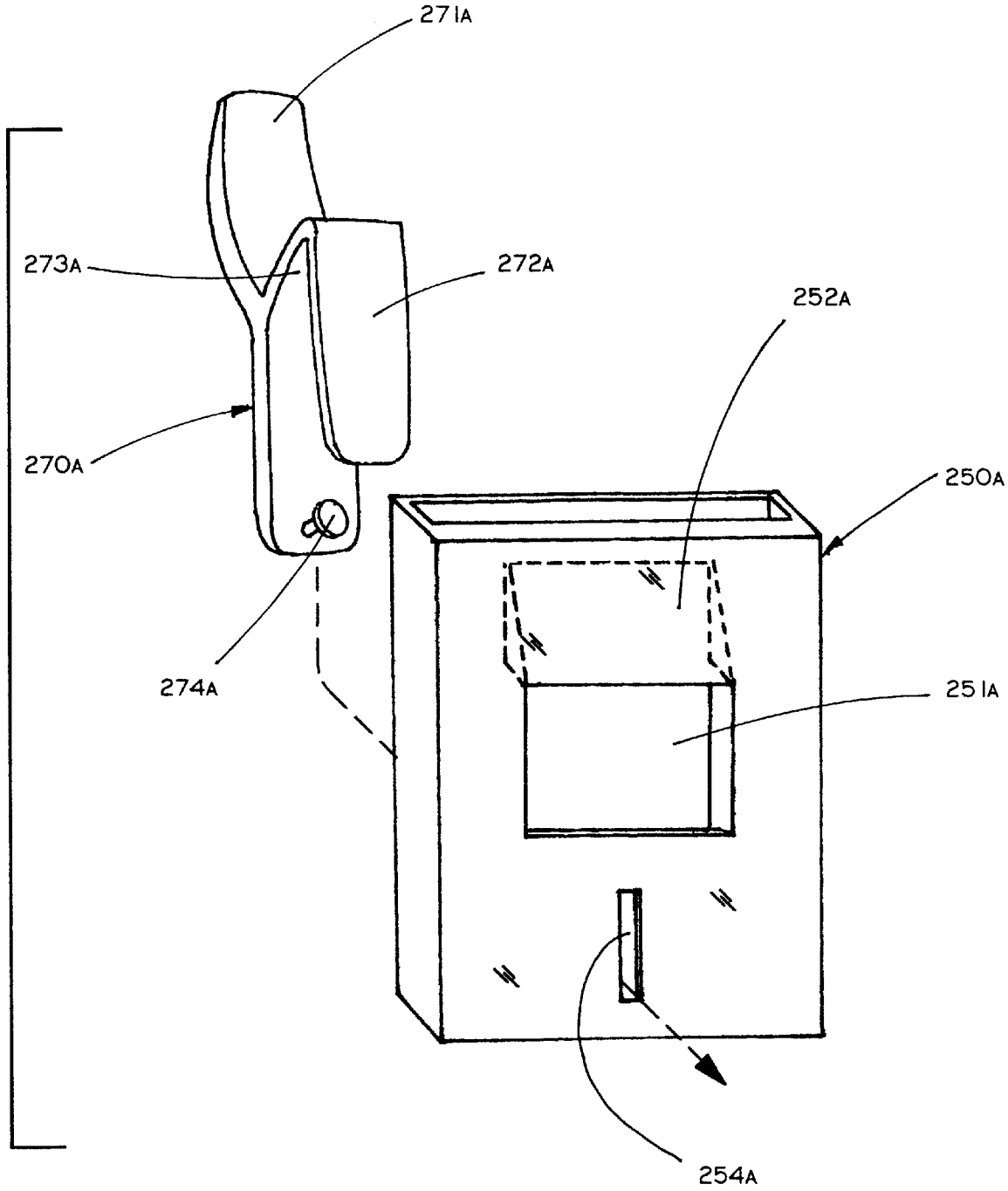
FIG. 11 is an exploded perspective view of an embodiment similar to that shown in FIG. 10 but having a different sliding connection between the hook/wedge and sliding trap.

The embodiment of FIG. 11 is similar to that of FIG. 10, except that instead of having locking hook and wedge 270 connected to sliding trap 250 with a female/male vertically sliding arrangement (opening 274 on holder bar 254), this embodiment has a male/female sliding arrangement, with disk-capped rod 274*a* sliding through and slightly pivoting within slot 254*a*.

FIGS. 12 and 12A show a generic box 300 that can be adapted for use in the lock embodiments of FIGS. 13–21. Box 300 is fixedly mounted to the rear of an item to be hung by way of mounting ears 306, and has a hollow cavity 304, and a vertical slot 301. For purposes of illustration in FIGS. 12 and 12A, the depth of sides 302 is exaggerated, and the height of box 300 is foreshortened. As viewed in FIGS. 12 and 12A, front side 303 of box 300 faces the wall and, in situ, will be adjacent to a mounting point on the wall such as wallbar 80 shown in FIGS. 1 & 3. In each of the embodiments of FIGS. 13–21, a downwardly pointing hook projects out through slot 301, along which it slides vertically during vertical adjustment.

The interior faces of sides 302 are chosen for the highest possible friction contact and gripping with the surface of the particular part of the embodiments of FIGS. 13–21 that will make contact there (discussed below). Conversely, the interior face of front face 303, and the slot sidewalls 307, may be coated with a slick surface such as TEFLON® in order to minimize friction with the downwardly pointing hook. The overall thickness of box 300 may be very important in certain configurations and it is thus desirable to minimize the depth of sides 302 to the extent that box 300 cannot be affixed or otherwise incorporated into the rear of the hanging item or frame in a recessed manner (i.e., with face 303 flush with the rear of the item), which means that materials such as steel or high-strength polymers may be most appropriate (to withstand the aforementioned forces). The interior faces of sides 302 should be of fairly high strength as some significant outward force may be applied to them by the apparatus described in FIGS. 13–21. Front face 303, however, generally need not be that strong and can thus be comparatively thin. As an example, using steel, front face 303 may be 1/64" thick, and rear wall 308 of box 300 may be 3/64" thick, with each measuring 2" wide by 4" tall; sides 302 may be 1/8" thick (excluding any interior coating such as rubber), and measure 4" tall by 5/32" deep. Such a configuration leaves a cavity 304 with a useable depth of (just less than) 3/32".

Figure 13:
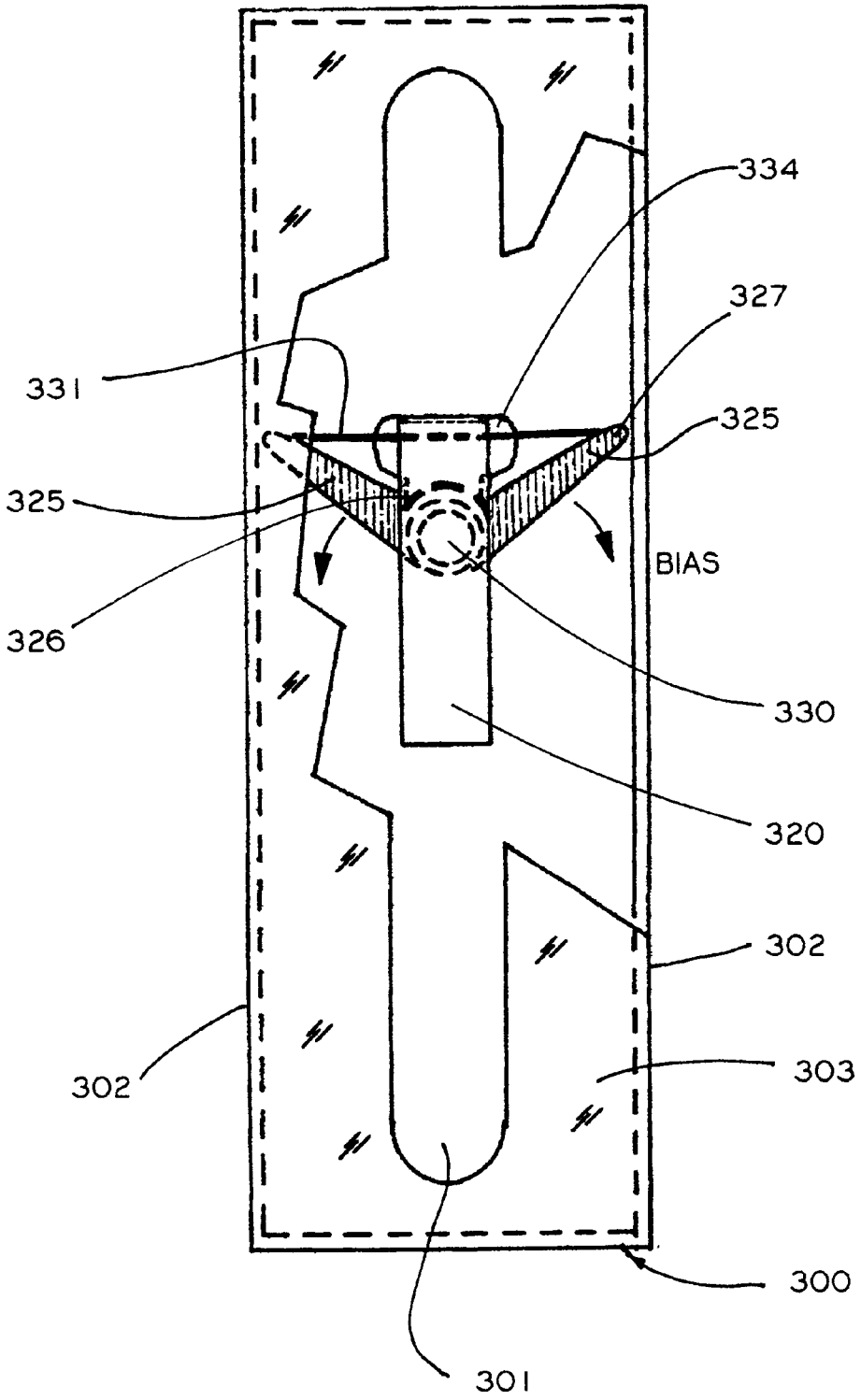
FIG. 13 is a partial front transparent cutaway view of a two-way adjustable embodiment including a version of the box of FIG. 12.
Figure 14:
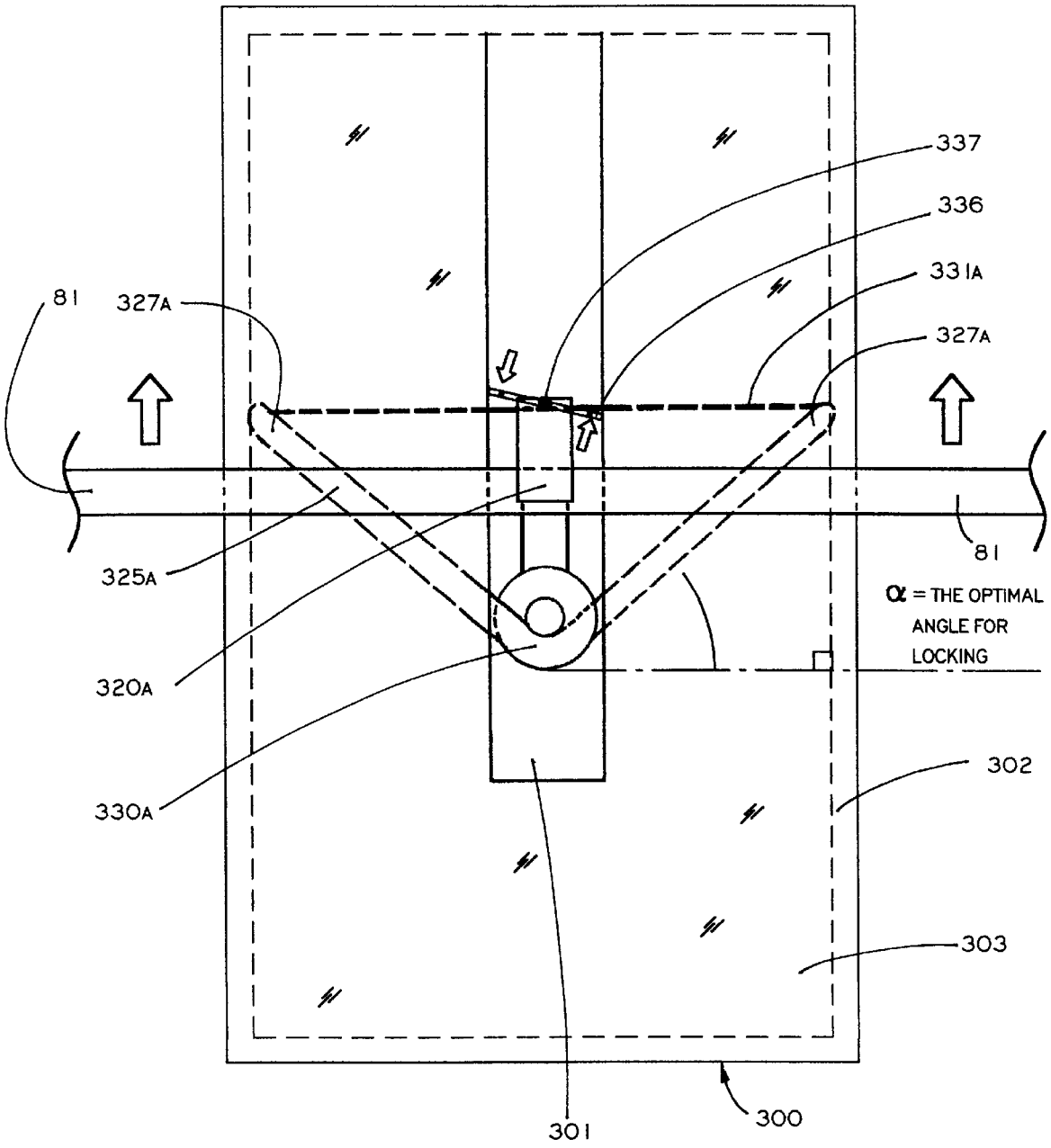
FIG. 14 is a front transparent view of an embodiment similar to that shown in FIG. 13.

FIGS. 13 and 14 show embodiments of the invention that are useable with a box similar to that of FIGS. 12 and 12A, and which utilize a bending hook and biased wings or arms lock assembly that slides vertically within the box during vertical adjustment. FIGS. 15–21 show embodiments of the invention that are also useable with a box similar to that of FIGS. 12 and 12A, and which utilize different configurations of an unbending hook and flippers that vertically slides in the box.

FIG. 13 shows a hook and wing lock assembly within a box. Hook 320 is "U" shaped, projects through slot 301, and includes a downwardly pointing portion that extends outside of the box and catches bar 81. The other end of hook 320 is attached to joint 330, which in turn has two wings 325 attached to it. At their inner radius, wings 325 are directly attached to each other with compressed spring 326; near their tips 327, wings 325 are attached by a taut cable 331. Taut cable 331 in turn passes underneath the top part of the upside-down "U" of hook 320. Optional vertical stabilizer lips 334 may be behind cable 331. The operation of this embodiment is partially similar to that of the embodiments of FIGS. 15—21 discussed below, inasmuch as locking is achieved in the same way, and is enhanced with the weight of the hanging item (see discussion below). In this embodiment, however, tips 327 are locked against the interior faces of sides 302 when at rest, and pulling outward on the item causes this locking to be released. Pulling outward on the item releases the locking because the arm of hook 320 which connects to joint 330 is somewhat flexible, and outward tension causes it to bend outward through slot 301 and outside of box 300, taking part of cable 331 with it. Since cable 331 tautly connects tips 327 of wings 325, pulling outward on cable 331 pulls tips 327 toward each other and away from engagement with the inner surfaces of sides 302. Releasing tension allows them to relock. As is discussed regarding some of the vertically sliding assemblies of the embodiments of FIGS. 15–21 below, when outward tension is maintained on the hanging item, pulling up or down on the hanging item causes the vertically sliding assembly of this embodiment to follow, sliding up or down within cavity 304 and slot 301 of box 300.

FIG. 14 shows a bending hook embodiment that is quite similar to that of FIG. 13, except for its substitution of arms 325*a* for wings 325 and the substitution of sprung joint 330*a* for joint 330 and spring 326, and the addition of rotating safety catch 336. As a consequence of the addition of rotating catch 336, the operation of this embodiment is partially different than that of FIG. 13, in that pulling outward will not activate vertical adjustability unless the hanging item is first pulled upwardly a slight amount. That is because when the hanging item is hanging, bar 81 has the top of hook 320*a* and also catch 336 resting on it. This forces catch 336 to rotate on axle 337 into a flat horizontal position that cause its arms to physically lie behind and obstruct the edges of face 303 adjacent to slot 301. When the item is pulled upwardly, however, catch 337 no longer rests behind any part of face 303 and is fully visible in slot 301, because axle 337 is biased to rotate catch 336 out of the horizontal position, and this occurs as soon as bar 81 is no longer in contact with it. Consequently, after this upward pull on the item, applying outward tension on the item causes hook 320*a,* unrestrained, to pull on taut cable 331*a,* causing tips 327*a* to disengage from the interior surfaces of sides 302, allowing adjustment as described of FIG. 13.

Figure 15:
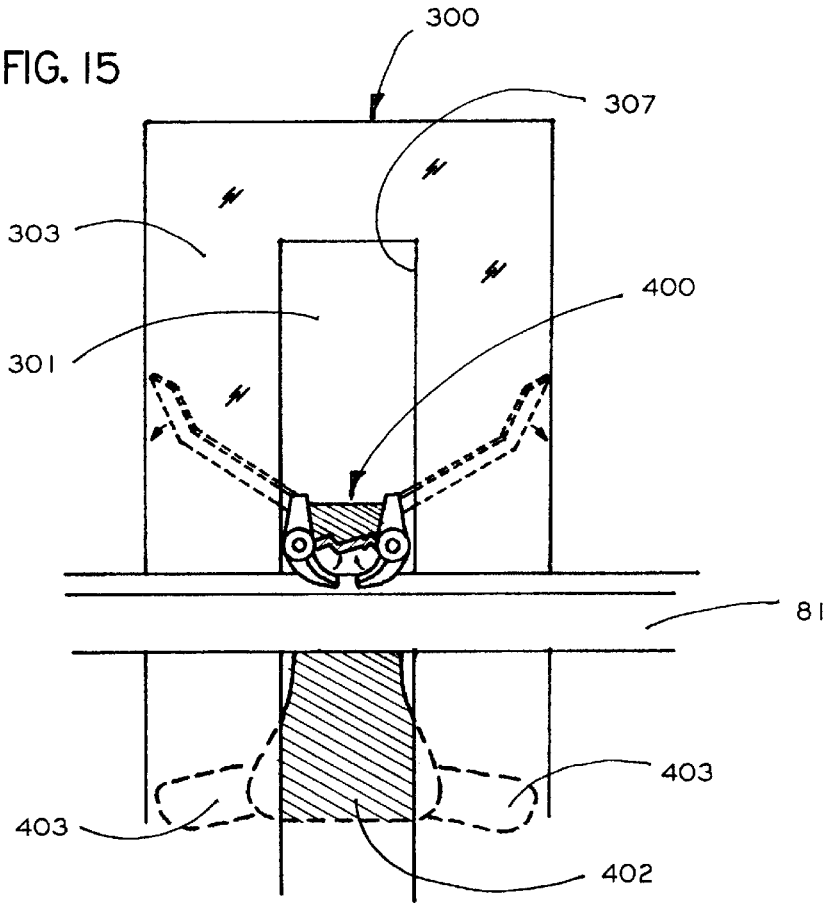
FIGS. 15 and 15A is a top perspective cutaway transparent view and a corresponding close-up view of part of a two-way adjustable embodiment, showing its actuators hitting the wallbar and the attached biased flippers moving towards the inner walls of the box.
Figure 15A:
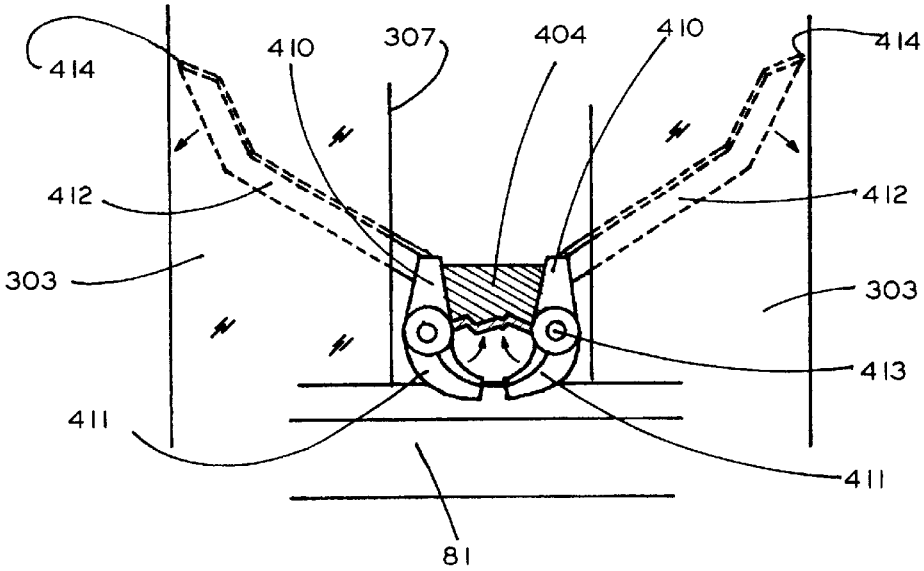
Figure 16:
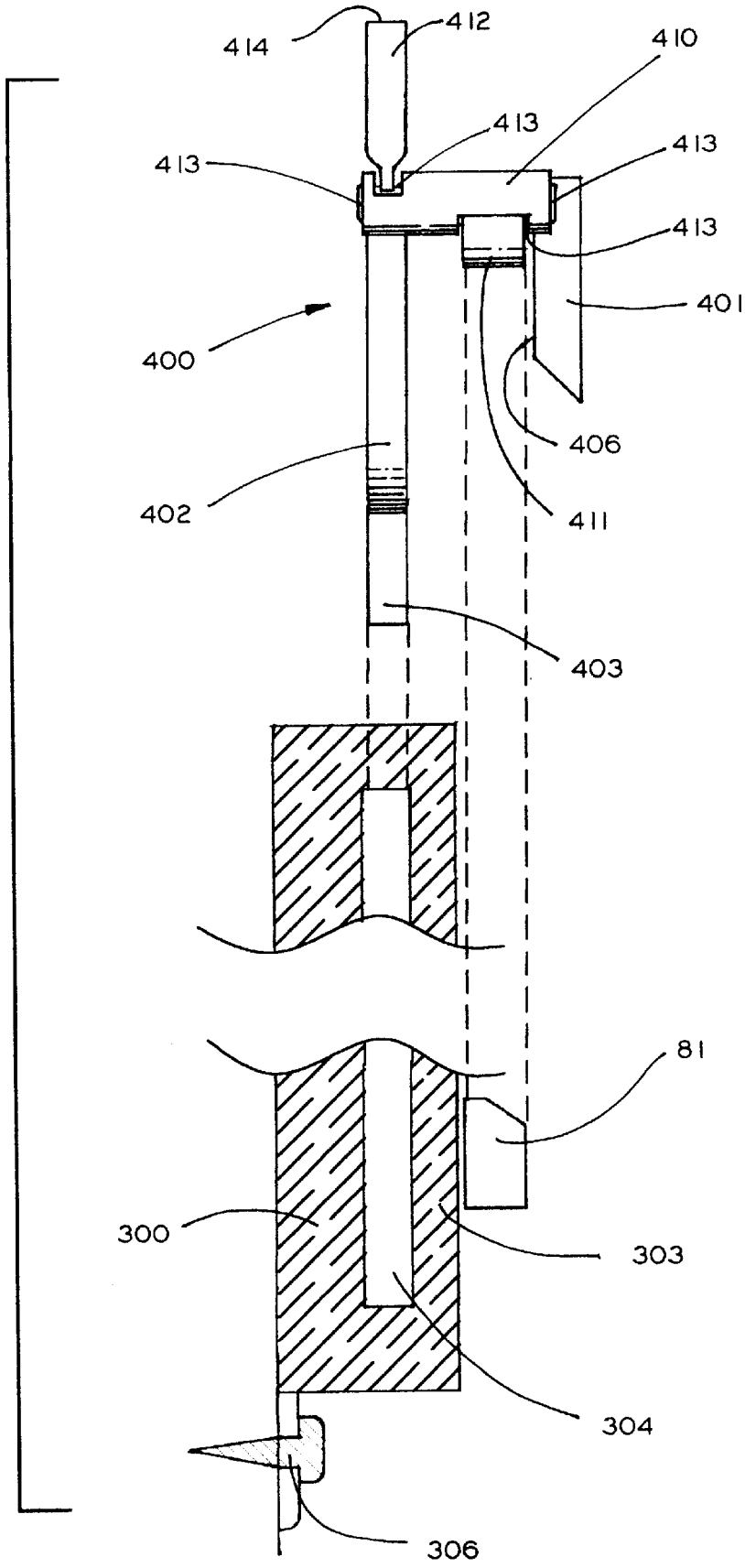
FIG. 16 is an exploded side view of the embodiment of FIG. 15, showing how the sliding locking hook assembly resides in the cavity of the box and how the flipper actuators rest on the wallbar and ho he hook resides behind the wallbar.
Figure 17:
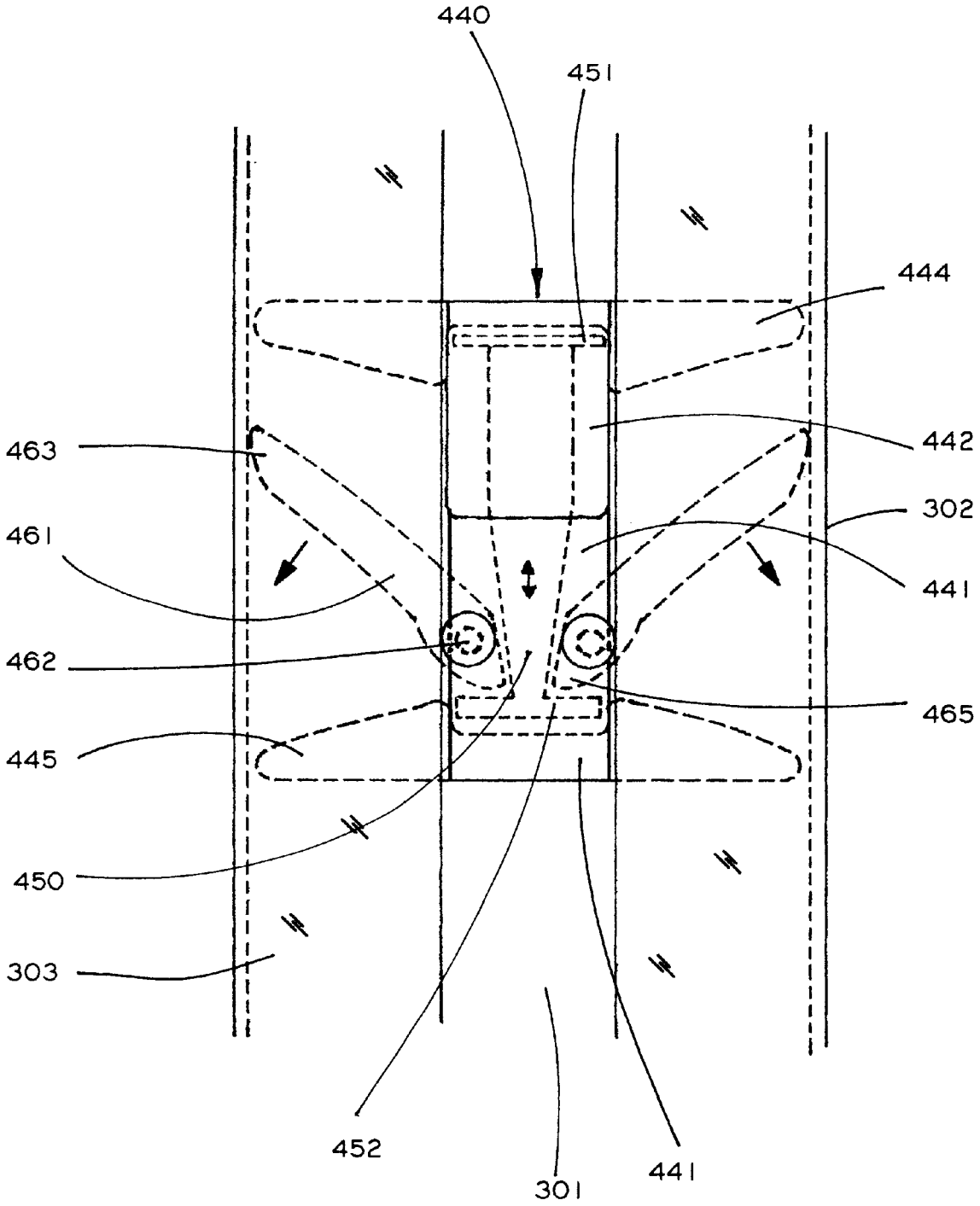
FIG. 17 is a front transparent view of an embodiment similar to that shown in FIGS. 15 and 16 but having a hook that is above the flippers.
Figure 18:
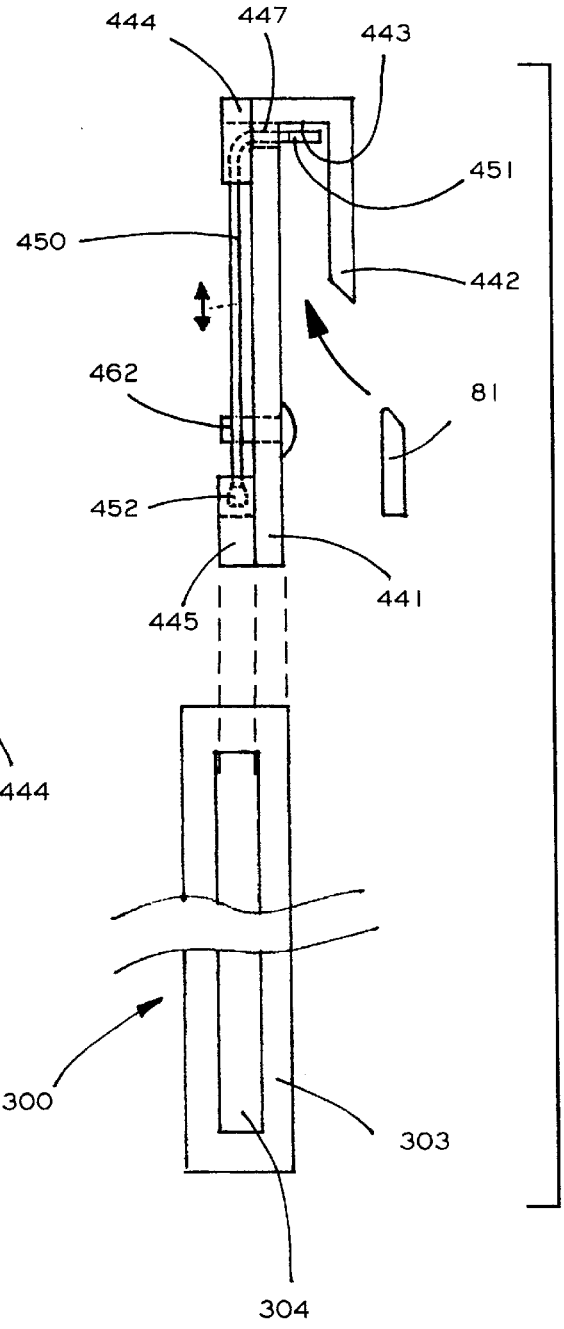
FIG. 18 is an exploded side transparent view of the embodiment of FIG. 17, showing how the sliding assembly resides primarily in the box, and showing where the hook rests on the wallbar.
Figure 19:
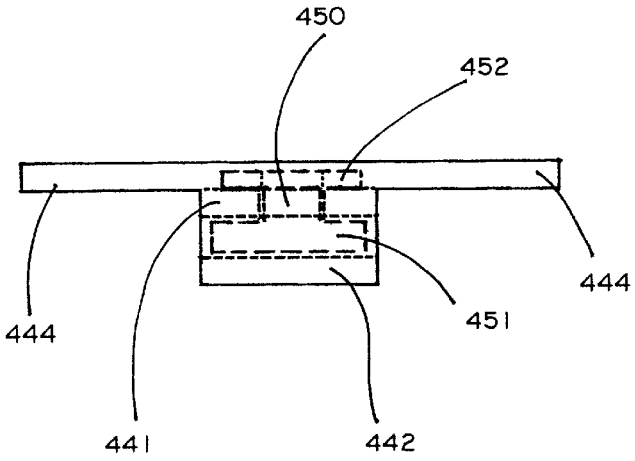
FIG. 19 is a partial transparent top view of the embodiment shown in FIGS. 17 and 18.
Figure 20:
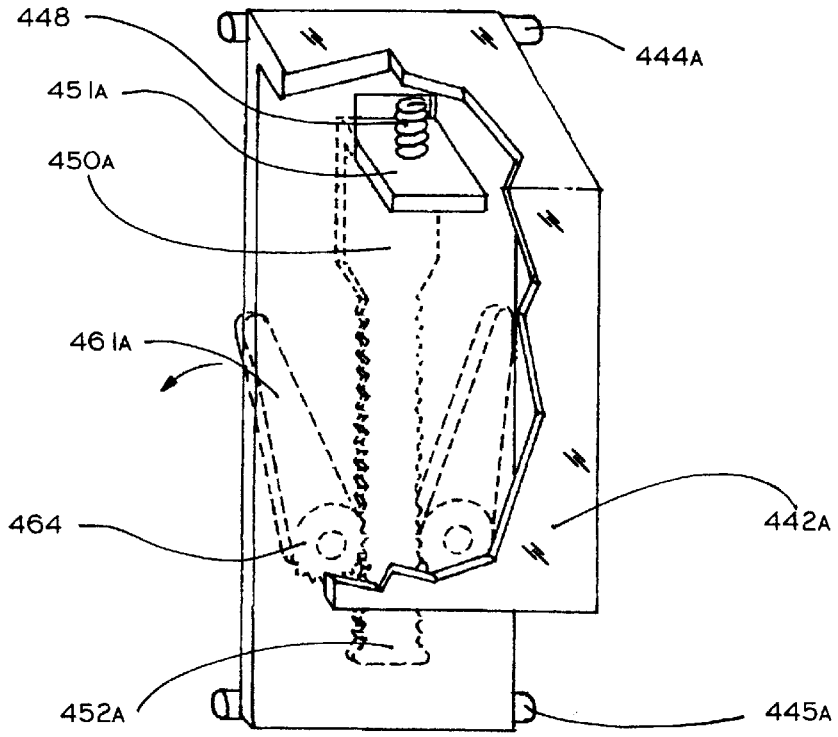
FIG. 20 is a partial transparent perspective cutaway view of an embodiment similar to that shown in FIGS. 17–19, but having a different actuator.
Figure 21:
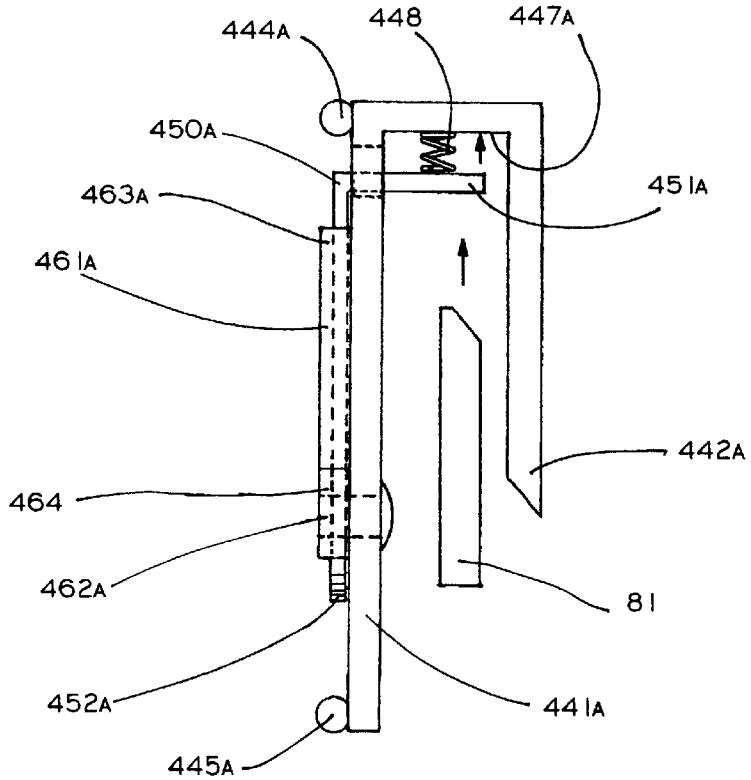
FIG. 21 is a partial transparent side view of the embodiment shown in FIG. 20.

FIGS. 15, 15A, and 16 show an unbending hook and flippers embodiment wherein the hook is below the flippers, while FIGS. 17–19 show a similar embodiment wherein the hook is above the flippers. FIGS. 20 and 21 illustrate an alternative embodiment to that of FIGS. 17–19.

FIGS. 15, 15A, and 16 show that vertically sliding locking hook assembly 400 resides primarily in cavity 304 of box 300. Therein, it may slide up and down with part projecting through slot 301, as can be seen from FIG. 16. Locking assembly 400 includes hook 401 (which is cutaway in FIGS. 15 and 15A where it connects to upper body 404 near the front, top region of assembly 400) which points downwardly and may be wedge-shaped to facilitate easy "finding" of bar 81 (which is attached to the wall as part of wallbar 80) when the hanging item is hung. Likewise, the top of bar 81 may be complementarily wedge-shaped in part (although not too much, as it may get stuck behind actuator 411) as shown in FIG. 16. Hook 401 connects to upper body 404 which connects axle housings 410. Upper body 404 is also connected to lower body 402 which includes wings 403 which serve to prevent rotation of assembly 400 within cavity 304 in the plane of the hanging item. Lower body 402 is completely contained with in cavity 304, and part of upper body 404 passes through and outside of front face 303 of box 300. Axle housings 410 run orthogonal to the plane of the hanging item and box 300, and contain axles 413 which rotate freely therein. Near the front end of axles 413 are connected downwardly facing flipper actuators 411. Near the rear end of axles 413 are connected upwardly facing flippers 412 which include wedging tips 414 designed to readily wedge into and grasp the interior faces of sides 302 of box 300 under a small amount of force. A bias means (not shown) is provided so that, at rest, tips 414 are lightly urged slightly away from the interior faces of sides 302.

Accordingly, when hook 401 of the item to be hung is positioned over and lowered onto wallbar 80, actuators 411 hit the top surface of bar 81, causing them to counterrotate with their tips moving upwardly (indicated by arrows in FIGS. 15 and 15A). At the same time, this causes axles 413 to counterrotate, and tips 414 to rotate downwardly and into the interior surfaces of sides 302. Thereupon, wedging tips 414 bite into sides 302 (which may be, for example, rubber coated); any further downward force on the hanging item, such as that due to its own weight, simply causes tips 414 to bite even more strongly, and hook 401 of assembly 400 is locked in its vertical position. Downward force from the hanging item may increase the locking bite of tips 414 through at least two mechanisms; first, any added rotation at actuators 411 will further rotate tips out towards sides 302; second, the added downward force on tips 414 applied by sides 302 simply applies further leverage at tips 414 causing them to attempt to rotate further outward.

To accomplish automatic vertical adjustment, the user pulls slightly upwardly on the item, which allows the bias of axles 413 to unlock tips 414 from the interior faces of sides 302. The user then pulls slightly outwardly on the hanging item, such that hook inside face 406, which may have a somewhat high-friction surface, is in tension with the wall-facing side of bar 81. Maintaining this tension, the user then simply pulls the hanging item up or down to a desired level and then releases the outward tension. When the user is pulling the hanging item up or down, sliding assembly 400 follows suit, sliding vertically in cavity 304 and slot 301. When the user releases outward tension (whether or not the vertical position of the hanging item is maintained), sliding assembly 400 falls downwardly by its own weight and onto the top of bar 81, causing actuators 411 to rotate axles 413 and push tips 414 to sides 302. Then, as the user lets go of the hanging item, the item's weight locks tips 414 into sides 302, as described above.

FIGS. 17–19 show an embodiment that operates somewhat similarly to that of FIGS. 15, 15A, and 16, except that the area where the hook rests on the wallbar is above the flippers. In this embodiment, sliding locking hook assembly 440 consists of three layers as can best be seen in FIG. 18 (which omits the flippers for clearer illustration). One layer resides entirely in cavity 304 of box 300, the second layer, adjacent to the first, resides in slot 301, and the third layer, adjacent to the second, resides outside of box 300. The first layer includes lower tabs 445 and upper tabs 444 which keep the assembly 440 aligned, and it includes flippers 461 and part of flipper axles 462. The second, middle, layer includes mid-body 441 of assembly 440, trigger channel 449, and part of axles 462. The third, outside, layer includes hook 442 and hook ceiling 447.

Also, trigger 450 runs through all three layers, starting with actuator bar 452 in the first layer just below axles 462, running up to and through trigger channel 449 in the middle layer, and into the third layer where it ends with trigger plate 451 which is parallel to and just below hook ceiling 447. Trigger 450 does not fall out of assembly 440 because trigger plate 451 is wider than channel 449, and because actuator bar 452 cannot rise above actuator tips 465 which are almost the same thickness as cavity 304. Also, trigger 450 has enough strength to substantially retain the right angle bend at its top adjacent to plate 451 when pressed by bar 81.

Operation of this embodiment is similar to that of the embodiment of FIG. 15, except that trigger plate 451 is lowered down onto bar 81, whereupon trigger plate 451 rises (channel 449 having enough vertical leeway for it to do so) close to or adjacent to ceiling 447. As it does so, trigger 450 pulls actuator bar 452 upwards whereupon it strikes actuator tips 465 at the bottom of flippers 461, causing wedging tips 463 to drive into the interior faces of side 302, locking the vertical position in box 300 of assembly 440. Similar to the embodiment of FIG. 15, flippers 461 and/or axles 462 are preferably biased toward the unlocked position, and the weight of a hanging item increases their locking once they have "bitten" (which is accomplished by lowering hook 442 down behind bar 81 whereupon trigger plate 451 is pressed upwards, raising actuator bar 452 into actuator tips 465 sufficiently to overcome the aforementioned bias).

A major advantage of this embodiment is that hook ceiling 447—which rests atop bar 81—is very close to the top of assembly 440. Assembly 440, in turn, can come very close to the top of box 300, assuming slot 301 is extended up sufficiently. Accordingly, the more desirable potential adjustability zone toward the top of the hanging item is maximized.

FIGS. 20 and 21 show an embodiment similar to that of FIGS. 17–19, with the main difference being the addition of geared axle heads 464 at the ends of axles 462*a,* and the substitution of toothed actuator rod 452*a* for actuator plate 452. The teeth of actuator rod 452*a* mesh with the gears of axle heads 464. As shown, rod 452*a* may also increase in width towards its bottom. Further differences in this embodiment are the addition of springs 448 between ceiling 447*a* and the top of plate 452*a,* and the substitution of guide rods 444*a* and 445*a* (which may be, for example, TEFLON®-coated), for tabs 444 and 445, respectively.

Figure 22:
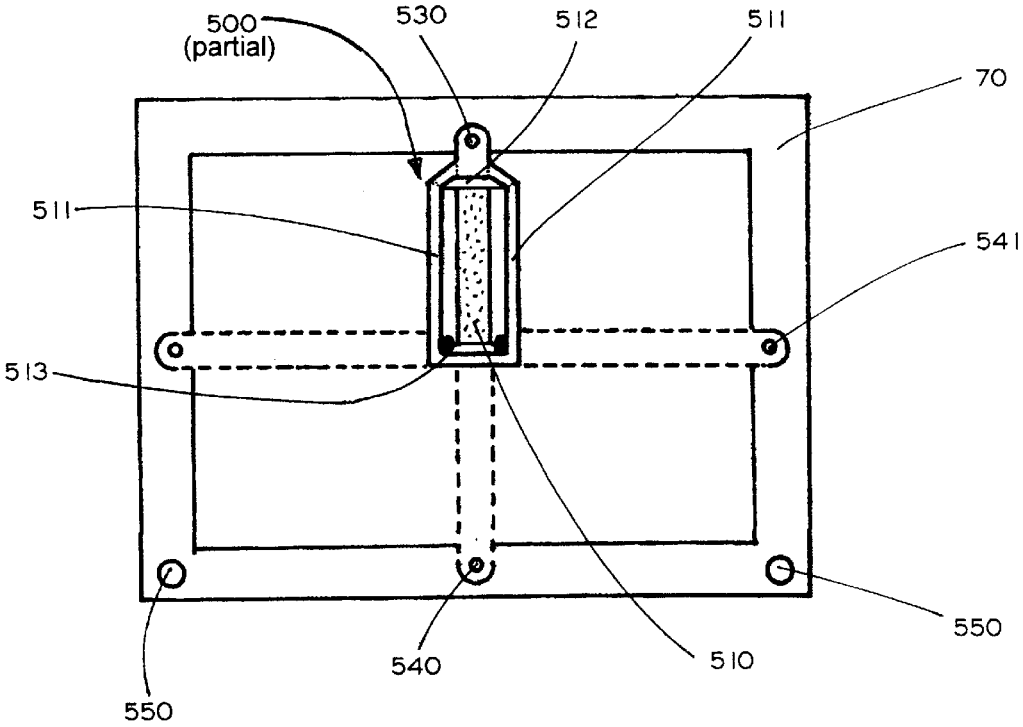
FIG. 22 is a front view of part of a two-way adjustable embodiment that attaches to the rear of a frame or the like, showing how the brake pad and rail assembly may be attached.

FIG. 22 shows an embodiment having two parallel guide rails 511 attached on either side of a locking brake pad 510. Locking brake pad 510 can be rubber, grooved metal or plastic, or other like means that are well known in the art. Relative to rails 511, brake pad 510 is depressed towards the rear of the item to be hung. Assembly 500 is preferably positioned on frame 70 so as to extend along the weight centerline, from the top portion to about the vertical midpoint of the frame 70; attachment may be by nail, pin, glue, et cetera. A small extension 530 can project from the top for nailing to the top of frame 70 of the item to be hung. Additionally, a manually adjustable-lengthed (or one sized to fit standard frames) bottom extension 540 can be used to attach to the bottom of the frame, or, alternately, a horizontal bar 541 (manually adjustable or in stock lengths) can be provided at the bottom of assembly 500, to allow attachment to the sides of frame 70. Another alternative is to provide a flat-backed assembly that can be glued or similarly adhered to a suitably flat rear surface of an item to be hung. Such an adhesive could be preapplied to the back of the assembly, and covered with a peel-off plastic liner.

Because assembly 500 may create some physical obstruction between the frame 70 and the wall, bumpers 550 can be provided for placement at the bottom corners of frame 70 to allow equalization and control of the distance from the wall. Such bumper could be, for example, felt or rubber, but may need to be slightly compressible to accommodate the inward activation force required for vertical adjustment (discussed below). Such bumper could also be placed at the top of frame 70, to serve as a biasing means to urge the top of frame 70 just slightly further away from the wall than assembly 500 would dictate, ensuring that the hanging item would not accidentally unlock (locking and unlocking is described below).

Figure 23:
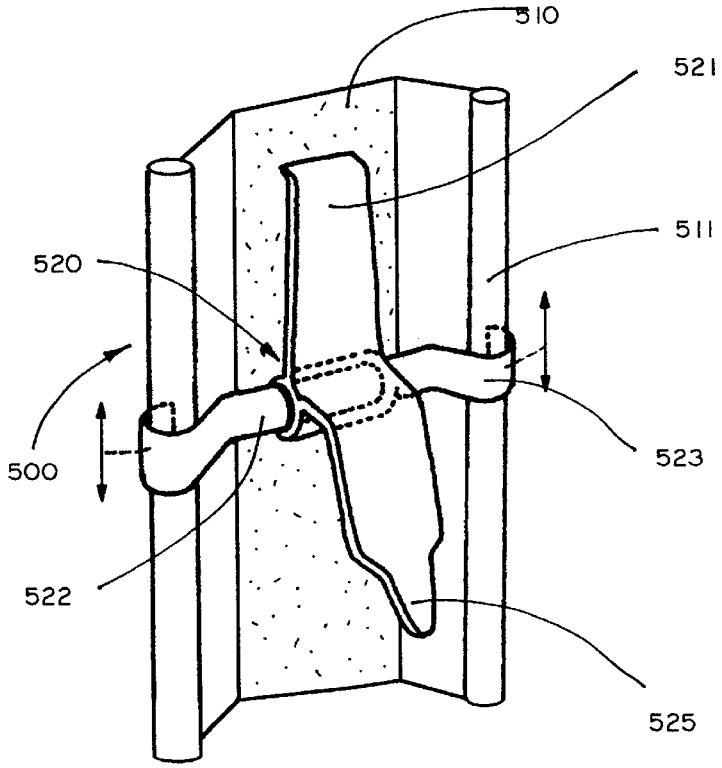
FIG. 23 is a perspective view of part of the embodiment of FIG. 22, showing how the vertically sliding locking hook attaches to and moves relative to the brake pad and rail assembly.

Finally, there may be a projection 512 at the top of brake pad 510 that serves as an upper stop for the brake foot 521 (see FIG. 23), and there may be projections 513 at the bottom of guide rails 511 to serve as lower stops for sliding grips 523 (see FIG. 23).

In FIG. 23, the connection of vertically sliding hook assembly 520 to guide rails 511 and brake pad 510 is shown. Hook assembly 520 can travel up and down rails 511, unless brake foot 521 is engaged with brake pad 510. Brake pad 510 is attached to guide rails 511 down their length, however, this attachment could alternatively just be at the top and bottom (similarly to the embodiment of FIG. 27), allowing sliding grips 523 to fully enclose or wrap around rails 511.

Figure 24:
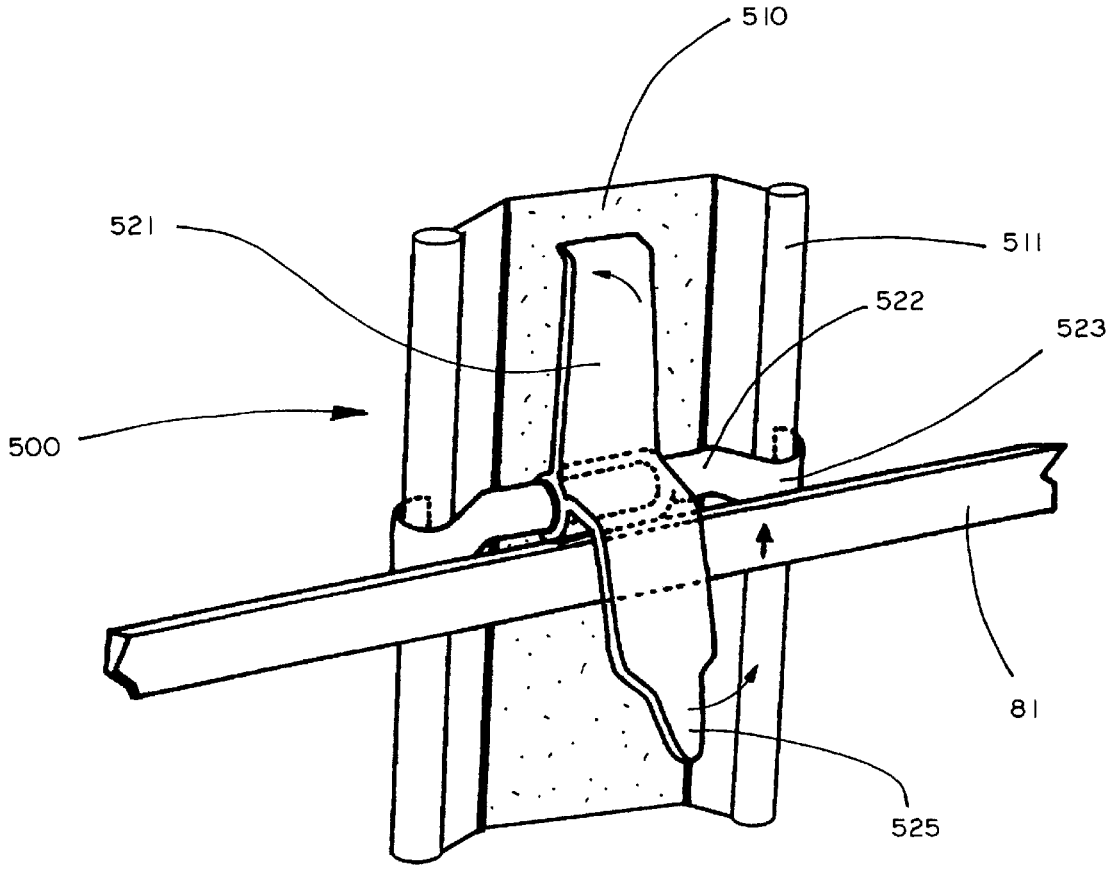
FIG. 24 is a perspective view of the embodiment of FIGS. 22 and 23, showing how the hook seats on the wallbar, causing the brake foot to catch in the brake pad under load.

As shown in FIGS. 23 and 24 (indicated with arrows), when loaded with a hanging item, hook 525 rotates counterclockwise as viewed from the left, causing engagement of brake foot 521 with brake pad 510. FIG. 24 shows how the bar 81 of wallbar 80 (not fully shown), which is affixed to the wall (see FIGS. 1 and 3), applies a relative upward force in opposition to the load of hook 525, causing hook 525 to rotate about axis 522, forcing the distant end of brake foot 521 to rotate into brake pad 510. It can also be seen from FIG. 24 that hook assembly 520 can freely slide left or right upon bar 81. To ensure level hanging (where a single mounting device is used), it may be desirable to provide means allowing for horizontally adjusting the attachment of assembly 500 to frame 70; hook 525 and/or sliding grips 523 can also be widened.

Figure 25:
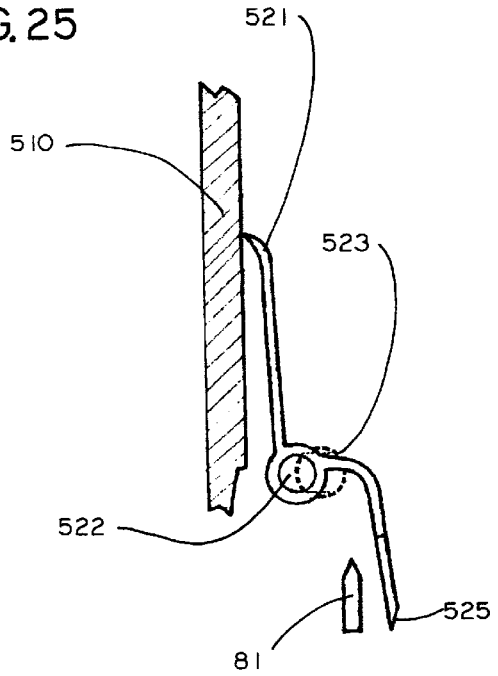
FIGS. 25 and 25A are a sequence of partial side views of the embodiment of FIGS. 22–24, showing how the hook seats on and mates with the wallbar, causing the brake foot to lock in the brake pad under load.
Figure 25A:
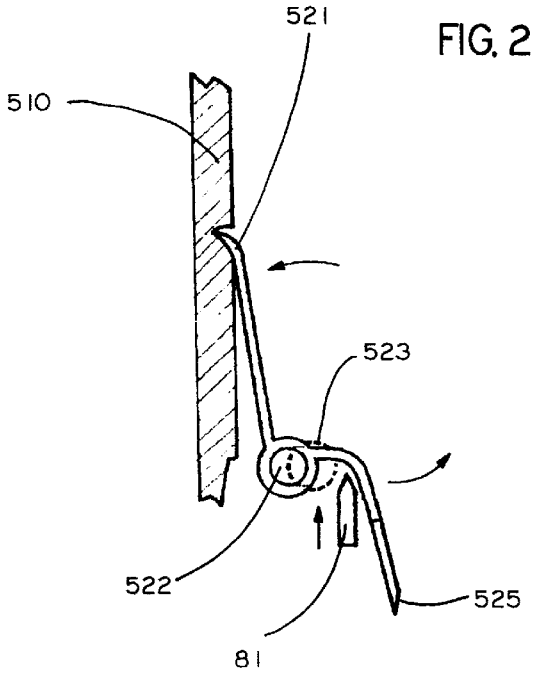

FIGS. 25 and 25A show a sequence wherein hook assembly 520 is seated over bar 81, causing engagement and locking. Bar 81 nests between hook 525 and the front extent of sliding grips 523 (shown in phantom). To facilitate insertion and seating of hook 525 behind bar 81, it may be beneficial to form hook 525 at somewhat of an angle. But, to prevent that angle from causing the tip of hook 525 to excessively impinge on the wall, the portion of hook 525 that extends below bar 81 may comprise an easily flexible but resilient material such as plastic, and simply act as an insertion guide.

Figure 26:
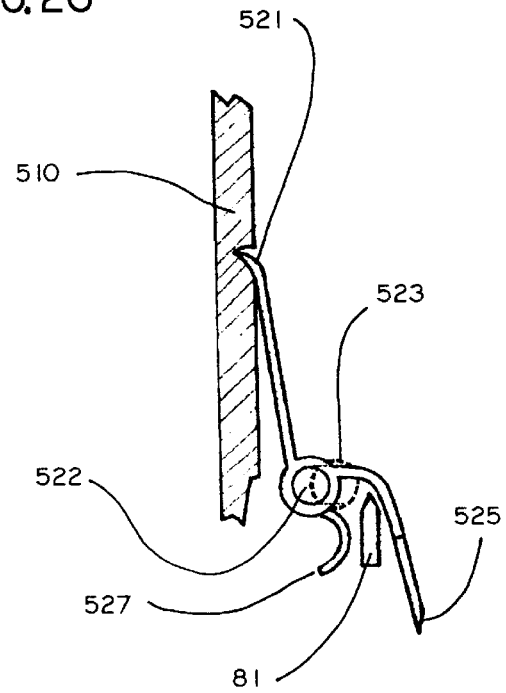
FIGS. 26 and 26A are a sequence of partial side views of an embodiment similar to that shown in FIGS. 22–25 but also having an activation catch, showing how the catch ensures unlocking of the brake when the frame is moved towards the wall.
Figure 26A:
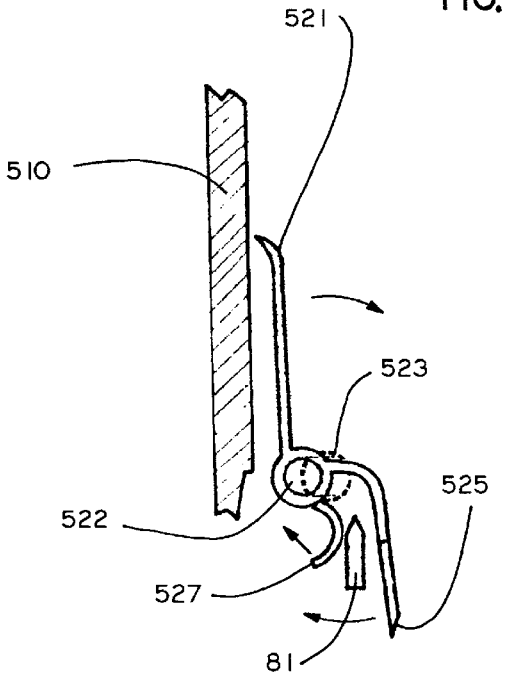

FIGS. 26 and 26A show a second sequence wherein the engaged and locked assembly is activated for adjustment. In the depicted embodiment, when the top of frame 70 is pushed inward (i.e., towards the wall) and upward, brake foot 521 disengages from brake pad 510. This disengagement is ensured through the force of gravity acting on hook 525 and/or the force exerted through hook 525 as it impinges more immediately against the wall. FIGS. 26 and 26A also show an optional catch mechanism 527 which provides further insurance that, when desired, brake foot 521 can be unlocked from brake pad 510. When locked, catch 527 does not impinge on bar 81; however, when the top of frame 70 is pushed marginally towards the wall, bar 81 hits catch 527, helping brake foot 521 to rotate out of engagement.

Figure 27:
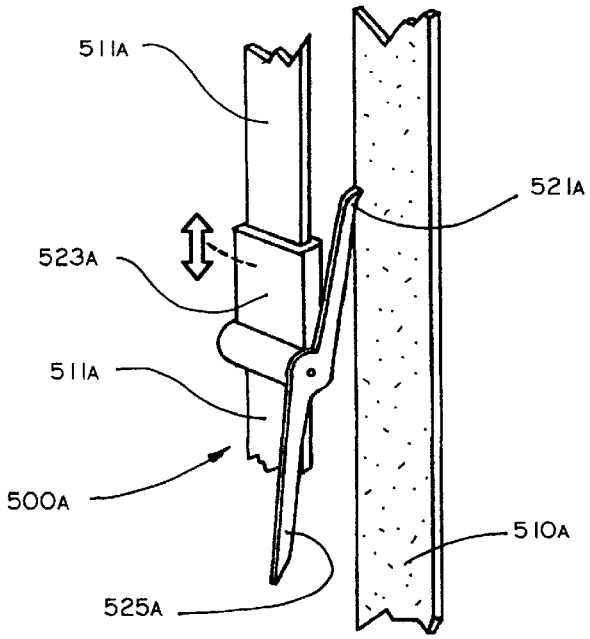
FIG. 27 is a perspective view of part of an embodiment similar to that of FIGS. 22–26 but having only one guide rail and a brake pad articulated therefrom, showing how the hook forces the brake pin/foot into the brake pad under load.

FIG. 27 shows a single guide rail embodiment wherein brake pad 510*a* is separated from guide rail 511*a* except at the top and bottom (not shown). An embodiment such as this could be used in dual, opposing fashion, to better distribute the weight of the hanging item. Embodiments could also readily be imagined with one or more guide rails, wherein the rails were not directly attached to brake pad 510*a* at all, but instead independently attached to the rear of the hanging item. In such an embodiment, brake pad 510*a* may also be glued to the rear of the hanging item.

Figure 28:
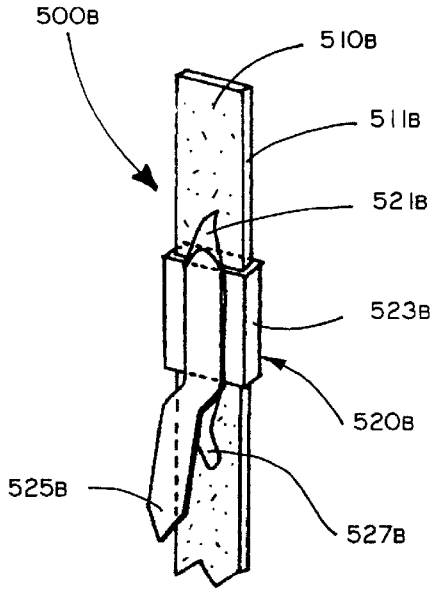
FIG. 28 is a perspective view of an embodiment similar to that of FIG. 27 but having the brake pad and guide rail integrated, showing how the hook forces the brake tooth into the brake pad under load.

FIG. 28 shows a simplified mechanism 500*b* wherein hook 525*b* is integrally connected to a sliding grip 523*b* and brake tooth 521*b,* and brake pad 510*b* is integrated into guide rail 511*b*. Similarly to what is shown in the previous Figures, loading hook 525*b* causes brake tooth 521*b* to engage brake pad 510*b*. The underside of an optional activation catch 527*b* (similar to that in FIGS. 26 and 26A) should be formed so as not to catch in brake pad 510*b*.

Figure 29:
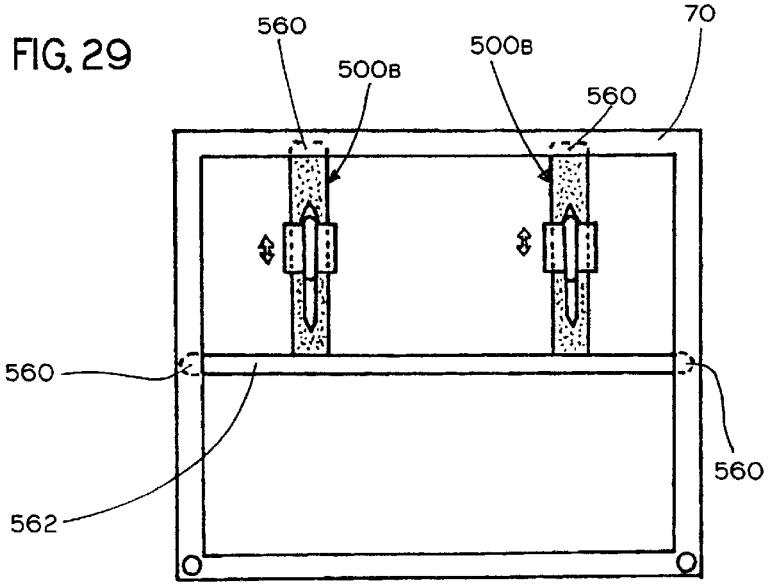
FIGS. 29 and 29A are a front view and a side perspective view of an embodiment similar to that of FIG. 28 but integrated with a frame, and dual, showing how the devices are integrated with the frame, and how the hooks engage the wallbars mounted to the wall.
Figure 29A:
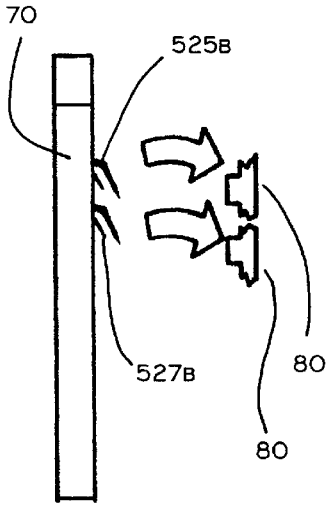

FIGS. 29 and 29A show other ways of attaching or integrating the vertically adjustable assembly into the rear of a frame 70. The invention could be designed to be manufactured into frame 70, or it could be designed for retrofitting in bulk based on standard frame sizes. For example, it could be provided with knife edges 560 which wedge into the inner edge of frame 70, and/or it could be provided with a lower cross member 562 with similar knife edges 560. It should be noted that this integration helps minimize the degree to which there is a physical obstruction between frame 70 and the wall, and also provides the consumer with an easier, more professional approach. Also, as shown, the invention can be doubled (or more) so as to provide a further measure of leveling, stability, and strength. It is not only the vertically adjustable assembly of the embodiment of FIG. 29A that is susceptible of being incorporated into or attached to a frame-back in the aforementioned ways either by a manufacturer, retrofitter, framer, or consumer, and many other embodiments discussed herein are similarly adaptable.

FIGS. 30 and 30A show an embodiment providing vertical adjustability, wherein upwardly pointing hook 575, mounted on the wall via nail/screw eyelet 574, is trapped by lock trap 570 which slides vertically along vertical bar 580 which may preferably have an elliptical or rectangular cross-section. Lock trap 570 includes pocket 571, which is placed over tip 577 of hook 575 and lowered until frictional region 576 of hook 575 hits frictional strip 581 (indicated by an arrow in FIG. 30A) of vertical bar 580 (mounted to the rear of the item to be hung at eyelets 583) and hook 575 wedges between the interior face of pocket 571 and strip 581. When hook 575 is thus trapped, vertical movement of the trap along bar 580 is prevented, locking the hanging item's vertical position. When the item is pulled upwardly, however, trap 570 moves up just slightly with respect to hook 575, loosening its grip. At this point, pulling outwardly on the hanging item causes frictional region 576 to lose contact with frictional strip 581; it also causes tension to be applied to trap 571 at frame-facing side 582 of bar 580. The frame-facing side 582 of vertical bar 580 may be a slick surface so as to foster vertical sliding of trap 570 along bar 580 when hook 575 is not trapped in trap 570. In this fashion, while an outward tension is maintained on the hanging item, hook 575 can be used to pull or push trap 570 upwardly or downwardly (respectively) along bar 580. When adjustment is completed, outward tension on the hanging item is discontinued, and a slight push inward on the hanging item is applied along with a slow and firm downward nudge to lower trap 570 over hook 575. A slight shake may also encourage the trap to "set." Hook 575 should be at least as long in its vertical upward extent as the vertical length of pocket 571 to ensure sufficient wedging action is available (rather than being obstructed by the lower extent of trap 570 hitting the crotch of hook 575). Also, simplified versions similar to the embodiment of FIGS. 30 and 30A can readily be imagined, such as one wherein trap 570 is simply a heavy rubber ring, bar 580 is simply a rod, and hook 575 has a fish-hook shape and a cylindrical cross-section.

FIGS. 31 and 31A show part of an embodiment similar to that of FIGS. 30 and 30A, but which also provides horizontal adjustability. Upwardly pointing hook 595 is slidably mounted in horizontal slider 590 which is affixed to the wall. Horizontal slider 591 includes slotted slider 591 and nail or screw eyelets 594. Slotted slider 591 has slot 592 in which hook 595 slides horizontally. Hook 595 is connected by connector 598 (which may be embedded in hook 595) to endpiece 593 which prevents hook 595 from rotating or being pulled upwardly and out of slot 592. As with the hook in the embodiment of FIGS. 30 and 30A, hook 595 includes a frictional region 596 and a tip 597. As shown in phantom in FIG. 31A, the side of hook 595 where frictional region 596 resides may extend further out than the face of slider 591 so that hook 595 may be trapped in pocket 571 without the face of slider 591 impinging upon vertical bar 580.

Figure 32:
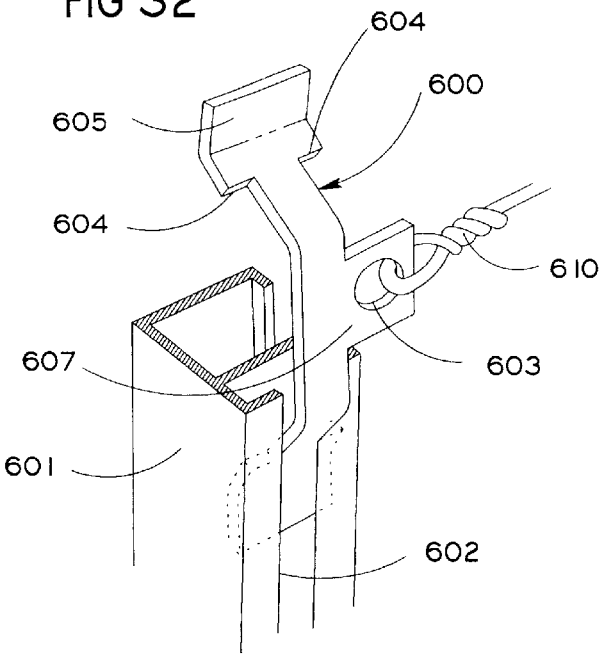
FIG. 32 is a perspective view of a prior art device commonly used to hang cable across the backs of frames made from aluminum channel.
Figure 33:
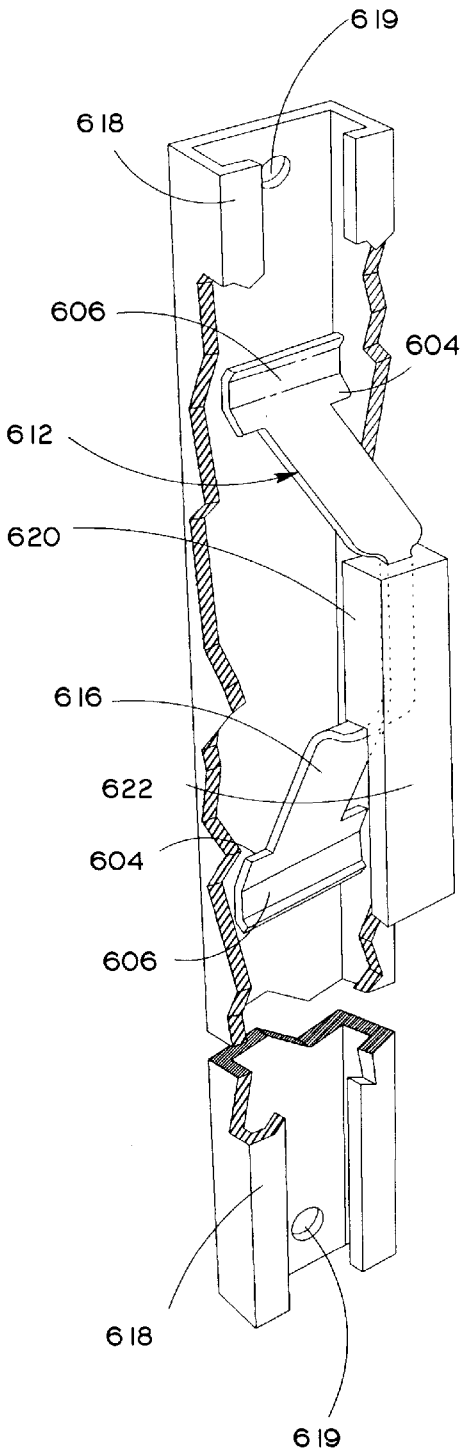
FIG. 33 is a cutaway perspective view of a two-way adjustable embodiment wherein vertical adjustment is activated by pressing the hanging item in toward the wall.
Figure 34:
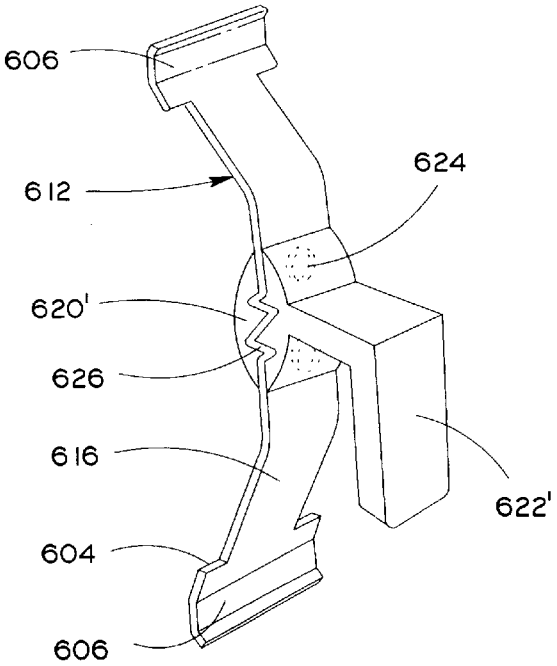
FIG. 34 is a partial perspective view of an embodiment similar to that of FIG. 33.

FIGS. 33 and 34 show two versions of a two-way adjustable embodiment wherein vertical adjustability is activated by pressing inward against the hanging item and into the wall. FIG. 32 shows a prior art hanging device that relies in part on a similar mechanism which will be described here first for reference. This prior art device is now commonly used to secure a conventional horizontal hanging cable to the rear of hanging items having an aluminum channel frame such as that shown here as 601. In these devices, a sliding grip 600 is placed in a channel of each side of the frame 601, and has attachment point 603 to which one end of the horizontal cable 610 is attached. A similar mirror image sliding grip (not shown) placed in the opposing side of frame 601 secures the other end of the cable 610. The sliding grip 600 is metallic and biased so that its front surface 607 and uppermost extensions 604 of the feet 605 urge outwardly at rest, with the extensions 604 forcefully impinging against the opposing interior edge of the channel 602 so as to strongly inhibit sliding movement of grip 600 with respect to channel 602 at rest. Both sliding grips 600 can be adjusted upwardly or downwardly by manually pressing on surface 607 against the bias of grip 600, which allows the feet 605 to move away and unlock from the opposing edges of channel 602, allowing the grip 600 to move more freely up or down in channel 602. Pressing against the grip's bias may make more oblique the angle at which the distal tips of feet 605 impinge on the interior of channel 602 further rendering sliding more facile. In any event, when the grip 600 is pressed, moved, and located at a desired position, the inward pressure on the front surface 607 is released, and the feet 605 lock into the channel 602 again. This procedure allows the height of the hanging cable 610 (and thus the hanging item) to be adjusted, however it requires the user to remove the item from the wall (or to at least inconveniently reach behind the frame at both sides) in order to make any such adjustment.

The embodiment of FIGS. 33 and 34 incorporate a similar biased lock mechanism, however, direct manual pressing of the mechanism behind the frame is not required, and removal of the hanging item is not necessary to accomplish vertical adjustment. Instead, to vertically adjust the hanging item, the user simply pushes inwardly on it enough to cause the front surface 622 of hook portion 620 to be pressed inward by the wall to and unlock feet 606 from the inside of track 618. Then, the user simply pushes the hanging item up or down while maintaining inward force against the hanging item so the hook assembly 612 remains unlocked from the inside of track 618 with its front surface 622 frictionally held in position against the wall. When the desired vertical position is found, the user releases the inward pressure, allowing the feet 606 of biased portion 616 to again lock in the track 618. Biased portion 616 may be metallic and have a waisted central portion around which hook portion can be insert molded from plastic.

The track 618 vertically extends along the hanging item's center of gravity (or "weight centerline") from the top to the bottom of the rear of the hanging item, and is attached with screws or the like through holes 619. Track 618 can be provided with suitable alternate mounting means known in the art (not shown), instead of or in addition to holes 619, depending on the hanging item to which it is to be attached (e.g., aluminum channel frame versus wood frame). Depending on the weight of the bottom, the track may be open for its entire length, or to prevent excessive torque and/or pitch and/or structural stress in the case of heavier hanging items there may be a closure or block at or below the track's vertical midpoint to prevent the hook from sliding below that point. The track can of course be constructed for recessed mounting in the case of hanging items that have sufficiently recessed backings to accommodate the track.

The prong of hook portion 620 seats on a wallbar constructed generally as described with reference to the foregoing embodiments, however, the seating portion of the wallbar should reside far enough from the wall so as to create a gap large enough to accommodate the degree of inward flexion of biased portion 616 required to unlock feet 606 from the interior of track 618. Of course, the wallbar permits free horizontal adjustment of the hanging item.

FIG. 34 shows a similar embodiment to that of FIG. 33, however, the prong of the hook portion 620' extends out from the middle of the hook assembly 612'. Here, the center of the biased portion 616' is wrinkled and includes holes 624, both to improve the connection of the biased portion 616' to the hook portion 620' in which it is insert-molded.

Although the embodiments of FIGS. 33 and 34 adjust without requiring any disengagement of the item from its support that would permit the item to fall to the ground if it were let go of, it should be noted that the item can be removed from the wall and the hook portion directly manipulated to effect adjustment. Further, a variation only permitting such direct adjustment could also easily be made (e.g., by compressing the size of the hook so that it could not hit the wall), and such an embodiment permitting continuous vertical adjustment and automatic continuous horizontal adjustment is also not taught in the prior art known to applicant. Such embodiments could alternately utilize many other clamping mechanisms known in the art to permit similar linear adjustment, including means that are only directly manually activatable.

FIGS. 35–41 show a two-way adjustable embodiment of the invention wherein vertical adjustability is activated by simply pulling directly up or down on the hanging item sufficiently. Vertical activation occurs when there is a pull sufficient to create a resulting (taking into account the downward force exerted on the hanging item by gravity) upward or downward force that is a bit greater than the force exerted on the hanging item by gravity. Preferably, the resultant force necessary for activation is sufficiently greater than the force ordinarily exerted by gravity that there is a minimal likelihood of unintended vertical adjustment caused by vibrations or the like.

Figure 35:
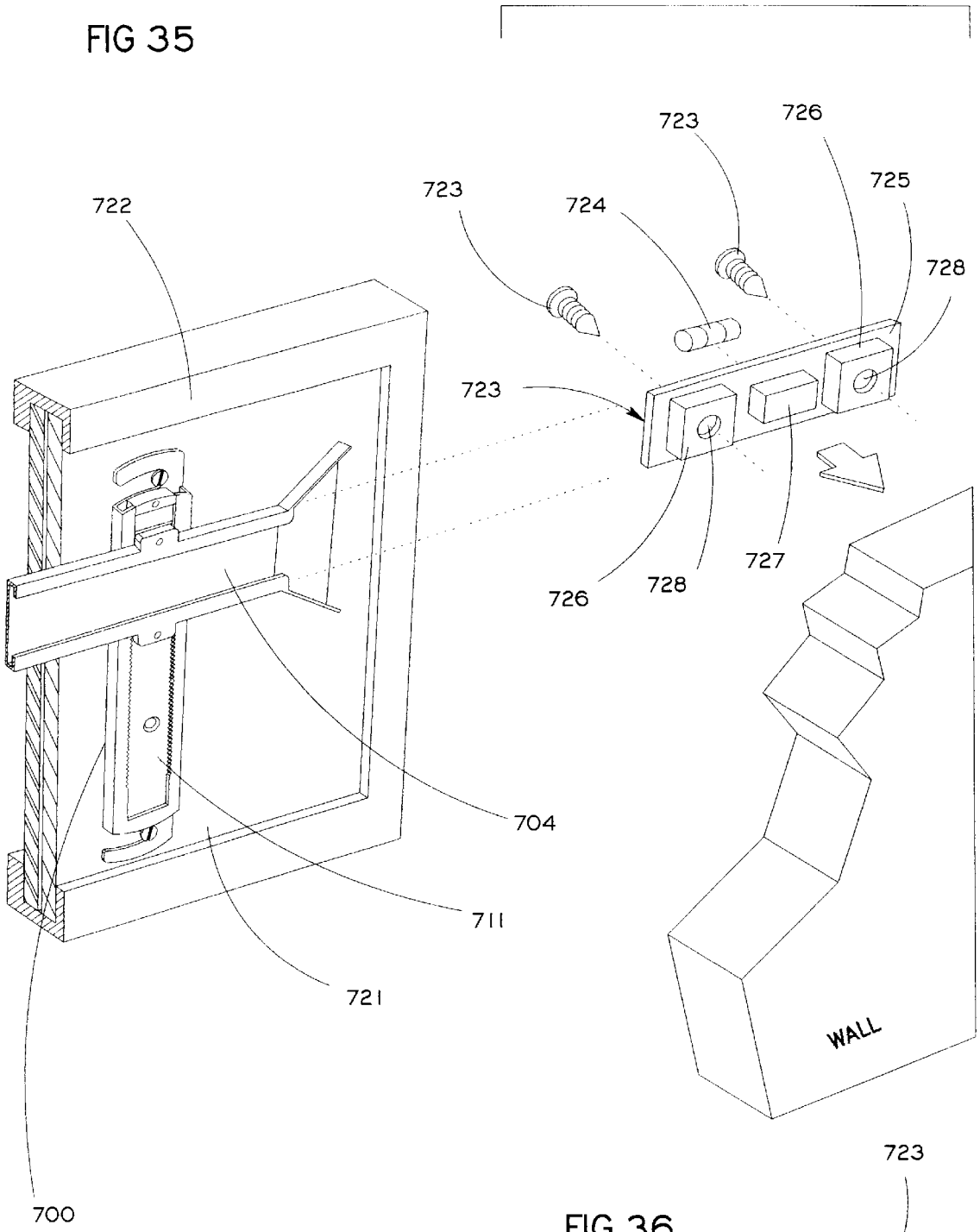
FIG. 35 is an exploded perspective cutaway view of a two-way adjustable embodiment wherein vertical adjustment is activated by exerting a predetermined force upward or downward, with the reverse side of the wall slide shown.
Figure 36:
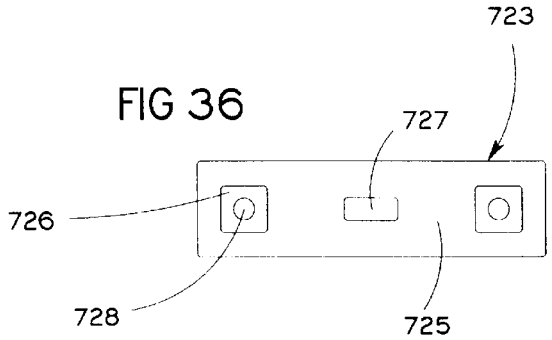
FIG. 36 is a front view of the obverse of the wall slide of the embodiment of FIG. 35.

FIG. 35 shows a cutaway exploded perspective view of the embodiment. Adjustable portion 700 is attached to the rear of the hanging item, for example, as shown, to a rigid backing 721 placed in a typical frame 722. Portion 700 includes a vertical track 711 and a horizontal track 704. Vertical track 711 vertically slidingly connects to horizontal track 704, and horizontally slides on horizontal wall slide 723. Slide 723, the obverse of which is shown in FIG. 36, is attached to the wall with screws 733 at holes 728. Front face 725 of slide 723 is spaced a selected distance from the wall by protrusions 726 (which appear as indentations from the front). The slide is hung on the wall by the user in a level fashion, optionally assisted by reference to the optional vial 724 which is friction fit into niche 727, or by equivalent level indicating means.

Figure 37:
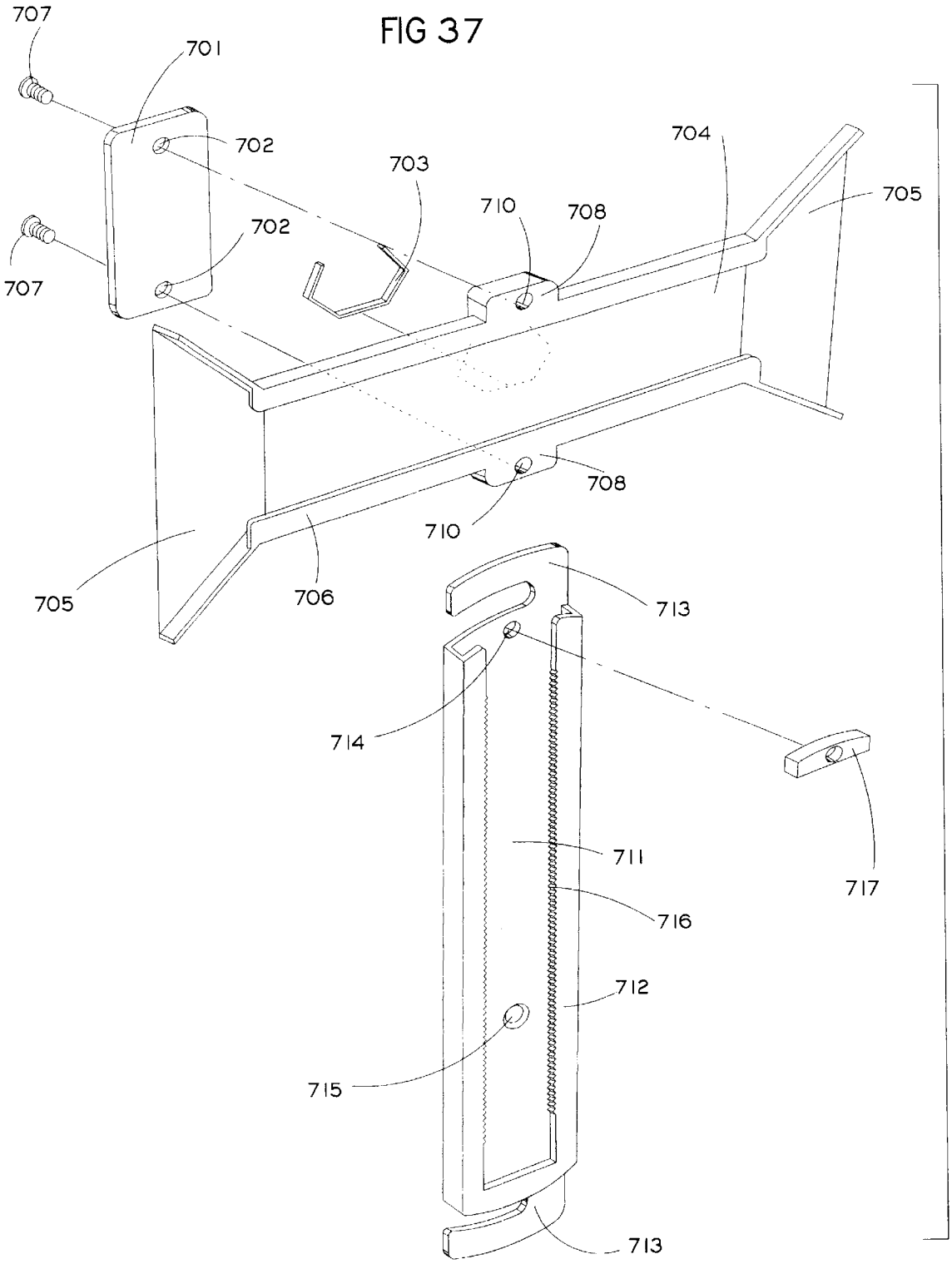
FIG. 37 is a partial exploded perspective view of the portion of the embodiment of FIG. 35 that mounts to the rear of the item to be hung.
Figure 38:
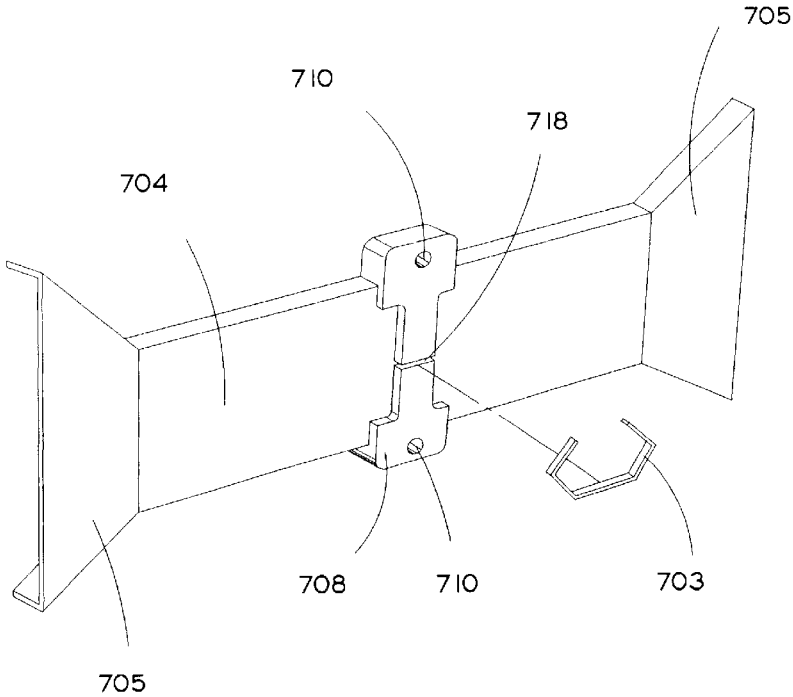
FIG. 38 is a partial exploded perspective view of part of the portion shown in FIG. 37, viewed from the other side.

FIG. 37 shows an exploded perspective view of portion 700. Vertical track 711 includes vertical lips 712 with frictional holding edges 716 that may optionally (as shown) be formed with teeth. Tines 713 are formed at the ends of track 711, to permit fixed attachment of track 711 to the rear of the hanging item, e.g., with screws. Track 704 includes horizontal lips 706, and flared ends 705 which distally widen and bend slightly inward towards the hanging item. Plate 701 holds spring 703 in place against the rear surface of track 704. As shown from the other side in FIG. 38, the bottom part of spring 703 is held in channel 718 between hubs 708 to which plate 701 is fixedly attached with a pair of screws 707 engaged through holes 702 and 710. Once track 704 is assembled, it is mated with track 711 by sliding the edges of plate 701 underneath lips 712 at their open end and then fastening block 717 to track 711 with a screw at hole 714.

Figure 39:
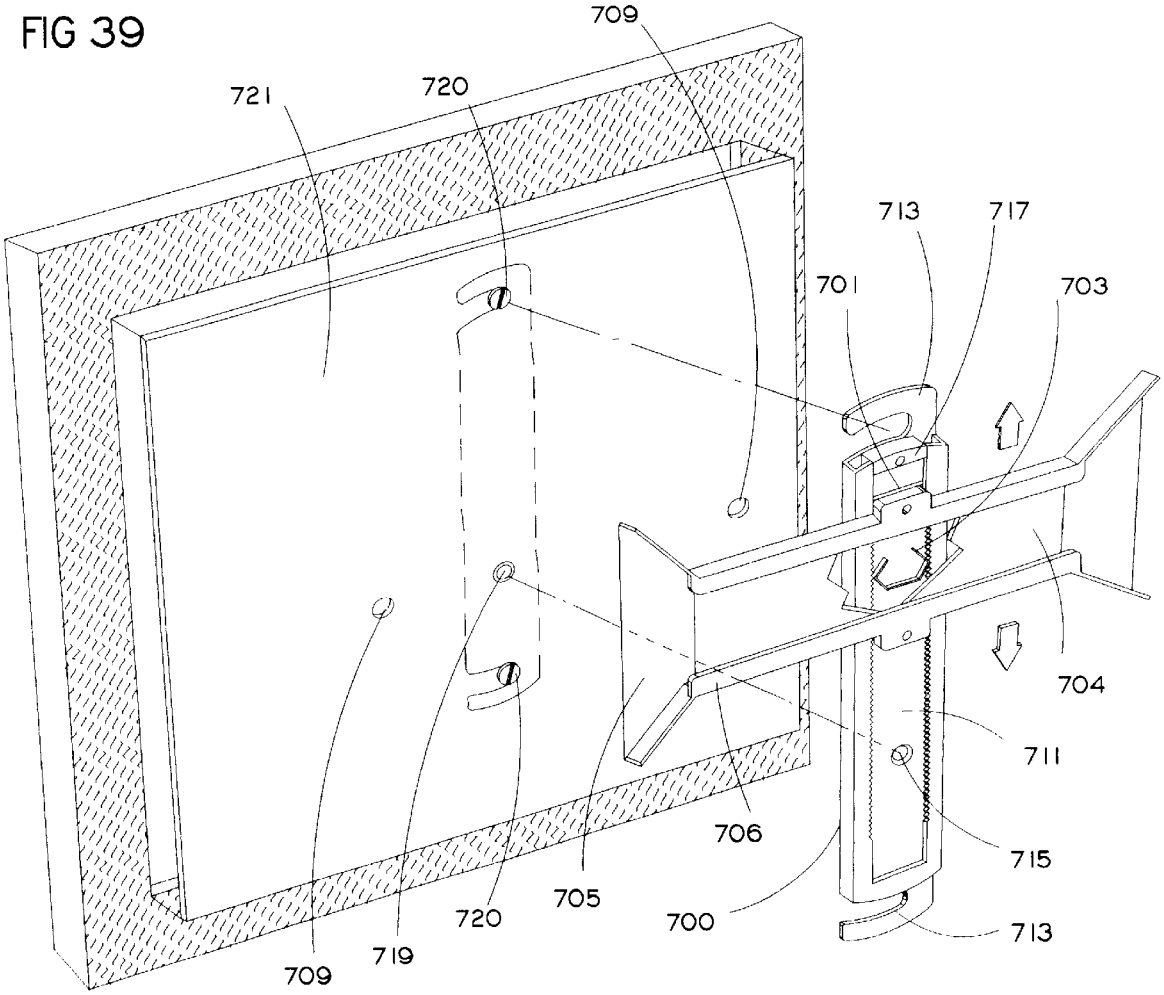
FIG. 39 is an exploded perspective and cutaway view of the portion of the embodiment of FIG. 35 that mounts to the rear of the item to be hung.
Figure 40:
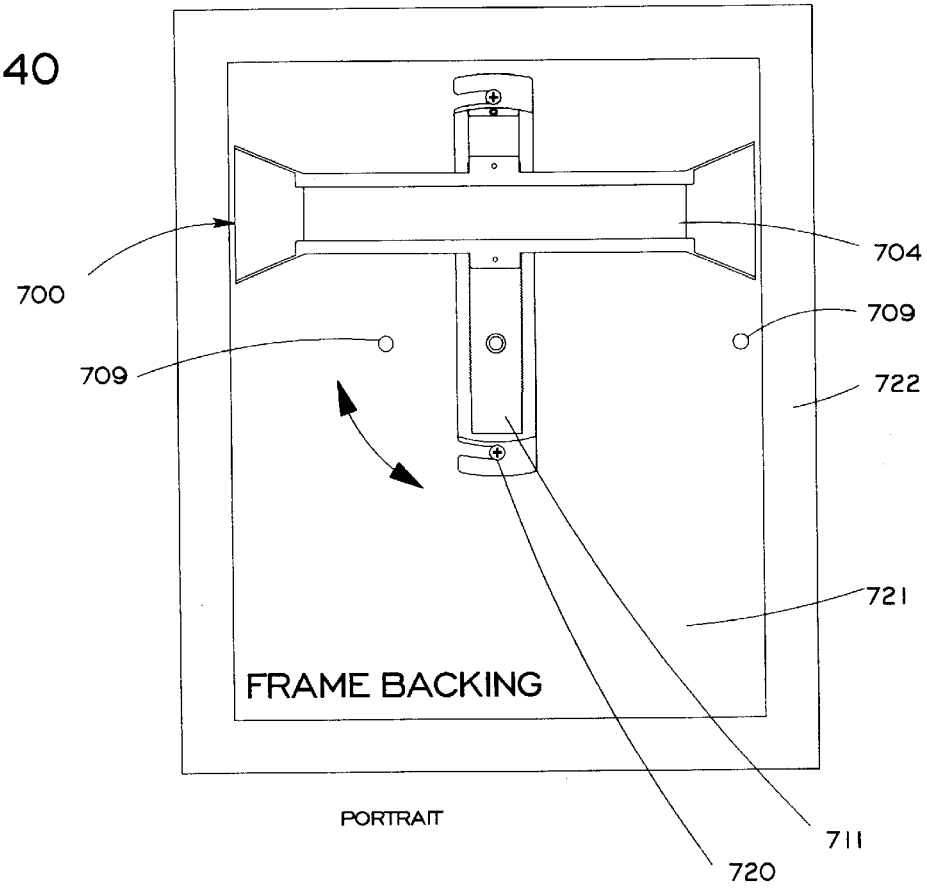
FIGS. 40 and 41 are front views of the portion of the embodiment of FIG. 35 that mounts to the rear of the item to be hung, shown respectively in two alternate mounting positions.
Figure 41:
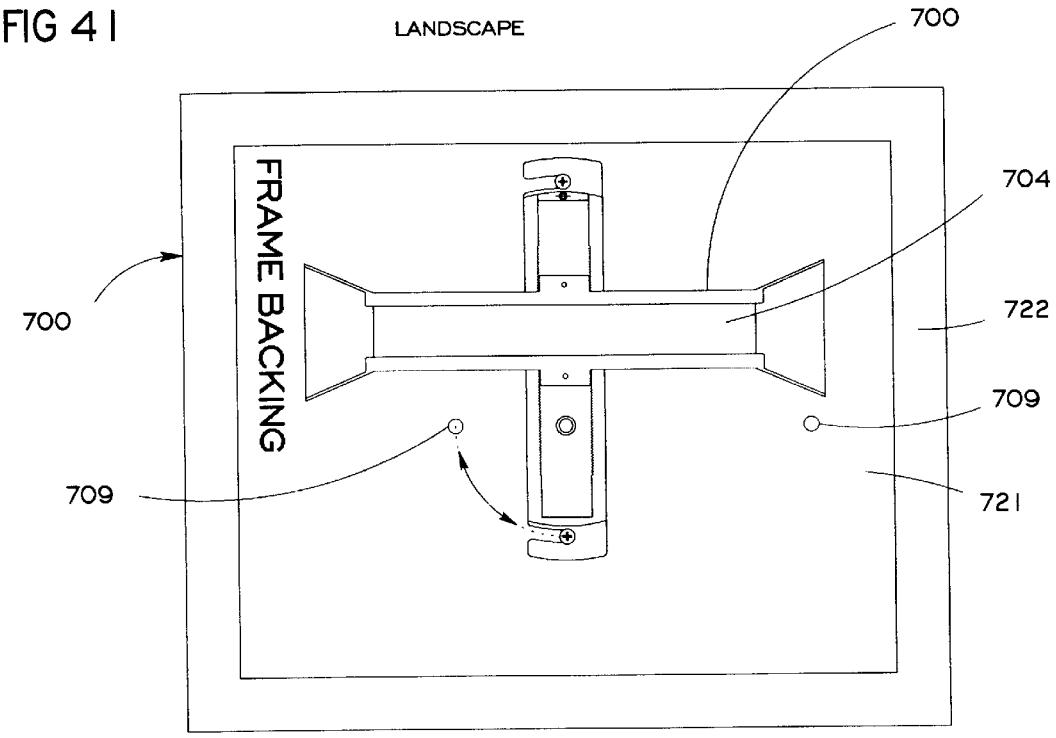

FIG. 39 is an exploded cutaway perspective view showing how the adjustable portion 700 can connect to the rigid backing 721 placed in a conventional frame 722. Portion 700 can be connected in a rotary fashion to backing 721, with a rivet (shown in FIGS. 40 and 41) or other suitable means rotatably connecting hole 715 to hole 719. Alternate holes 709 are provided, so that either a landscape or portrait hanging orientation can be selected by removing screws 720, rotating portion 700 ninety degrees at the rotary connection point between holes 715 and 719, and reaffixing screws 720 in the alternate holes 709. This rotary attachment method is optional but not necessary to the invention, however, and a simple fixed attachment to the backing or to the top and bottom of the frame, can be used. Also, with non-square items, using the rotary connection will reduce the adjustability (without visible overhang) available in one orientation.

In use, portion 700 is affixed to the rear of the item to be hung (by a manufacturer, custom framer, consumer, etc.), and wall slide 723 is affixed to the wall. The proper orientation of portion 700 (landscape versus portrait) can be selected and fixed as described above. Then, the item to be hung is positioned so that the left flared end 705 is adjacent to and aligned with the right end of slide 723 (or right with left). Flared end 705 is then moved further toward slide 723 until it hits the end of the slide 723 and is funneled along so that lips 706 slide into engagement around the corresponding top and bottom horizontal edges of front face 725 of slide 723. This funneling action is assisted by the slight inward bend of end 705 which allows the user to press the item fully against or very close to the wall during the process just described while preventing end 705 from going behind face 725, and by the flaring of end 705 which reduces the likelihood of lips 706 missing and thus failing to engage with slide 723. Once the item has begun to be engaged in this way, it is moved further until slide 723 provides sufficient support to hold the hanging item (support is best when the full horizontal length of slide 723 is engaged between lips 706). With the item hung on the wall in this fashion, its horizontal hanging position can be adjusted by simply moving the item laterally (until the limit is reached where slide 723 no longer is sufficiently engaged as described above), which occurs freely.

The item's vertical hanging position is frictionally locked by the pressure of spring 703, which is outwardly biased to lock against frictional holding edges 716. The tips of spring 703 contacting edges 716 can be modified, e.g., by providing them with more surface area, to increase the gripping of edges 716. Or, optionally (as shown), edges 716 can be formed with teeth corresponding to the tips of spring 703, to provide a supplemental mechanical locking action. (By "supplemental" it is meant that such mechanical means' surfaces which prevent vertical movement form an angle with that direction of vertical movement that is significantly less than ninety degrees, e.g., forty-five degrees). In any event, the item's vertical position is adjusted by pulling the item directly upward or downward with enough force to overcome the locking of spring 703 along edges 716. The item then moves up or down, with plate 701 sliding vertically underneath lips 712 and maintaining the orientation of the item. When the aforementioned force is withdrawn, the hanging item no longer moves vertically. The item can be removed by simply sliding it horizontally far enough to one direction so that the slide 725 is no longer held within lips 706.

It should be noted that as depicted in FIGS. 35–41, this embodiment relies on the vertical captivation of slide 725 created by its engagement with horizontal track 704 to permit vertical activation. This would be possible only in the downward direction if an unmodified downward pointing hook and wallbar (as described elsewhere herein) were substituted for the horizontal track 704 and slide 725. However, a hybrid version of the depicted embodiment can readily be created by replacing track 704 with a modified hook and replacing slide 725 with a modified wallbar. The hook would be modified (in addition to being modified to form an appropriately stable connection to the spring) by providing a barb at its end similar to a fishhook arrangement, and by making the tip of the hook slightly flexible. The hook and/or wallbar would be modified so that, during the process of seating the hook on the wallbar, the hook tip would need to flex slightly outwardly (toward the wall) in order to permit the barb to pass over the rear surface of the wallbar. The hook tip would have a length such that the barb could just pass below the bottom edge of the wallbar, and the hook tip would have to be resilient so as to then flex back to its original shape causing the barb to catch under the wallbar preventing the hook from passing back up over the wallbar's rear surface if the item were pulled upwardly. Also, the wallbar would include an escape for the barb to permit disengagement of the item from the wallbar (e.g., a portion of reduced thickness of the wallbar's edge provided at the left or right end of the wallbar, or some manual security means).

The depicted embodiment has the advantage (vis-à-vis the hybrid just discussed) of allowing horizontal adjustment (without visible overhang of the device) of more than one half the horizontal length of the item to be hung. While this advantage is more applicable to lighter items (since undue torque may be created on the assembly by a heavy item that is supported horizontally too far from its center of mass), the depicted embodiment is generally more useful with lighter embodiments anyway due to the relatively high force that would be necessary for upwardly adjusting a holding mechanism suited for a heavier items. On the other hand, the holding mechanism of the depicted embodiment could readily be replaced by an alternate holding mechanism that relies on an activation force that is not aligned with gravity, which would greatly reduce the user's force required for upward activation in the case of embodiments made for heavier items. For example, spring 703 and plate 701 could be replaced by a biased portion and locking feet (similar to those described in FIGS. 32–34) running in track 711, with vertical activation occurring when the item is pressed against the wall.

FIGS. 42–61 show a two-way adjustable embodiment wherein vertical adjustment is activated by applying slight pressure on an activation trigger at an edge of the rear of the hanging item. As shown in the partial perspective cutaway exploded view of FIG. 42, the front view of FIG. 43, and the side view of FIG. 44, this embodiment includes a vertically adjustable assembly comprising a vertically adjustable downward pointing hook 824 that is formed to mate with a wallbar (further described in connection with FIGS. 57–61). The hook 824 adjusts vertically on a track 812. Vertical adjustability is activated by pressing trigger head 802 down a slight amount, which causes trigger rod 808 to force the top annular surface 843 of ball cage 831 down, allowing balls 832 to move outwardly in bores 841 at a larger diameter portion of inner conical surface 845 of lock clamp body 830 thereby releasing their lock on hookrod 820 which is fixedly connected to hook 824. The lower end of track 812 (cutaway) is fixedly connected to the correspondingly shaped upper portion 833 of clamp body 830, and endcap 837 is secured to lock clamp body 830 with threads 836 screwed into threads 838. Coil spring 834 is contained at its lower end by the top of endcap 837, sheathes the lower projection 835 of ball cage 831, and abuts the bottom of flange 842 thereby urging ball cage 831 upwardly towards the smaller diameter portion of the interior conical surface 845. Endcap also includes aperture 839 which permits the end of hookrod 820 to pass through when hook 824 is adjusted downwardly. Cap 804 is fixedly connected to the top of track 812 and includes projection 810 which may abut the top surface 818 of hook 824 when hook 824 is adjusted to its uppermost extent. Cap 804 also includes an aperture for trigger rod 808 to pass through it, and also includes screweyes 814 through which screws 806 can mount cap 804 to the top of the rear surface of the item to be hung (in the illustrated example, frame 800). Cap 804 could optionally include a pair of angled ramps (not shown, but similar to those in FIGS. 54A and 54B) extending along the two distant side edges of the cap (just beyond the screweyes) and extending a bit below its bottom edges, to physically prevent the wallbar 860 from ever catching directly under projection 810 in such a way that a user might be misled into releasing the item thinking the hook had seated on the wallbar.

Horizontal cable 840 is threaded through bore 821 in lock clamp body 830 and is attached at either side of the rear of the hanging item in a fashion similar to that conventionally used in hanging frames except that cable 840 is pulled taut (alternately, it can be attached straight to the bottom of the item or in down to the bottom corners of the item so as to form an upside-down "Y" when viewed as a whole with the track). Hook rod 820 runs within channel 816 defined in the front of track 812 and has a ninety degree bend at its top where it attaches (e.g., by soldering, glue, or welding) to hook 824 at niche 819 as also shown in FIGS. 45–49. Alternately, an upside down "U" shaped end of hookrod 820 could be insert molded or cast into hook 824 at a central or other internal position lower than that of niche 819. Hook 824 is maintained in position on track 812 because it has a complementary shape as particularly shown in FIG. 46, with rear extensions 826 wrapping behind track 812 and sides 825 running alongside the sides of track 812. Trigger rod 808, which has a rectangular cross section, is held captive within the correspondingly shaped but slightly larger channel 809 in track 812. Trigger rod 808 may alternately be formed of two cylindrical rods joined side by side, so as to create a central indentation between them which allows a little more space for hookrod 820 to nestle inwardly. Hook 824 may have a pointed tip 827 to facilitate the seating of prong 822 behind the wallbar.

The clamp mechanism is shown in more detail in FIGS. 50–54. For more detail on such mechanisms, the disclosure of U.S. Pat. No. 4,656,698, issued to Arakawa on Apr. 14, 1987, is incorporated herein by reference in full, and particular attention drawn to that patent's FIGS. 1–3 and 9–13 and corresponding description. Also incorporated herein by reference is the disclosure of U.S. Pat. No. 5,359,870 issued to Reutlinger on Nov. 1, 1994 and disclosing similar ball detent or "ball and cage" lock clamps. While the present embodiment is obviously amenable to using any suitable clamping mechanism permitting a remote trigger adaptation (including ones with a hookrod of non-circular, e.g., rectangular, cross-section), the ball detent clamp is illustrated as it is particularly reliable, capable of supporting significant weight, and easily triggered.

Figure 42:
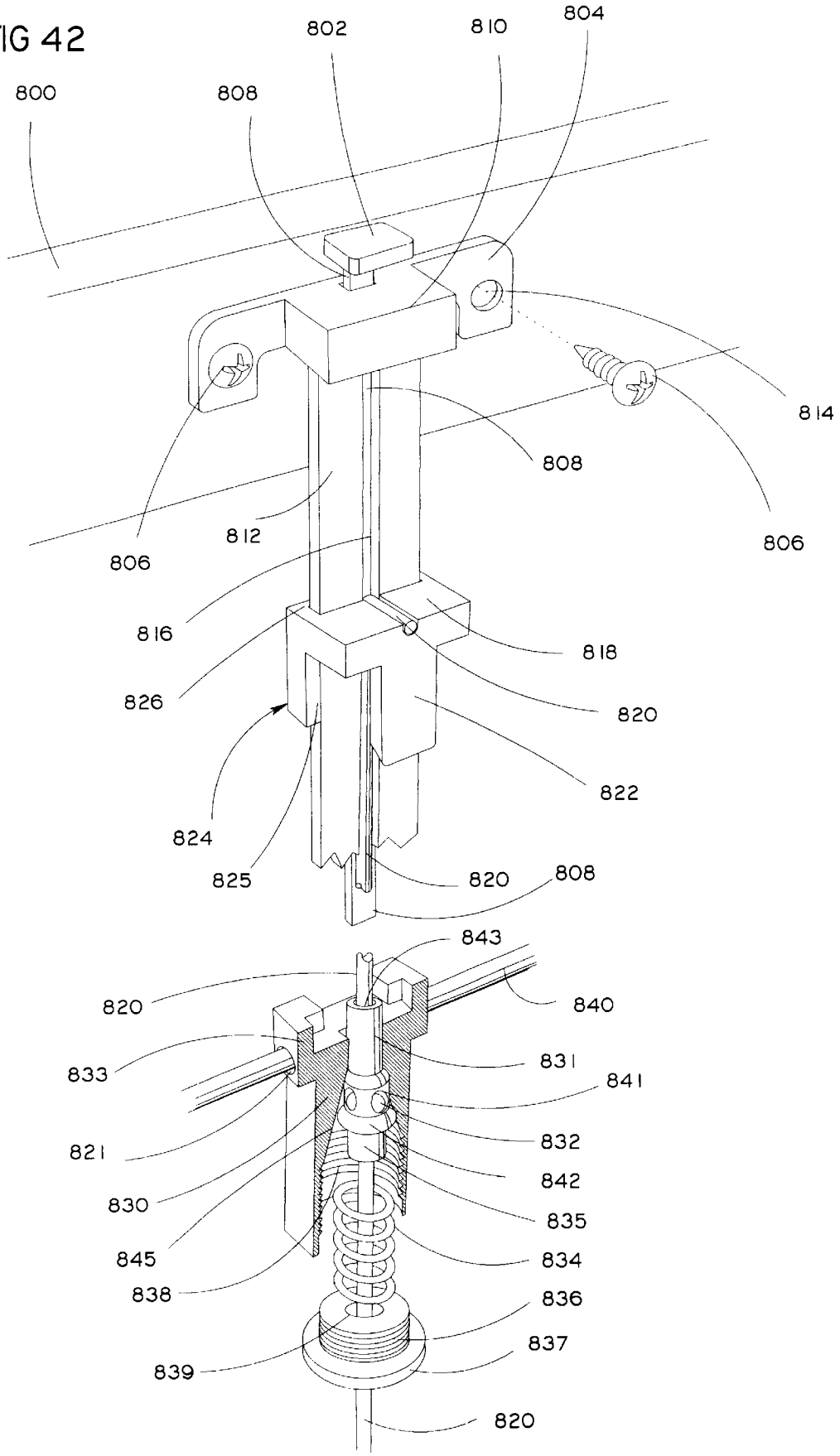
FIG. 42 is a partial perspective cutaway exploded view of a two-way adjustable embodiment wherein vertical adjustability is activated and maintained by pressing on a button placed at the top edge of the frame.
Figure 43:
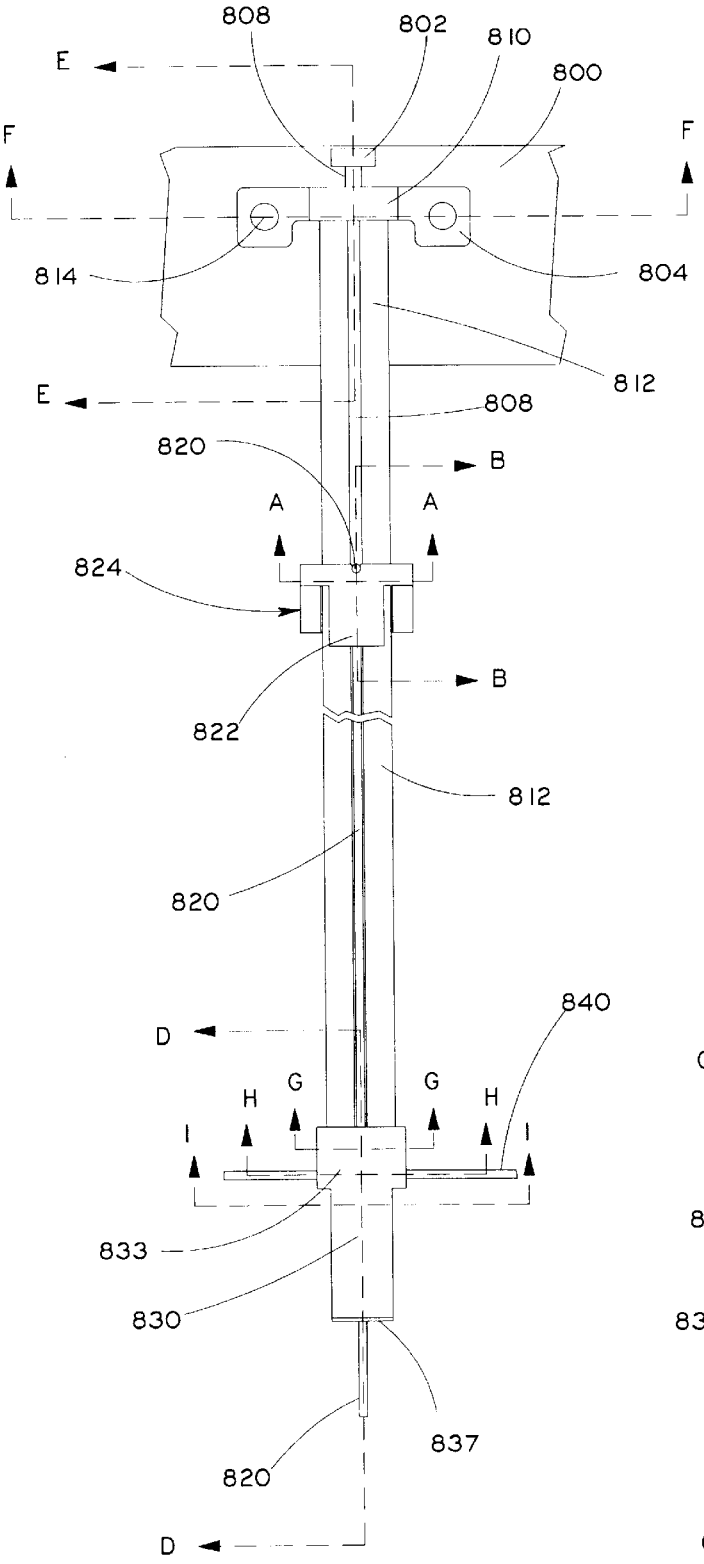
FIGS. 43 and 44 are front and side views, respectively, of the embodiment of FIG. 42.
Figure 44:
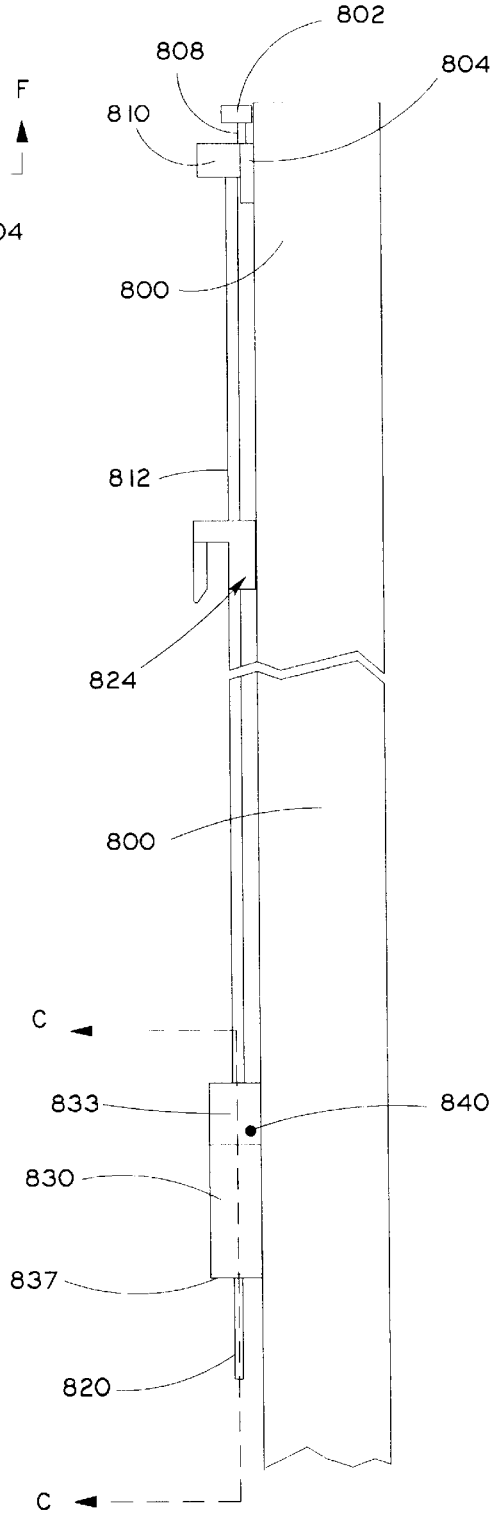
Figure 45:
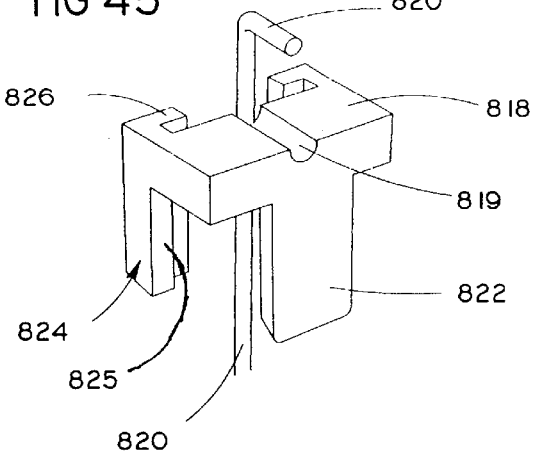
FIG. 45 is a partial exploded perspective view of the hook of the embodiment of FIG. 42.
Figure 46:
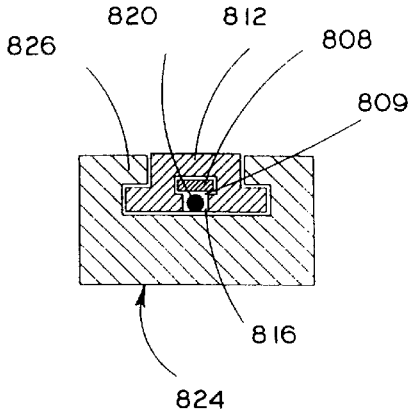
FIG. 46 is a sectional view taken through the line A—A of FIG. 43.
Figure 47:
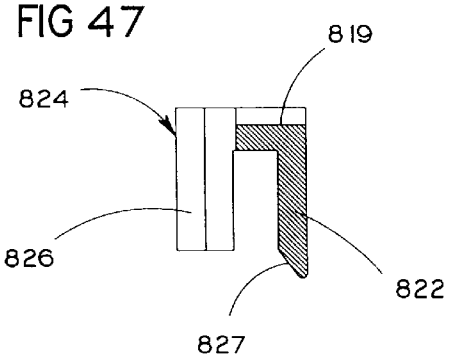
FIG. 47 is a sectional view taken through the line B—B of FIG. 43.
Figure 48:
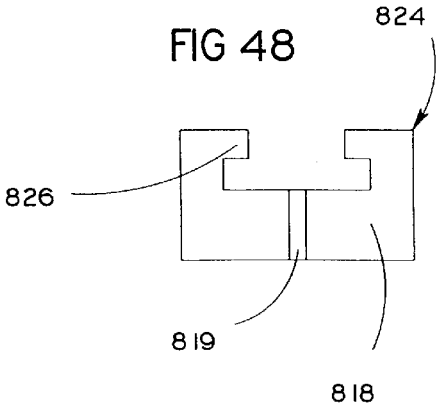
FIG. 48 is a top view of the hook of FIG. 42.
Figure 49:
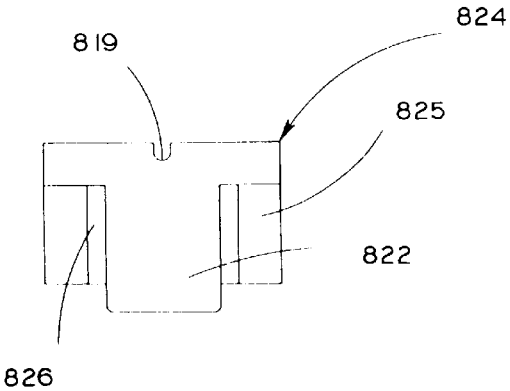
FIG. 49 is a front view of the hook of FIG. 42.
Figure 50:
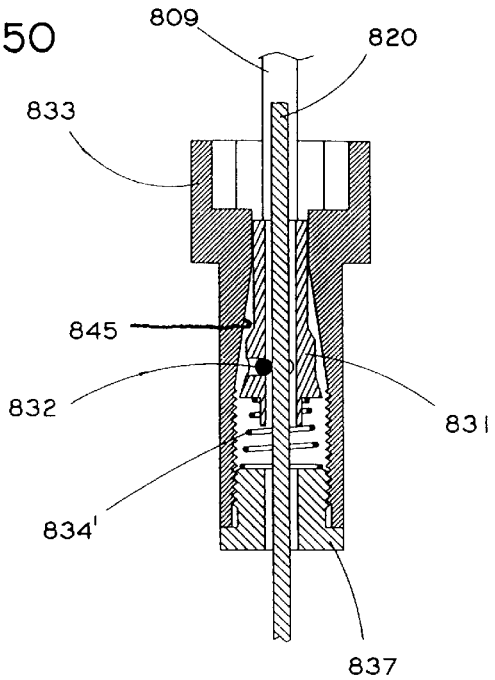
FIG. 50 is a sectional view taken through the line C—C of FIG. 44.
Figure 51:
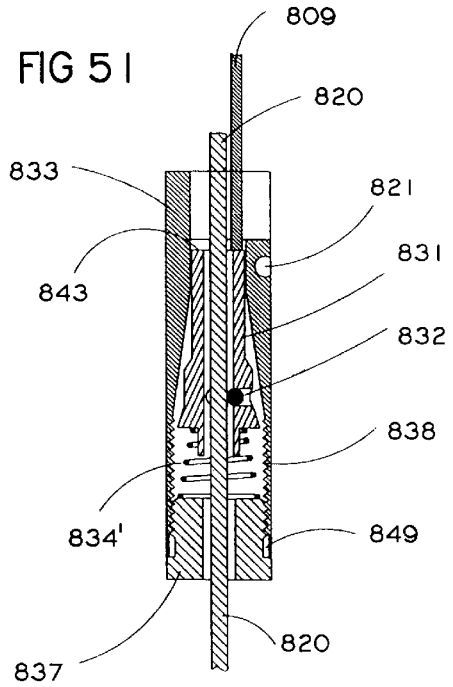
FIG. 51 is a sectional view taken through the line D—D of FIG. 43.
Figure 52:
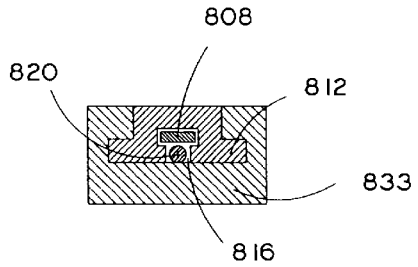
FIG. 52 is a sectional view taken through the line G—G of FIG. 43.

FIGS. 50–54 are sections taken through the clamp of the embodiment of FIGS. 42–44. FIGS. 50 and 51 show an alternate spring 834' that is conical rather than cylindrical, and show that gap 849 may be provided for the introduction of glue to more securely bond endcap 837 to clamp body 830. As shown in FIG. 52, top portion 833 of clamp body

Figure 54A:
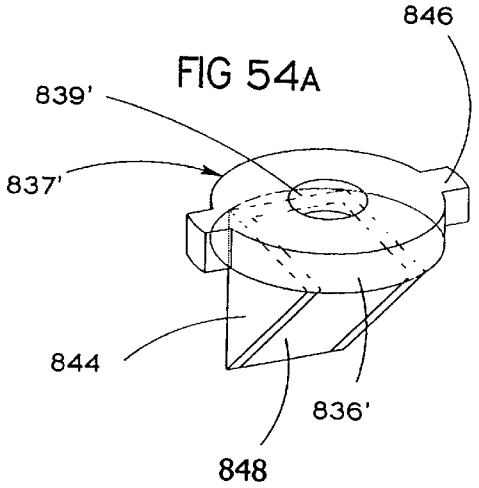
FIG. 54A is perspective transparent view of an alternate endcap for use with an embodiment similar to that of FIG. 42.
Figure 53:
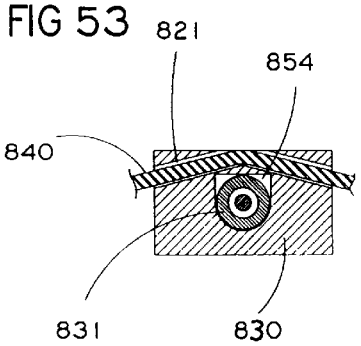
FIG. 53 is a sectional view taken through the line H—H of FIG. 43.
Figure 54B:
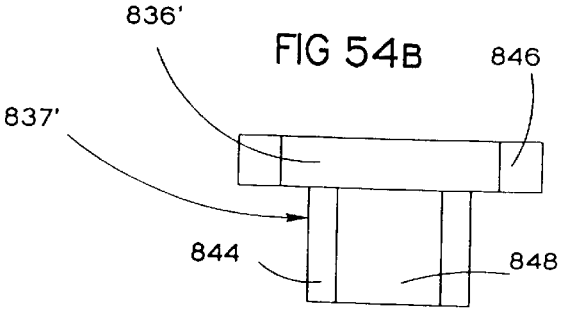
FIG. 54B is a front view of the endcap of FIG. 54A.
Figure 54:
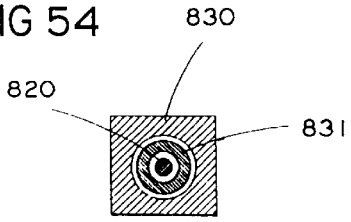
FIG. 54 is a sectional view taken through the line I—I of FIG. 43.
Figure 55:
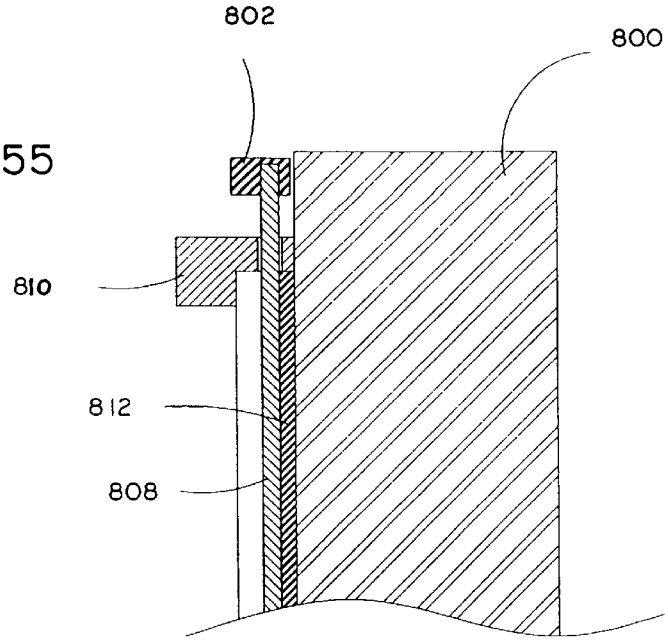
FIG. 55 is a sectional view taken through the line E—E of FIG. 43.
Figure 56:
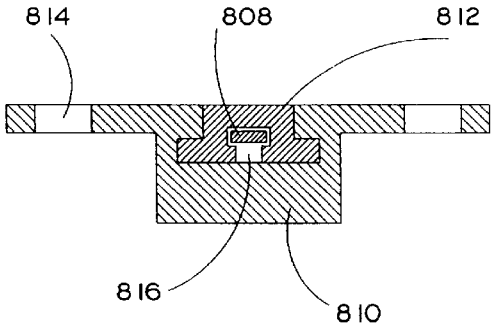
FIG. 56 is a sectional view taken through the line F—F of FIG. 43.

830 is bonded to the bottom portion of track 812. As shown in FIG. 53, the portion of clamp body 830 below the bottom of track 812 but above conical inner surface portion 845 has an internal aperture 854 with a "mailbox" shape, to permit the end of the (rectangular cross-sectioned) trigger rod to fit and travel down thereinto. This aperture 854 changes to an ordinary circular shape at the conical inner surface portion 845 as shown in FIG. 54. The "mailbox" shape aperture 854 should extend at least far enough to allow the trigger rod to travel far enough downwardly to fully unclamp a rod 820 of a predetermined widest diameter (e.g., 1.5 mm); as the diameter of rod 820 increases, cage 831 must be pushed further downward along conical surface 845 to unclamp. Conversely, annular top 843 of cage 831 should have sufficient leeway to move upward enough to cause clamping of a predetermined narrowest diameter rod 820 (e.g., 1.0 mm). For example, in an embodiment using 1.0 to 1.5 mm hookrod, the mailbox shape aperture section should extend vertically about 4 mm. As shown in FIGS. 55 and 56, only trigger rod 808 extends upward through cap 804. An alternate, unthreaded endcap 837' could be used, as shown in FIGS. 54A and 54B. Instead of threads 836, endcap 837' would have a smooth mating portion 836' which friction fits into a corresponding non-threaded interior of the end of a modified clamp body (not shown), and could be glued, soldered or otherwise fixed in place. Also, tabs 846 could be provided (along with a corresponding further modification to the interior of the end of the clamp body) to allow more secure fixation of the endcap. Tabs 846 would also prevent rotation of the endcap 837', which would be beneficial if, as shown, optional ramps 844 are provided. Ramps 844 are angled so as to slip past the wallbar if it is contacted during hanging, preventing unwanted catching of the wallbar by the bottom of the clamp that might otherwise mislead a user into improperly letting go of the item. Ramps 844 are oriented such that connecting rear wall 848 goes nearest the rear of the item to be hung.

Underhang of the end of hookrod 820 is prevented by selecting an appropriate-sized vertical assembly for a given item, and mounting it at the top of the item, both of which also maximize the available vertical adjustability. With items having a rear that protrudes further out at the middle than at the top (e.g., a framed item with a taped-in-place backing that protrudes further out than the rear edge of the frame), a shim, block, or spacer can be placed under cap 804 to permit it to be secured to the top of the rear of the item without track 812 damaging or unduly pressing into the protruding rear of the item.

In an alternate embodiment (not shown), hookrod 820 could be replaced with a non-rigid cable. A flexible cable's lower end could be gathered in by an uptake means (as in the mechanism of an automatic hand-held tape measure) or manually tucked behind the hanging item on a suitable post or the like, allowing for vertical adjustment in excess of half the item's vertical height without visible underhang of the cable. (Without some lower support extension which would of course be visible, however, it is not preferable to support heavier items with the wallbar support being too far below the midpoint of the item, because undue torque is exerted on the hanger and wallbar). Visible underhang of a cable could also be preferable aesthetically and safety-wise to that of a rigid rod. The lack of rigidity of a cable, however, could make seating the hook on the wallbar more difficult since the hook and cable would tend to slide downward prior to seating, so additional means of temporarily keeping the hook in place prior to seating (e.g., manually holding the hook, or provision of a slight bump at the top of the track) would be beneficial. A weight or uptake means should also be added to the bottom of the cable as a substitute for the weight of the hook itself which, when a rigid hookrod is used, transmits its weight directly down the hookrod, forcing it down through the clamp mechanism when unclamped, keeping up with the user's adjustment.

The embodiment of FIGS. 42–61 could also be adapted (not shown) to include a more rigid connection than that afforded by cable 840 alone, reducing pitching when the item is hung at its highest position (i.e., with the hook at its lowest position). For example, if the item permitted, a direct connection (e.g., tape, glue, screw, etc.) could be made between the clamp and the portion of the rear of the item just beneath the clamp (with or without cable 840). Or, instead of utilizing cable 840, a rigid vertical rod could connect the bottom of the clamp to the bottom of the rear of the hanging item (or, although less preferred, a horizontal rod could connect the clamp to both sides of the item). Such a rod could be built into endcap 837 or clamp body 830 in such a way that rigidity between track 812 and the rod is maximized (e.g., by extending the bottom portion of the clamp so as to mate with an extended part of the rod). The rod could further be optionally adapted to adjust to a few discrete mounting lengths or a continuous range of mounting lengths, so that stock track sizes could be used for all frames. To allow such a continuous range, a telescoping connection could be used, or serial attachment holes and break slots or perforations could be provided at the end of the lower connector, for example as taught in U.S. Pat. No. 2,740,603, issued to Wofford on Apr. 3, 1956, the disclosure of which is incorporated herein by reference.

Also, an alternate cap and trigger could be made to permit a recessed mounting (in the case of items having an appropriately recessed rear, such as a frame with a sufficiently recessed backing) of the track 812 such that its farthest extent is flush with the edges of the rear of the item, with only the hook protruding when the item is viewed from the side. In such an alternate embodiment, the section of the cap where the holes for screws 806 are provided would have to be farther out relative to the track, and the top of the trigger rod could take an "S" curve to wrap around the frame edge. With aluminum channel frames, an alternate lower connection means as described above may be preferable, and known means of connection to channel frames could be used. This would also permit a recessed mounting, in which case a hole could be drilled at the top of the frame to pass the trigger rod through (the trigger head could be subsequently glued or screwed on by the framer), or an "S" curve made in the trigger rod.

Figure 59:
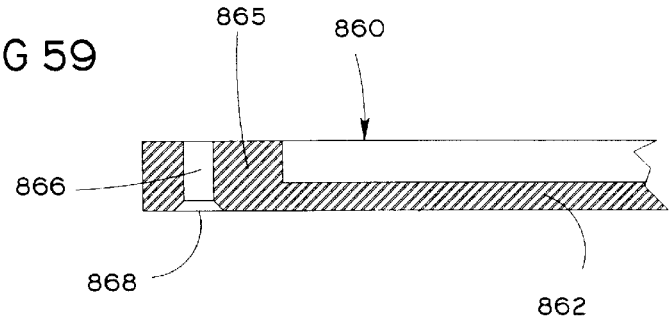
FIG. 59 is a sectional view taken through the line J—J of FIG. 60.
Figure 57:
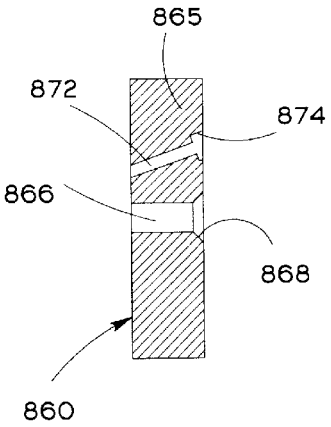
FIG. 57 is a sectional view taken through the line K—K of FIG. 60.
Figure 60:
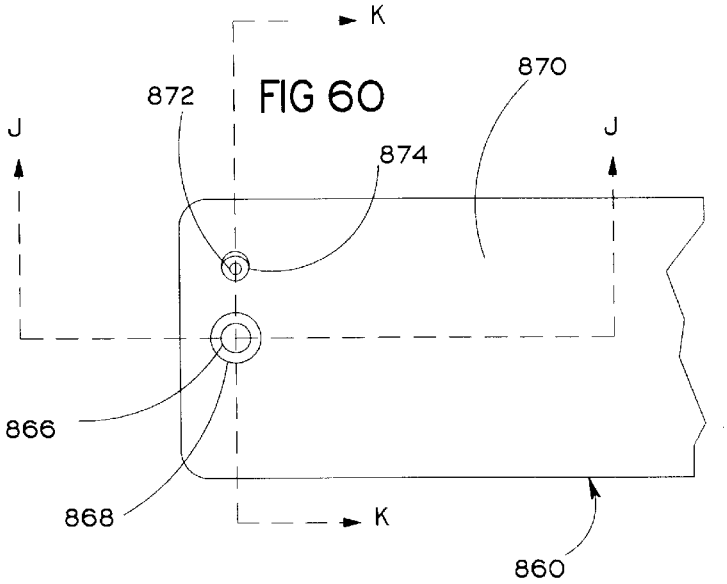
FIG. 60 is a partial front view of a wallbar for use with the embodiment of FIGS. 42–56.
Figure 58:
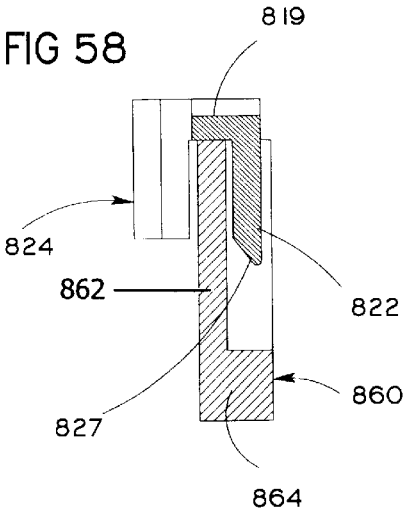
FIG. 58 is a sectional view taken through the line L—L of FIG. 60, showing a hook seating on the wallbar.
Figure 61:
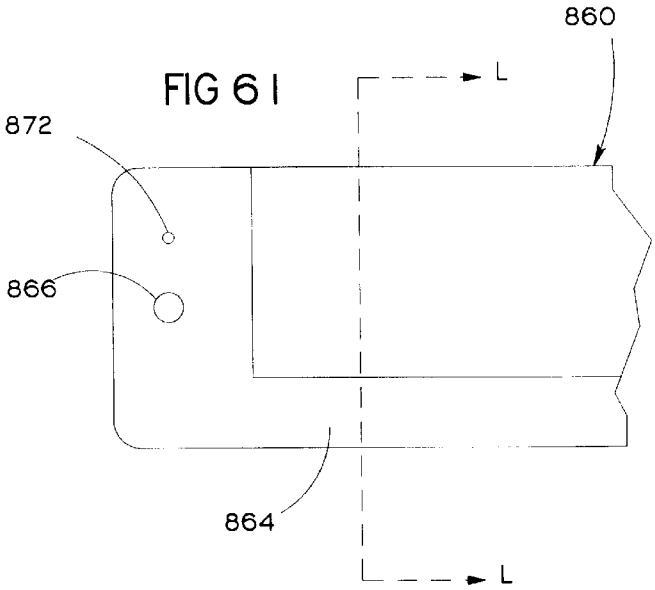
FIG. 61 is a partial rear view of a wallbar for use with the embodiment of FIGS. 42–56.

Turning to FIGS. 57–61, a wallbar 860 particularly suited for use with the embodiment of FIGS. 42–56A is shown (left sides only shown in FIGS. 59–61). Wallbar 860 includes a hook supporting wall 862 spaced a predetermined distance, or gap, from the wall by sides 865. Sides 865 in turn either have (or as shown, optionally have both) nailholes 872 or screwholes 866 with bevels 874 and 868 respectively, with the nailholes being downwardly angled to provide more secure attachment to the wall. Also as shown, wallbar 860 optionally includes a lower support rib 864. The gap between the wall and wallbar 860 is selected to correspond to the thickness of prong 822 of hook 824 and to incorporate some degree of leeway; correspondingly, the relative sizes and resulting tolerances between the supporting wall 862 of wallbar 860 and the gap between prong 822 and the front of sides 825 of hook 824 may be selected to allow freer relative movement or to induce some degree of frictional holding of the hook to the wallbar once seated. Alternately, a magnet (not shown) could be incorporated into the hook, and a ferrous material could then be included in or could comprise the wallbar (or vice versa). Alternately still, a slight horizontally extending ridge (not shown) could be formed on the rear side of the supporting wall 862 of the wallbar 860 and a corresponding barb (not shown) could be formed at the end of prong 822 of hook 824. In the latter case, the ridge could end a bit before reaching the right- or left-most end of the rear side of the supporting wall 862, so that the hook could be moved to that side to allow its barb to escape the ridge, permitting removal of the hook from the wallbar.

In the embodiments of FIGS. 42–64, both the ratios of vertical adjustability vs. vertical item length, and horizontal adjustability vs. horizontal item length (assuming no visible overhang of the device), are maximized by minimizing the length of non-adjustable portions that obstruct adjustment such as the vertical length of cap 804, the distance from the top of cap 804 to the top of the frame, the distance between the top of clamp body 830 and balls 832, the vertical length of wallbar 860, and the horizontal length of its sides 865. Generally, a given reduction to any of these aspects results in a corresponding increase in adjustability equal to 50% of the reduction.

In operation of the embodiment of FIGS. 42–64, a custom framer attaches the vertically adjustable assembly to the rear of a frame by affixing screws 806 to the top of the frame so trigger 802 is flush or slightly above or below the top of the frame, and so that track 812 is along the center of weight line of the item. A cable is then threaded through bore 821 and horizontally tautly attached between the sides of the frame, or an alternate more rigid lower connection means is used. If cable is used, the custom framer should if possible tape the clamp to the backing, placing a shim of appropriate thickness between the clamp and backing if necessary to keep track 812 aligned with the plane of the item. A toothpick tip may be wedged in bore 821, or other suitable means may be used, to lock cable 840 in place. To maximize adjustability and prevent visible overextension of the hookrod, the framer should select a unit that has vertically adjustability of just less than half the vertical length of the item to be hung. This is also important with heavier items, because if support from the wall (which goes through the wallbar and into the hook at whatever vertical level the hook is placed) is too low on the item, undue torque and thus undesirable pitch or failure can result. With non-recessed mountings, felt or rubber bumpers are preferably placed at the bottom corners of the frame to minimize pitching and torque.

Then, the framer selects a wallbar that is preferably about one half as long as the horizontal length of the item to be hung, and provides it along with the item to the customer. The framer may demonstrate the system to the customer using a demo in the frame shop.

Finally, the customer affixes the wallbar to the wall, makes sure the hook is at or near the top of the track, and slides the item to be hung down the wall until the hook hits and seats on the wallbar. The item freely moves sideways. To accomplish vertical adjustment, the user holds the top edge of the item with one hand, applies slight downward finger pressure on the trigger head, and moves the item up, down, or diagonally on the wall. Preferably, the user's free hand is used to support another edge of the item during adjustment. When a possibly suitable position is found, pressure on the trigger head is released and the picture is gently released.

Track 812 can be any suitably rigid material, including metals such as extruded aluminum or high strength alloys, steel, or, for lighter applications, an injection-molded plastic of high strength and durability. Hook 824 can be metallic, such as die cast zinc, or it can be injection-molded of high strength plastic, preferably with the end of hook rod 820 bent into an upside down "U" shape and insert molded into it. Cap 804 can be metallic, such as die cast zinc, or high strength plastic, preferably insert molded with the top end of track 812 therein. Trigger rod 808 can be metallic, such as extruded aluminum, or depending on the dimensions, extruded or molded plastic. Trigger head 802 can be plastic, preferably an ergonomic textured polymer molded or glued onto the end of trigger rod 808. Hook rod 820 should be metallic, preferably a metal of high hardness and low ductility. Clamp body 830 can be metallic such as die cast zinc with machined threads (and optionally a machined inner conical surface), or a durable and high strength plastic insert molded on the lower end of the track 812. If clamp body 830 is made of plastic, a relatively thin conical metallic insert may optionally be placed inside body 830 to provide a more durable inner conical surface 845. Cage 831 could be machined steel, or molded durable plastic. Endcap 837 can be plastic or metal and need not be that strong unless part of an alternate lower connection means (which is preferably extruded aluminum or steel). The wallbar should be light but durable and rigid, and can thus be an injection-molded plastic such as Lexan®, a glass fiber or carbon filled plastic, or a metal such as a strong aluminum alloy. It may also be insert molded with a straight edged metallic strip protruding somewhat similar to common wooden rulers. Materials should all be chosen for non-reactivity with each other and common frame materials, and exposed metal moving parts that might leave marks on the wall should be taped or sprayed with plastic, etc.

Figure 56A:
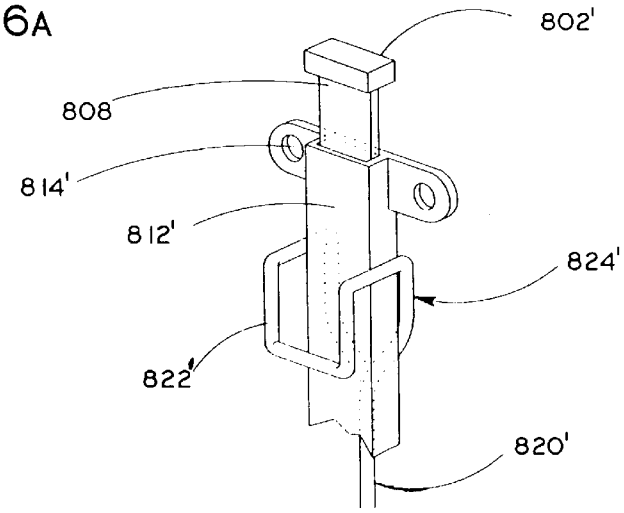
FIG. 56A is a partial perspective cutaway view of an embodiment similar to that of FIG. 42 but utilizing an alternate track, hook, trigger, and hookrod configuration.
Figure 62:
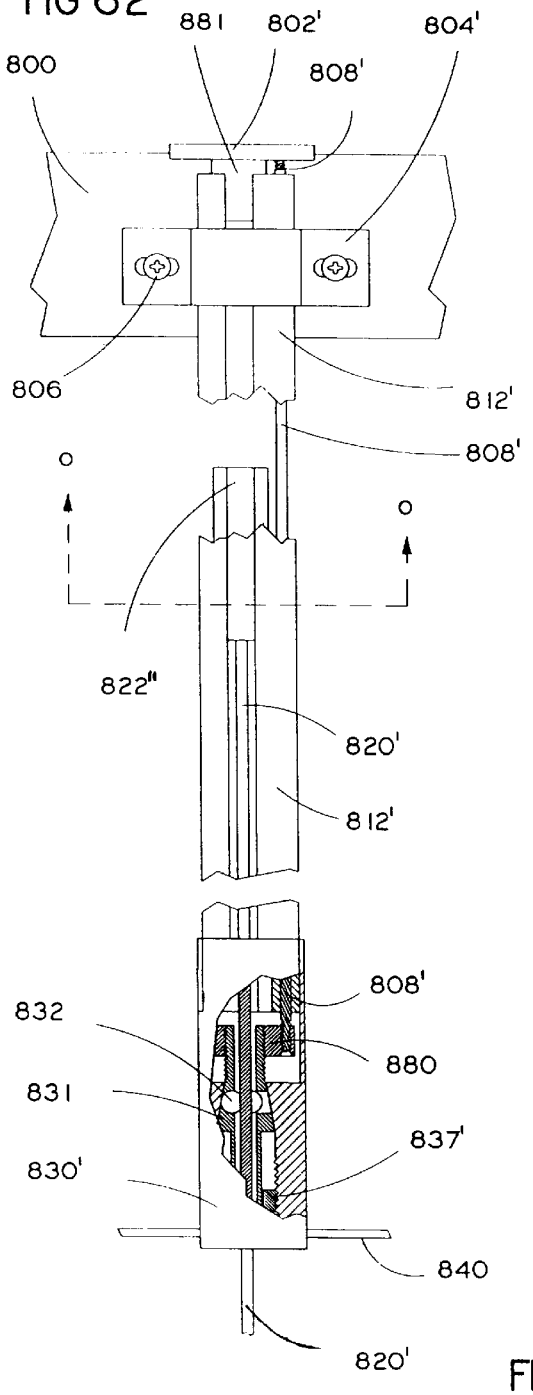
FIG. 62 is a front cutaway view of an embodiment similar to that of FIG. 42 but utilizing an alternate track, hook, and trigger configuration.
Figure 63:
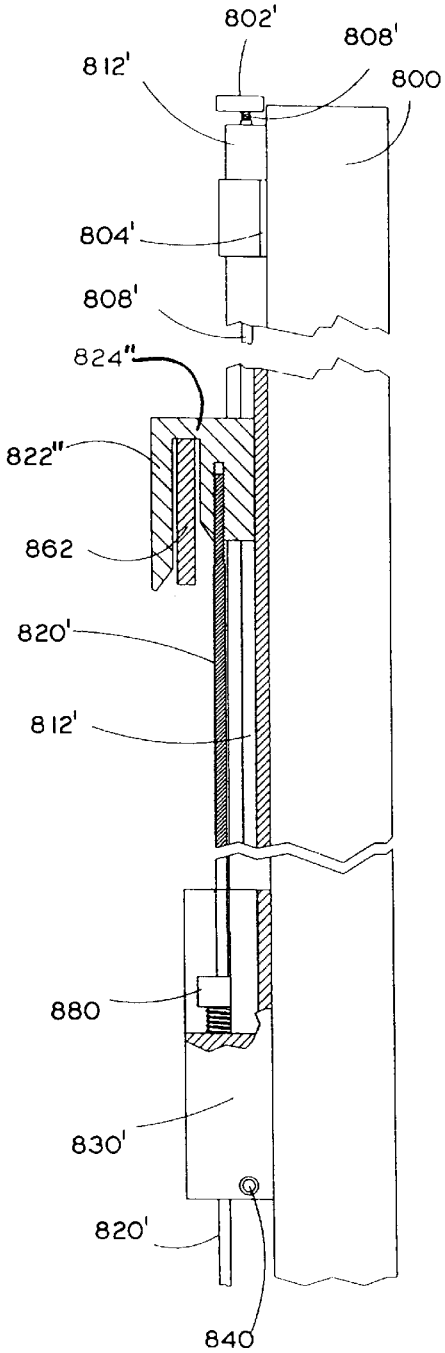
FIG. 63 is a partial sectional cutaway view of the embodiment of FIG. 62.
Figure 64:
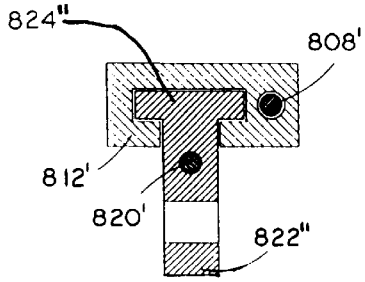
FIG. 64 is a sectional view taken through the line O—O of FIG. 62, showing the mating of hook and track.

The foregoing relative trigger rod/track/hookrod configuration can be modified in many ways, and the trigger may be not captivated by the track if the trigger is made of a suitably rigid material and is not too long. Further, as shown in FIG. 56A, the hookrod could be placed behind the track rather than coplanar with its front face (which also shows a simplified hook 824 formed by bending the end of hookrod 820'). As one of many other readily apparent examples, FIGS. 62–64 show an embodiment similar to that shown in FIGS. 42–61 but with a track 812' having separately compartmentalized trigger and hook rods (808' and 820' respectively) with the trigger rod 808' being offset. Also, the hook 824 is simpler, primarily internal to the track 812', and has a "T" cross-section as shown in FIG. 64 taken through line O—O of FIG. 62. This allows hook 822' to be guided by track 812' without having to wrap around it. Also, to accommodate the offset of the trigger rod 808' compared to cage 831, connector 880 is provided connecting the two; similarly, modified trigger head 881 is provided for the top end of trigger rod 808', and includes a lower guiding portion that slidingly mates within the channel of track 812'.

An optional feature also applicable to the embodiment of FIGS. 42–61 are the horizontally extended screwholes for screws 806, which allow minor adjustments to be made by, e.g., the custom framer, to compensate for discrepancies in measurement or weighting that might otherwise result in a tendency for the item to hang out of level. This adjustment can be made by loosening screws 806, sliding cap 804 (along with the top of the entire track assembly) left or right as necessary and retightening screws 806.

It should be noted that embodiments such as those of FIGS. 42–64 are adaptable to a wide range of other applications where vertical adjustability of an element is desired. An office chair having an articulated chair-back of selectable height is but one of many examples. These embodiments are also very useful in any application where a remote activation trigger is desirable.

Figure 65:
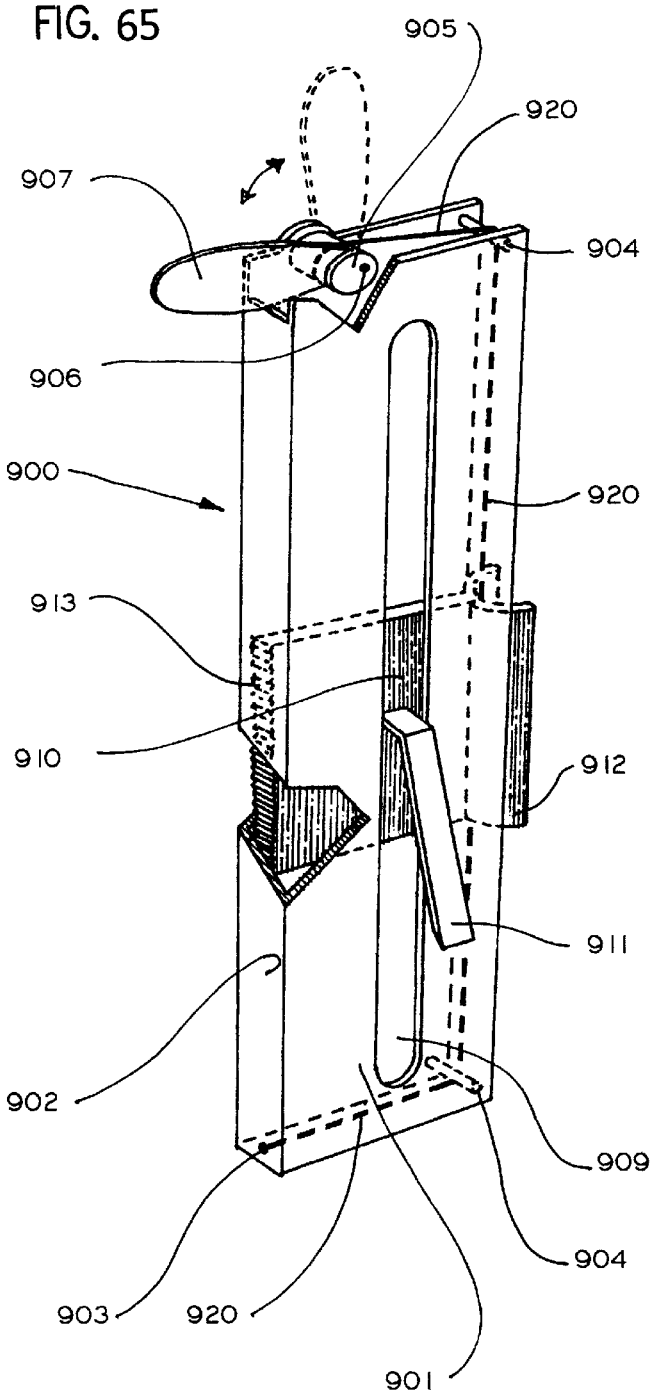
FIG. 65 is a cutaway transparent perspective view of a two-way adjustable embodiment, showing how the vertical adjustability is activated and deactivated by a finger lock.
Figure 66:
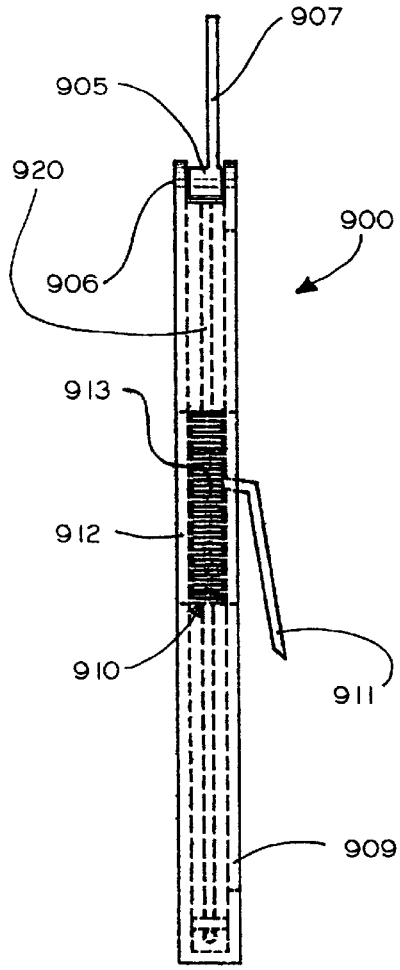
FIG. 66 is a side transparent view of the embodiment shown in FIG. 65.

FIGS. 65–66 illustrate a taut cable and finger locking embodiment 900. This embodiment includes a vertical locking box 901 which is generally prism-shaped with a thin cross-section (shown from the left in FIG. 66) and is attached (attachment not shown) to the rear of an item to be hung (not shown), and includes a vertically adjustable hook 911 which points downwardly and mounts on a wallbar. Box 901 has a closed top and bottom and four sides; the side shown on the left in FIG. 65 is closed, while the opposite side (right) has an opening running down most of its length. The side of box 901 which faces the wall (shown in the front in FIG. 65) has a slot 909 running vertically down its center for most of its length. Hook plate 910 slides vertically along the hollow interior of box 901 with attached hook 911 projecting through slot 909.

The interior of box 901 that is shown on the left side of FIG. 65 includes a brake pad 902 which opposes brake teeth 913 of hook plate 910. Hook plate 910 includes on its other side cable catch channel 912, which slidingly projects through the vertical opening on that side of box 901. Box 901 also includes at its bottom end a fixed cable attachment point 903 and cable guide 904. At its top end box 901 has another cable guide 904 and an axle 906 which is connected to, but free to revolve within its connection to, box 901. Axle 906 is fixedly attached to cable wheel 905 which in turn is fixedly connected to manual locking lever 907. Cable 920 is attached to an appropriate point on the outer diameter of wheel 905 and runs around the top side to the right side to the bottom end of box 901, passing over guides 904 and cable catch channel 912, and terminating at fixed attachment point 903 to which it is attached. When lever 907 is rotated to its counterclockwise position shown in FIG. 65, cable 920 cinches in against cable catch channel 912 (which can be coated with rubber to increase gripping), forcing hook plate 910 to the left which causes brake teeth 913 to impinge upon brake pad 902, fixing hook plate 910 in its vertical position, along with hook 911. When lever 907 is rotated somewhat clockwise as viewed in FIG. 65 to its other position (shown in phantom), cable 920 is loosened from channel 912, allowing hook 911 (and consequently plate 910) to slide up or down through slot 909 as desired. Wheel 905 may be oblong and its surrounding surface (not shown) on box 901 may be formed so that wheel 905 and lever 907 have two desired positions which require some amount of force to "get over the hump" and move between. Lever 907 may be placed as far as possible towards the wall-facing part of wheel 905, to allow box 901 to be placed further inwardly on the reverse side of the item to be hung without lever 907 hitting the item. Lever 907 can be sized such that is easily reachable, but just out of view behind the outer extent of the edge of the item to be hung when lever 907 is in its locked position (shown in solid in FIG. 65). Additionally, or alternatively, the connection between lever 907 and wheel 905 may be detachable, so that lever 907 can be removed from assembly 900 after adjustment, stored, and reconnected if further adjustment is desired. Also, channel 912 may have a cable guard (not shown) which closes the opening of channel 912 thereby preventing cable 920 from falling out.

Figure 67:
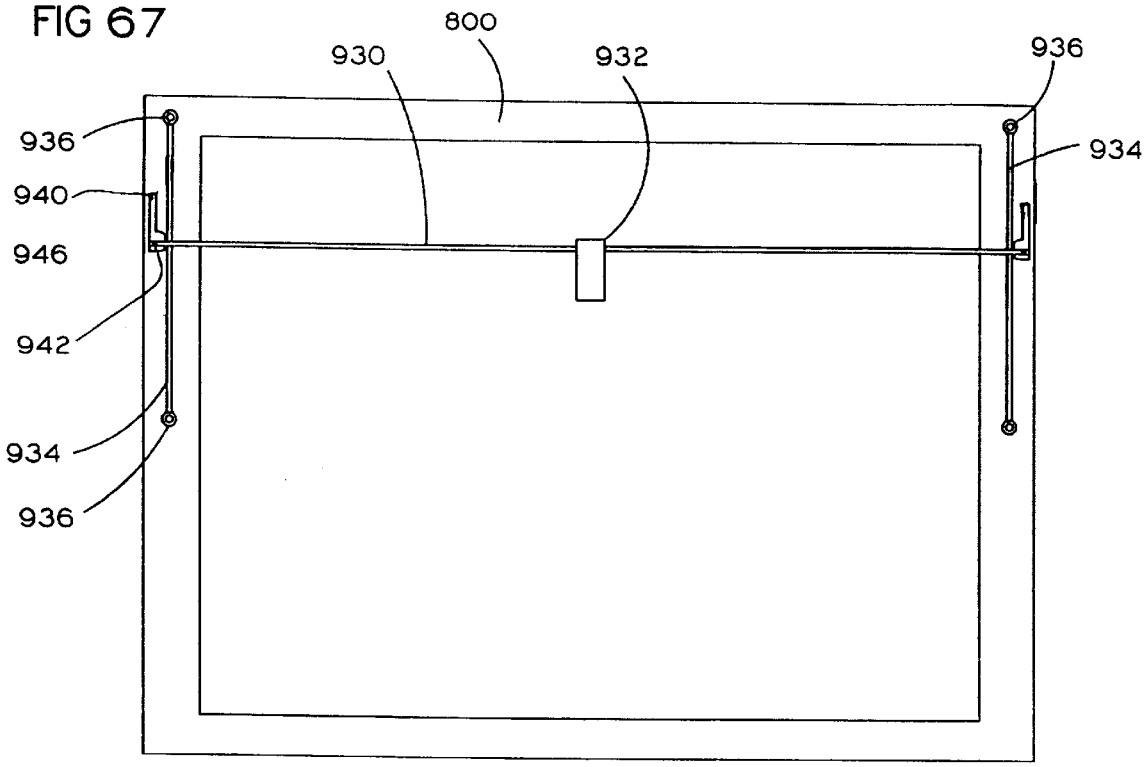
FIG. 67 is a front view of a two-way adjustable embodiment, showing how the vertical adjustability is activated and deactivated by dual finger locks at the edges of the frame.
Figure 67B:
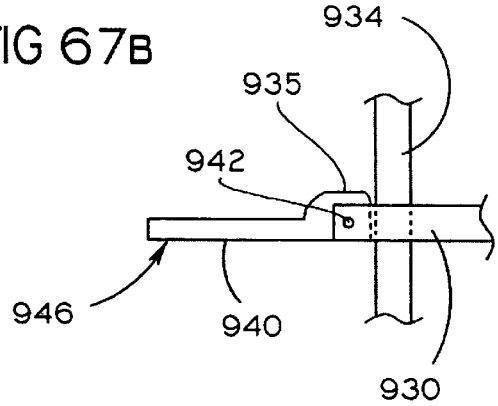
FIGS. 67B and 67C are a sequence of partial side transparent views showing how the finger lock of FIGS. 67 and 67A is locked.
Figure 67A:
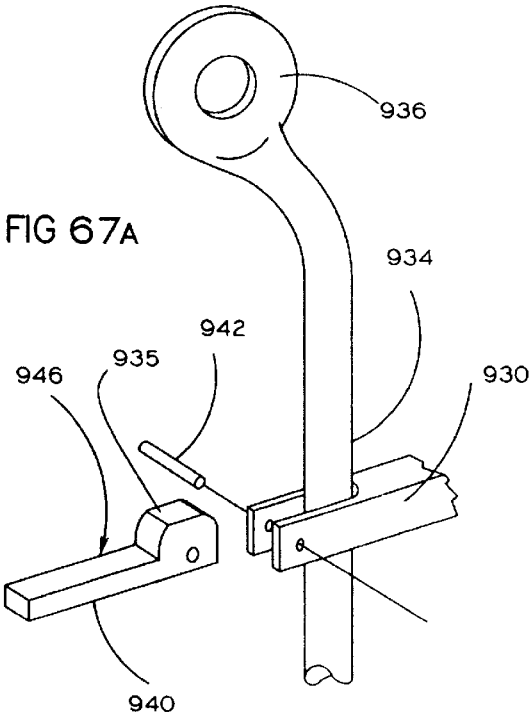
FIG. 67A is a partial exploded perspective close-up view of the finger lock of FIG. 67.
Figure 67C:
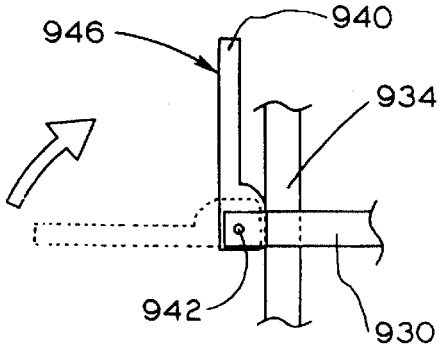

As shown in FIGS. 67–67C, another embodiment utilizes a locking crossbar 930 (or alternately a cable, not shown), wherein vertical adjustability is activated and deactivated by one or more finger locks 946 at the edge of frame 800. Similar to the embodiment of FIGS. 65–66, finger locks 946 can (as shown) rely on a cam mechanism, with levers 940 being placed near the edge of frame 800 allowing the user to conveniently unlock locks 946. Locking is the result of the cam 935 being forced against rod 934 when lever 940 is upwardly rotated on axle 942. Crossbar 930 is free to slide up and down along rods 934 when locks 946 are unlocked, but is secured to them at any desired vertical level where locks 946 are locked. In order to accommodate crossbar 930, rods 934 are spaced slightly away from the rear of frame 800, with a concomitant slight bend placed in rods 934 where they connect to eyelets 936. At the center of crossbar 930 is affixed downward pointing hook 932 for seating on a wallbar. An alternate embodiment could be manufactured into a frame with finger locks neatly and flushly incorporated into the frame's edges. In such an embodiment, rods 934 could be replaced by slots through the frame's side edges, running parallel to the plane of the frame and bisecting the frame edges into two layers over part of their vertical length. In this version, the cams could have a female fork connection to the axle with the crossbar being male rather than vice versa, and a first vertically running abutment would be placed in the aforementioned slots immediately between the cam and a pair of second abutments placed on the crossbar near the axle, so that the first abutment would be clamped between the cam and the second abutments when the levers are up, precluding movement of the crossbar.

Figure 68:
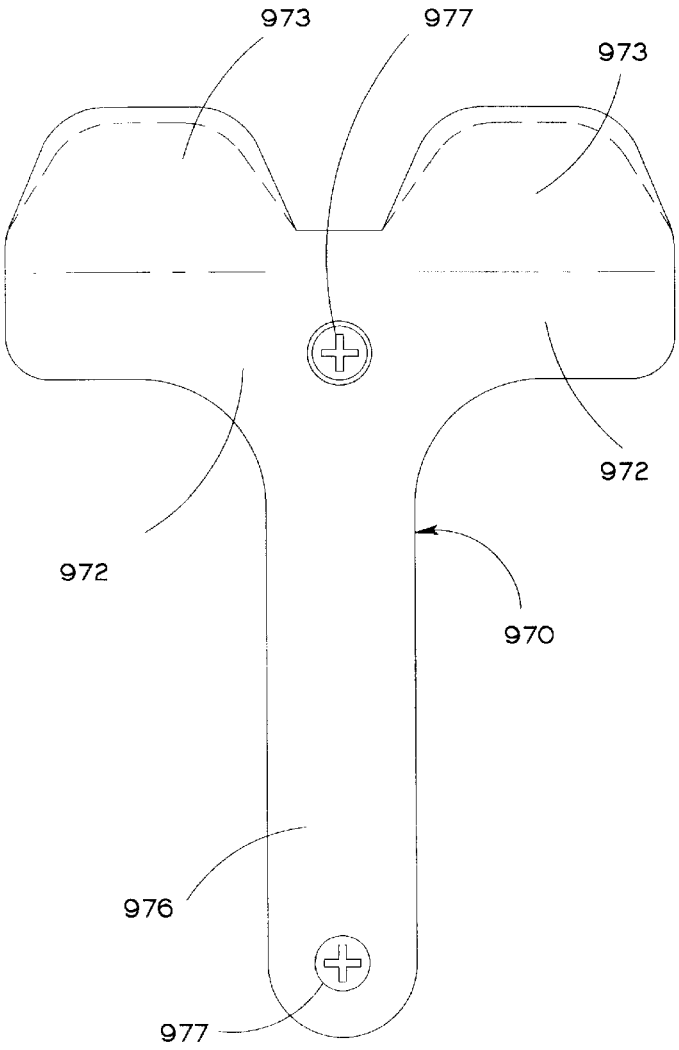
FIG. 68 is a front transparent view of an embodiment that allows for placement of an item off center from a stud, showing how the embodiment is fixed to the wall.
Figure 69:
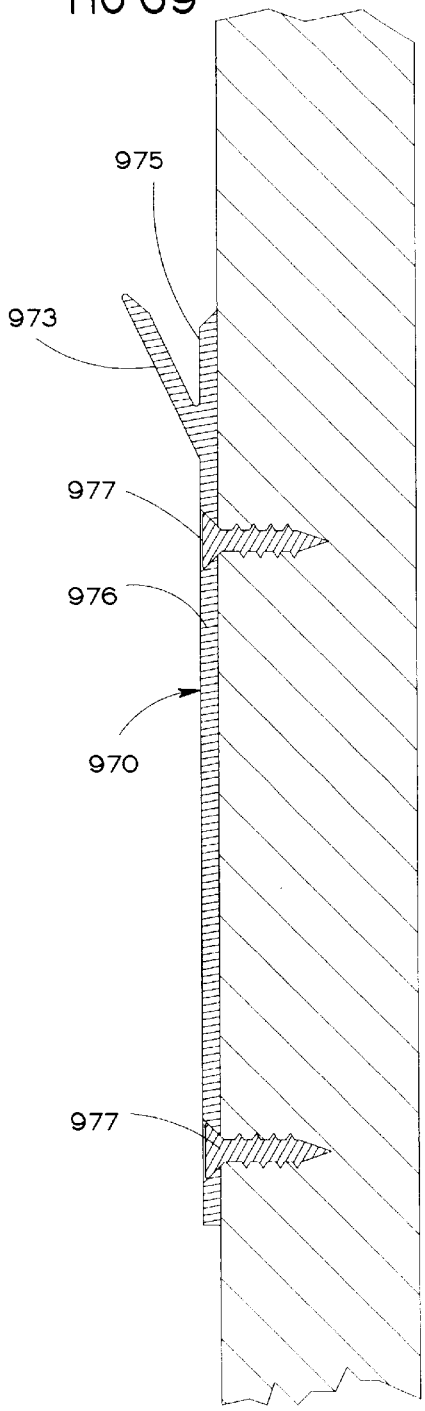
FIG. 69 is a side view of the embodiment of FIG. 68.

FIGS. 68 and 69 show a stud extender 970 that allows for placement of an item off-center from a stud while nevertheless utilizing the stud's support. FIG. 68 shows a front view, and FIG. 69 a side cross section of this embodiment, the main purpose of which is to allow an item to be placed at a desired lateral position on the wall, even though there is not a stud exactly at the centerline through that position. This embodiment includes a horizontal bar 972 and a vertical bar 976, and is formed to attach to a stud with screws or nails at vertically aligned points of attachment 977. The dual points of secure attachment inhibit the hanger from twisting or ripping out of the wall, even when the load's center of gravity is not in line with the hanger. In use, the horizontal hanging wire typically placed on the back of frames, or a channel or recess found on many frames, may be placed on hooks 973 and slid horizontally left or right to a desired position. Keepers 975 prevent a wire from slipping past horizontal bar 972 and wedging behind it. A horizontal bar 972 long enough in relation to the weight and horizontal length of the item to be hung to allow decent lateral play without the item falling out of level, should be selected.

Also (not shown), means for allowing manual vertical adjustment of a stud extender can be provided, for example by doubling the vertical length of the vertical bar and adding a second, independent vertical bar underneath it and about half its size, with corresponding vertical slots (for inserting two screws or nails through) extending the length of both vertical bars. A screw and wingnut or alternate means can be placed through the slots above the higher of the two fixed screws (or nails), for tightly securing the two vertical bars together at a desired vertical position.

General Discussion Pertaining to Multiple Embodiments of the Invention

With virtually all of the embodiments described above, and with most applications, any physical obstruction ("gap") and angle of pitch between the hanging item and the wall (or other hanging surface) should be kept below a degree that would be functionally detrimental or aesthetically unpleasing. The gap and pitch associated with a given embodiment of non-recessed adjustable hanger will in most cases tend to increase with the weight of the hanging item, and as the hanging item is adjusted to hang toward its highest vertical location. However, as the vertical size of the hanging item increases, the aesthetically acceptable gap between the hanging item and wall also generally increases somewhat. To reduce unwanted pitch, the portion of an adjustable hanger affixed to the hanging item can either be mounted in a recessed fashion, or bumpers may be placed at the bottom of the item. Gap can be minimized by mounting the hanger recessed flush with the frame back, and/or by simply minimizing the thickness of the hanger assembly as measured from the edge of the hook to the frame back.

Relative to horizontally-adjustable embodiments of the present invention for use in a typical picture hanging-type context, it is almost mandatory that there be two points of attachment to the vertical surface. If only one point of attachment is provided, the torque generated in the plane of the vertical surface by an item hanging with its center of gravity not exactly above the point of attachment will tend to cause rotation around the point of attachment, which results in the item hanging seriously off-level, or simply falling off altogether. Because vertical adjustment does not shift a hanging item's horizontal center of gravity, plural points of attachment to the vertical surface are not requisite in vertically-only adjustable embodiments.

The particular embodiments discussed in detail herein to illustrate the principles of the invention are not meant to limit in any way the scope of the claims that follow, or their legal equivalents. For example, many of the particular nuances and features that are described with regard to only certain embodiments herein are obviously applicable to, or interchangeable with those of, other embodiments. Various additional and/or substitutable features that are well known in the art need not discussed herein, as it will become readily apparent to anyone of ordinary skill in the art that such features are applicable without need for description thereof.

What is claimed is:

1. An adjustable hanger for use with an item to be hung on a substantially flat and vertical surface, the item having sides, a front and a rear, said hanger comprising:

(a) a support formed to be attached to the surface, and support including a hook with an upwardly pointing projection;

(b) a vertical track having a top and bottom formed to be affixed to the rear of the item, said track including a high friction front surface along at least a substantial part of its vertical length; and (c) a trap slidingly engaged with said track along said substantial part of the vertical length of said track, said trap including a pocket adjacent said high friction front surface, said pocket formed to receive said upwardly pointing projection in a wedging fashion against said high friction surface when said upwardly pointing projection is pushed upwardly into said pocket.

2. The hanger of claim 1, wherein said support is formed to be attached to the surface at a single, fixed point attachment.

3. The hanger of claim 1, wherein said support includes a horizontal member having a vertical slot defined therein and extending horizontally along a substantial portion of the horizontal length of said member, wherein said hook is engaged with said slot and horizontally sliding therein.

4. An adjustable hanger for use with an item to be hung on a substantially flat and vertical surface, the item having sides, a front and a rear, said hanger comprising:

(a) a support member including means for fixedly incorporating or attaching said support member to the substantially vertical and flat surface at two or more points;

(b) a vertical track having a top and a bottom and including means for fixedly incorporating or attaching at least the top and bottom of said track to the rear of the item to be hung;

(c) an interface vertically sliding on said track and formed to engage with said support member in a horizontally sliding manner; and (d) a substantially continuous, automatic lock connecting said interface to said track.

5. The hanger of claim 4, wherein said support member is a wallbar, said hanger further comprising a hook that includes a wallbar seating surface and a downwardly pointing projection, wherein said interface includes said seating surface and said downwardly pointing projection.

6. The hanger of claim 4, further comprising a manual activation means that is conveniently manually accessible when said track is incorporated or attached to the rear of the item, said support member is incorporated or attached to said surface, and said interface is engaged on said support member; wherein said manual activation means permits convenient unlocking of said lock so as to permit automatic adjustment of the item's vertical hanging position.

7. The hanger of claim 6, wherein said lock includes a cam and said manual activation means includes a finger lever.

8. The hanger of claim 4, wherein said lock is formed to be activated vertical adjustment by the manual application of a selected force or series of forces on a conveniently accessible portion of the item itself when said support member is incorporated or attached to said surface, said track is incorporated or attached to the rear of the item, and said interface is engaged on said support member.

9. The hanger of claim 8, wherein said track includes a vertical channel, said lock includes a biased portion, and said biased portion includes two biased feet, said feet placed within said vertical channel.

10. The hanger of claim 8, wherein said lock includes an element selected form the following group: wedge locks, biased flippers on box clamps, and brake traps.

11. The hanger of claim 4, wherein said support member is formed to built into the substantially flat and vertical surface, along approximately a full uninterrupted horizontal length thereof.

12. An adjustable hanger for use with an item to be hung on a substantially vertical support, the item having sides, a front and a rear, said hanger comprising a horizontal support member formed to be fixedly incorporated into or attached to the substantially vertical support, said hanger further comprising a vertical track assembly having a top and a bottom, said track assembly including:

(a) means for fixedly incorporating or attaching at least the top and bottom of said track assembly to the rear of the item to be hung;

(b) a vertically sliding interface, said interface including means for engaging with said horizontal support member in a horizontally sliding manner;

(c) a substantially continuous vertical length of track along which said vertically sliding interface can slide; and (d) an automatic lock connected to said interface.

13. The device of claim 12, wherein said lock is fixedly connected to said interface and vertically slides with said interface along said track.

14. The device of claim 12, wherein said support member is formed to be built into the substantially vertical support, along approximately the full horizontal length thereof.

15. The hanger of claim 12, wherein said track assembly further comprises a manual activation means that is conveniently manually accessible when said track assembly is incorporated or attached to the rear of the item, said support member is incorporated or attached to said substantially vertical support, and said interface is engaged on said support member; wherein said manual activation mean permits convenient unlocking and locking of said lock so as to permit automatic adjustment of the item's vertical hanging position.

16. The hanger of claim 15, wherein said lock includes a cam and said manual activation means includes a finger lever.

17. The hanger of claim 16, wherein said track assembly is bifurcated into separate left and right vertical tracks, with at least the top and bottom of said left and right tracks being formed to be affixed to the rear of the item at or near the item's left and right edges; wherein said track assembly further includes a crossbar connecting said left and right vertical track and wherein said lock includes left and right cams, said manual activation means includes left and right finger levers, and said interface includes a downwardly pointing hook located on said crossbar, halfway between said left and right vertical track.

18. The hanger of claim 12, wherein said lock is formed to be activated for vertical adjustment by the manual application of a selected force or series of forces on a conveniently accessible portion of the item itself when said horizontal support member is incorporated or attached to said substantially vertical support, said track assembly is incorporated or attached to the rear of the item, and said interface is engaged on said support member.

19. The hanger of claim 18, wherein said length of track includes a vertical channel, said lock includes a biased portion, and said biased portion includes two biased feet, said feet placed within said vertical channel.

20. The hanger of claim 18, wherein said lock includes an element selected from the following group: wedge locks, biased flippers in box clamps, and brake traps.

* * * * *